US005299795A

United States Patent [19]

Miyake

[11] Patent Number: 5,299,795

[45] Date of Patent: Apr. 5, 1994

[54] SHEET FEEDING APPARATUS

[75] Inventor: Norifumi Miyake, Kawasaki, Japan

[73] Assignee: Canon Kabushiki Kaisha, Tokyo, Japan

[21] Appl. No.: 960,931

[22] Filed: Oct. 14, 1992

[30] Foreign Application Priority Data

Oct. 15, 1991 [JP] Japan ..... 3-266188
Oct. 8, 1992 [JP] Japan ..... 4-270201

[51] Int. Cl.[5] ..... B65H 3/06

[52] U.S. Cl. ..... 271/9; 271/111; 271/270

[58] Field of Search ..... 271/9, 110, 111, 265, 271/270

[56] References Cited

U.S. PATENT DOCUMENTS 5,042,793 8/1991 Miyake .
5,213,320 5/1993 Hirota ..... 271/110 X
5,221,949 6/1993 Miyamoto ..... 271/111 X

*Primary Examiner*—Richard A. Schacher
*Attorney, Agent, or Firm*—Fitzpatrick, Cella, Harper & Scinto

[57] ABSTRACT

A sheet feeding apparatus having a sheet deck for stacking a plurality of sheets and accommodating the sheets, a separation unit for separating the sheets stacked on the sheet deck one sheet after another, a sheet detecting unit mounted at the downstream of the separation unit for detecting the sheet separated by the separation unit, and a controller for activating again, if the sheet detecting unit does not detect the sheet after the start of the operation of the separation unit, the separation unit at a lower operation speed, and if the sheet detecting unit detects the sheet thereafter, setting the operation speed of the separation unit to an original speed.

9 Claims, 64 Drawing Sheets

| FIG. 1A | FIG. 1B | FIG. 1C |
|---|---|---|

SHEET FEEDING APPARATUS

BACKGROUND OF THE INVENTION

1. Field of the Invention

The present invention relates to a sheet feeding apparatus for feeding sheets from a sheet stacker.

2. Related Background Art

In a conventional large capacity sheet deck for transporting sheets on a transport path and feeding sheets to an image forming apparatus, a sheet transport speed is set at a high speed in order to maximize the image forming efficiency.

With a conventional sheet deck, a probability of error occurrence of the sheet separating operation increases as the transport speed becomes high. Upon occurrence of a sheet separating error, the image forming operation is intercepted, lowering the image forming efficiency.

On the contrary, if the sheet transport speed is lowered in order to reduce the probability of separation error occurrence, obviously the total image forming efficiency is lowered.

If the sheet separation operation is resumed under the same condition after a separation error, the succeeding separation operation is associated with a high probability of separation error.

In an image forming apparatus having a both-side mode for forming images on both sides of a sheet and a multiple mode for forming a plurality of images on the same side of a sheet, sheets are temporarily loaded in an intermediate tray during the image forming operation, and thereafter the sheets are again fed.

Also with such an image forming apparatus, if refeeding from sheets from the intermediate tray is speeded up in order to improve the image forming efficiency per unit time, a probability of sheet separation error at the intermediate tray increases. The image forming operation is therefore intercepted, lowering the image forming efficiency.

On the contrary, if the sheet transport speed is lowered in order to reduce the probability of sheet separation error, obviously the total image forming efficiency is lowered. If the image forming operation is intercepted by an occurrence of separation error, the image forming operation already carried out prior to the error occurrence becomes wasteful. and Not only the sheet, but also expendables such as toner, ink and the like consumed during the image forming operation also becomes wasteful In addition, sheets remain on the intermediate tray so that the recovery operation of the apparatus becomes very complicated.

SUMMARY OF THE INVENTION

It is an object of the present invention to provide a sheet feeding apparatus eliminating the above-described disadvantages.

It is another object of the present invention to provide a sheet feeding apparatus, capable of lowering the image forming efficiency as little as possible, by performing the recovery operation for a sheet separation error without intercepting the image forming operation.

It is a further object of the present invention to provide a sheet feeding apparatus capable of not wasting sheets loaded in the intermediate tray, by performing the recovery operation for sheet separation error at the intermediate tray without intercepting the image forming operation.

It is a still further object of the present invention to provide a sheet feeding apparatus capable of lowering the image forming efficiency as less as possible, by reducing the sheet separation operation speed when a sheet separation error occurs and thereafter again performing the sheet separation operation.

The other objects of the present invention will become apparent from the following description when read in connection with the accompanying drawings.

DETAILED DESCRIPTION OF THE PREFERRED EMBODIMENTS

Embodiments of the present invention will be described below.

1st Embodiment

Figures 1, 1A:
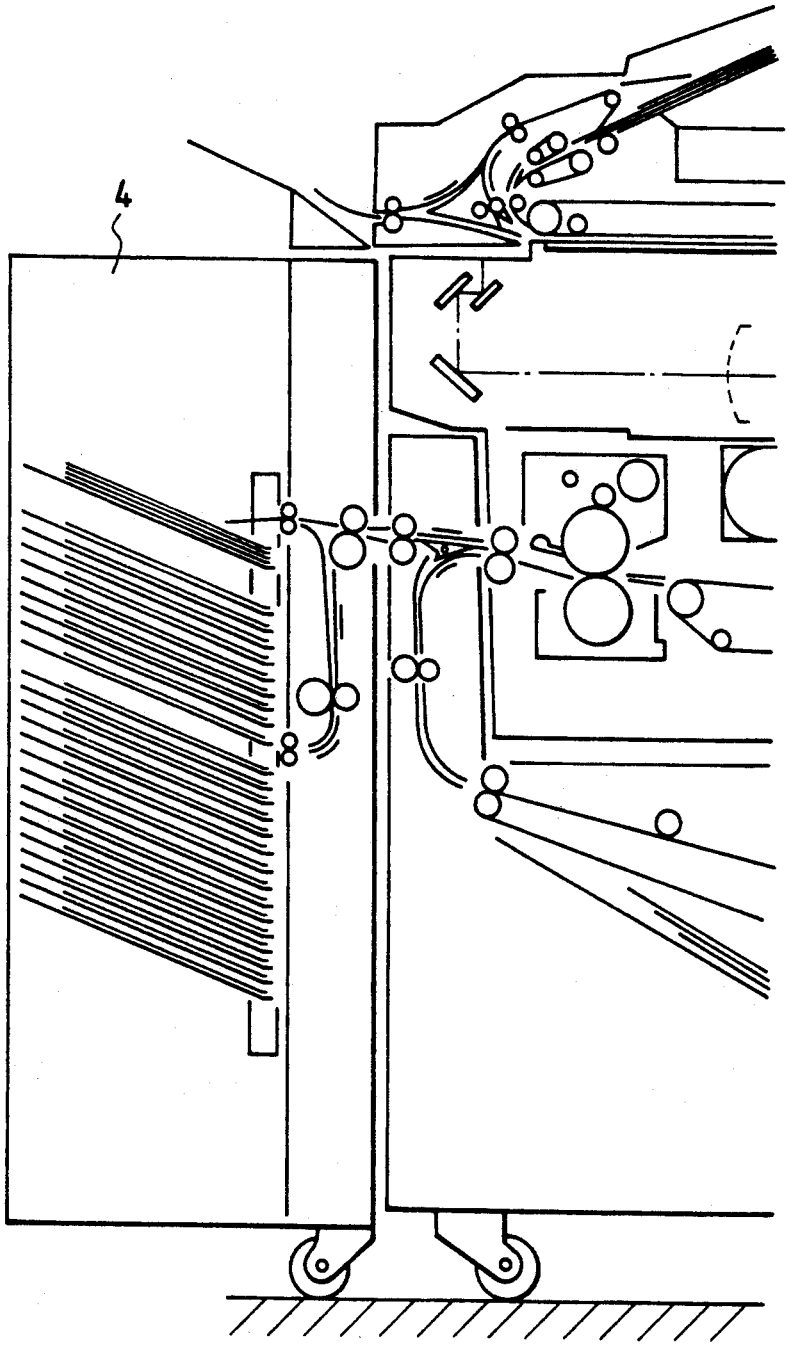
FIG. 1 comprised of FIGS. 1A, 1B, and 1C, is a cross sectional view showing the structure of a copier to which the present invention was applied.
Figure 1B:
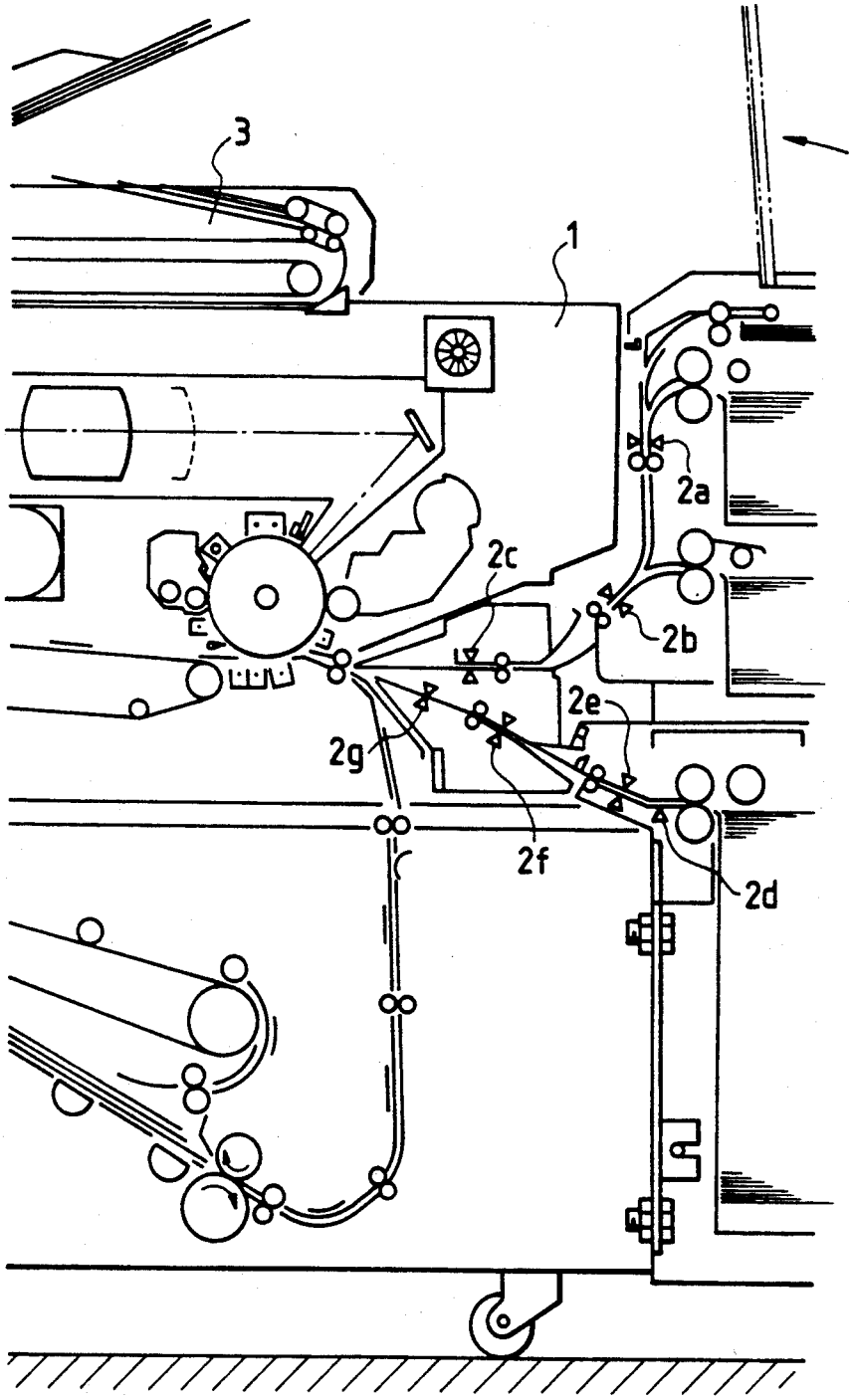
Figure 1C:
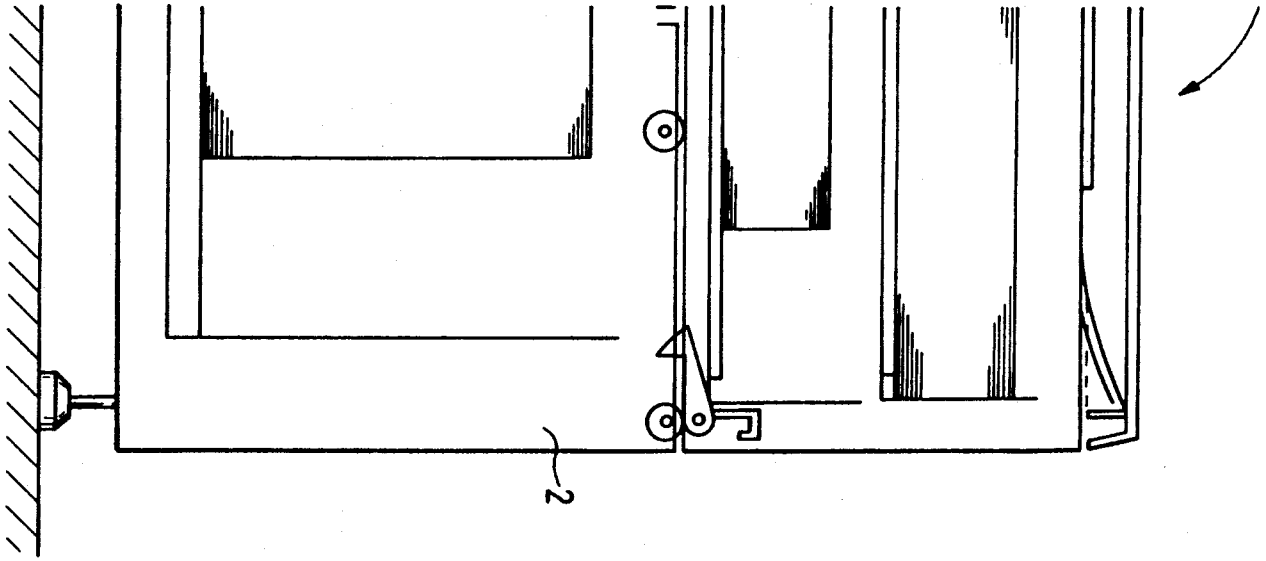
Figure 2:
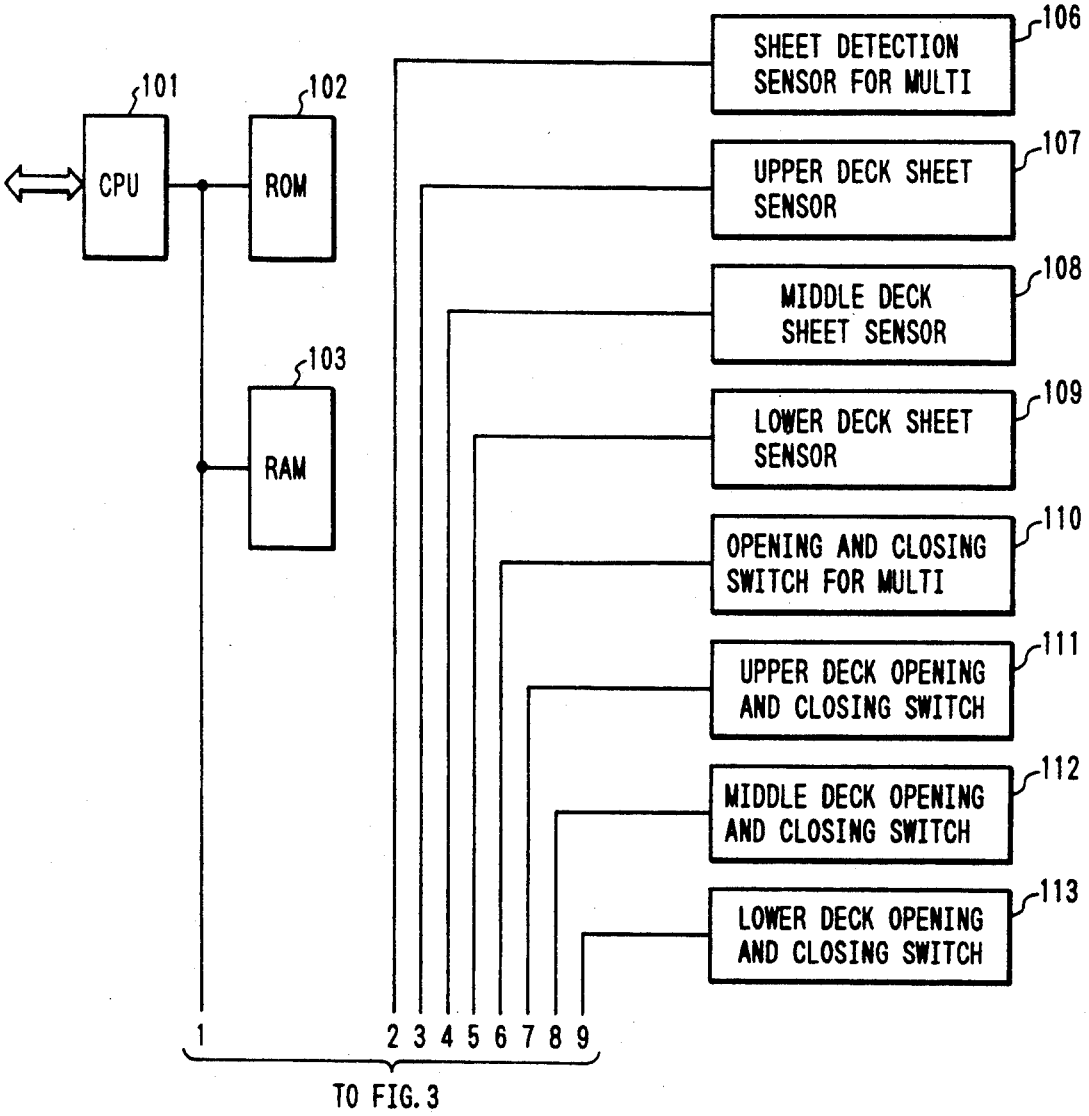
FIG. 2 is a block diagram showing part of a control circuit according to an embodiment of the present invention.
Figure 3:
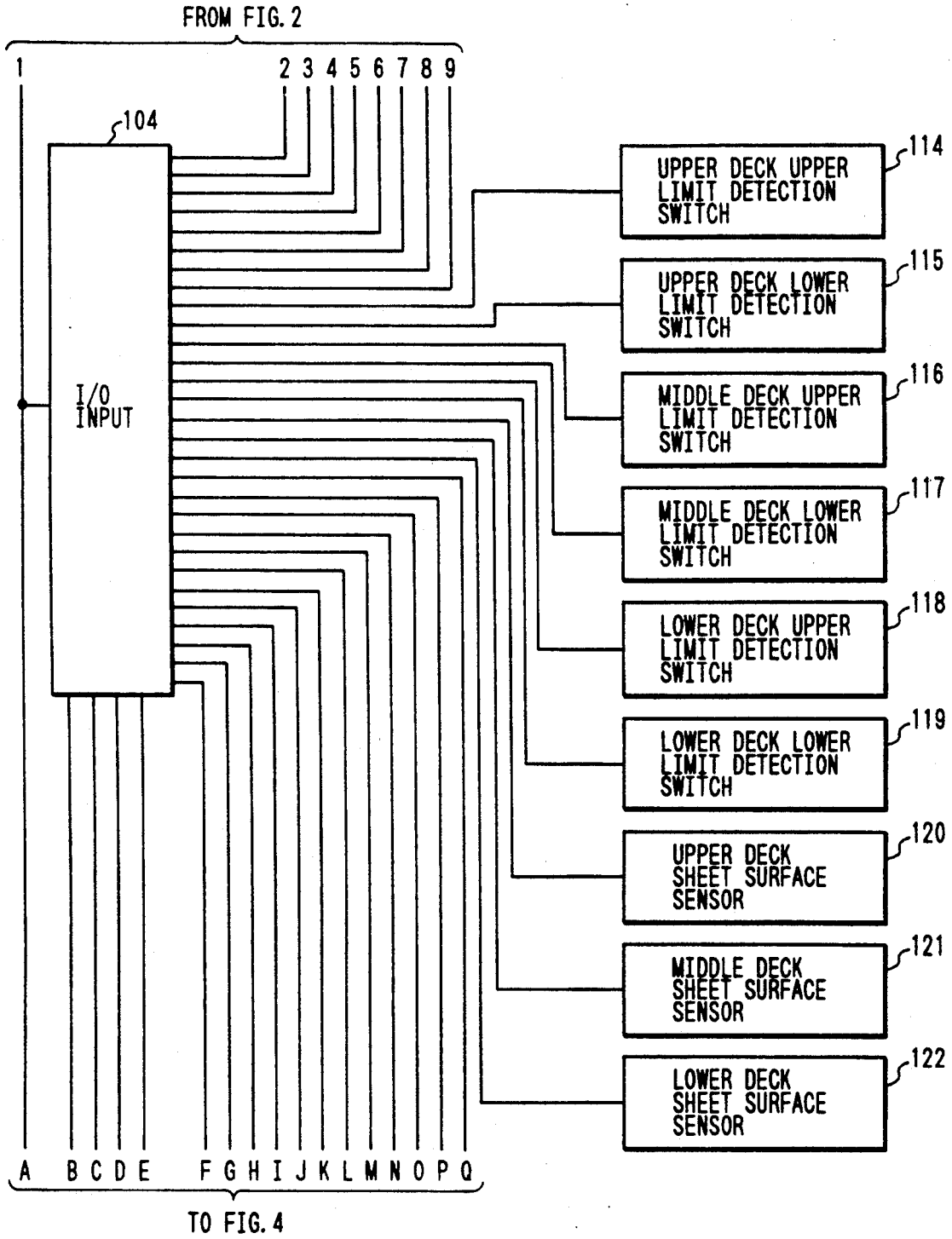
FIG. 3 is a block diagram showing part of the control circuit of the embodiment.
Figure 4:
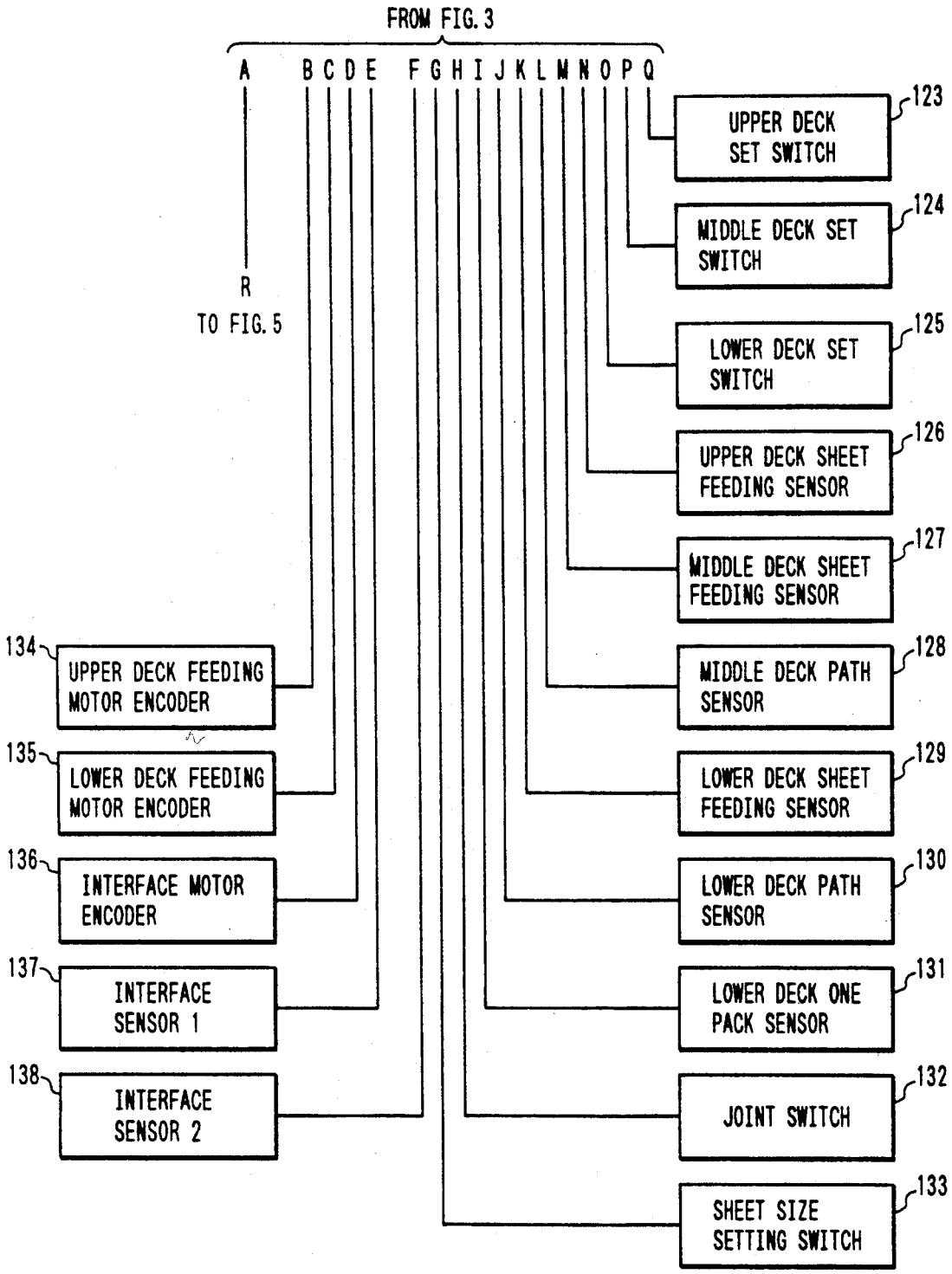
FIG. 4 is a block diagram showing part of the control circuit of the embodiment.
Figure 5:
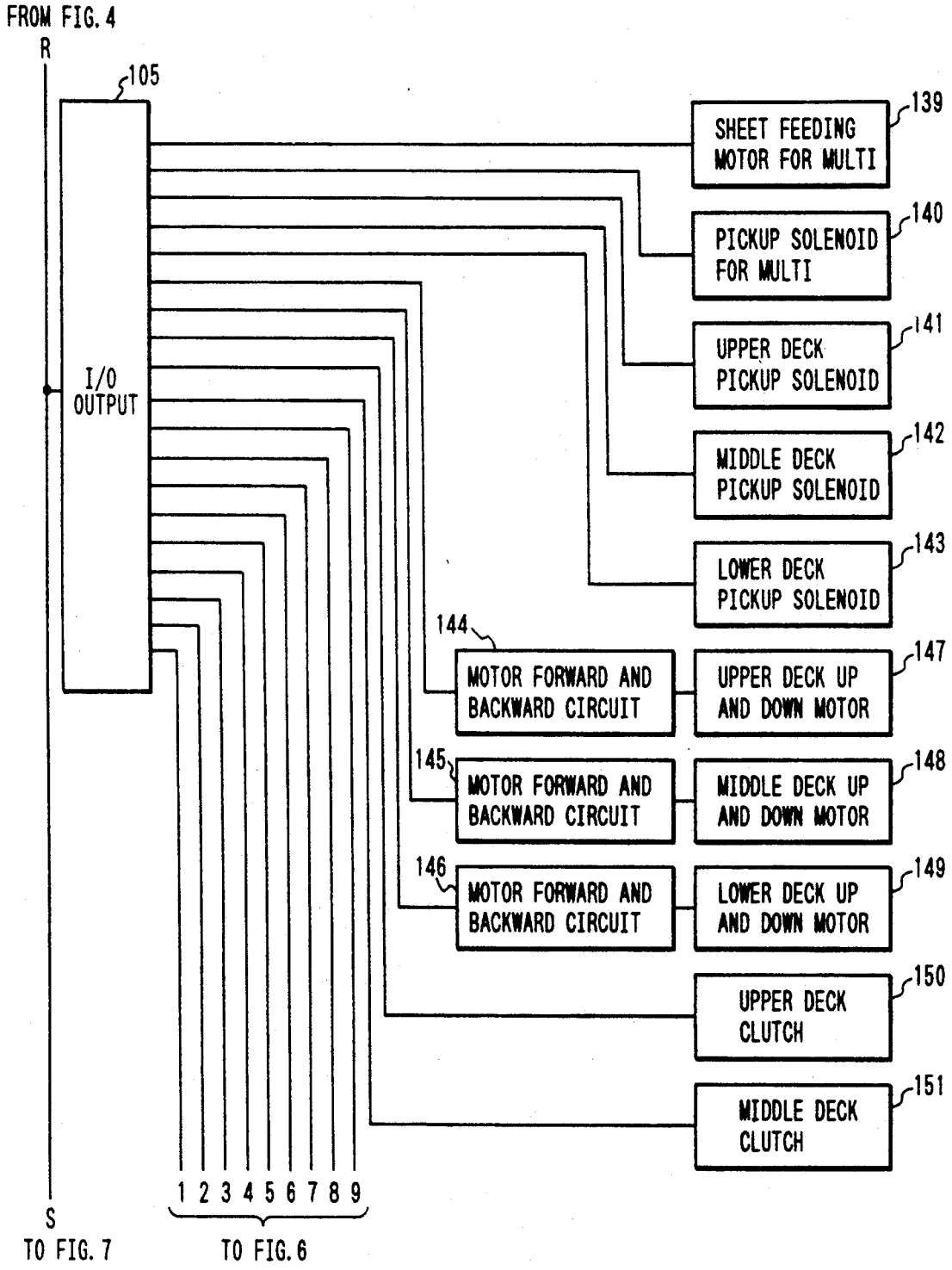
FIG. 5 is a block diagram showing part of the control circuit of the embodiment.
Figure 6:
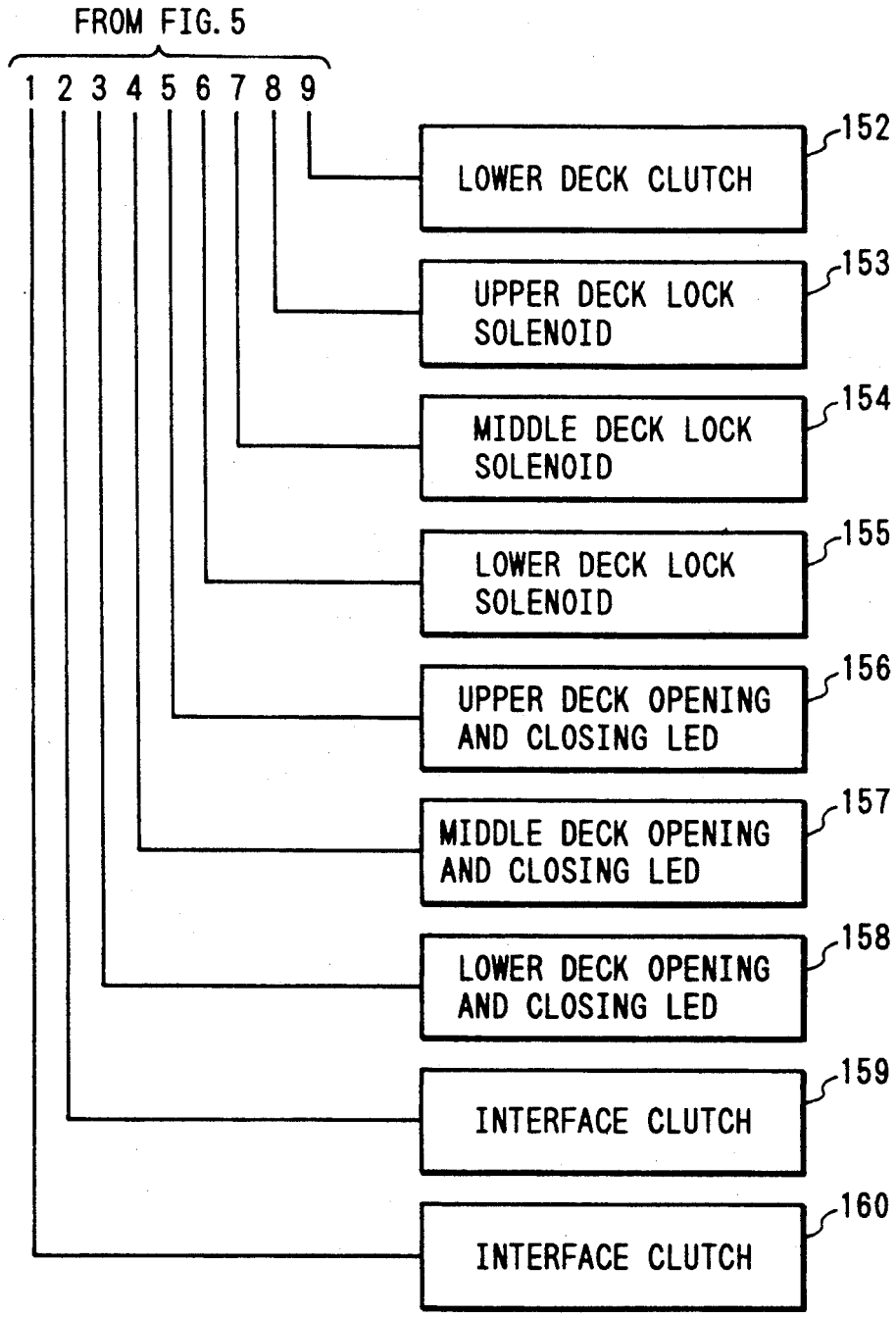
FIG. 6 is a block diagram showing part of the control circuit of the embodiment.
Figure 7:
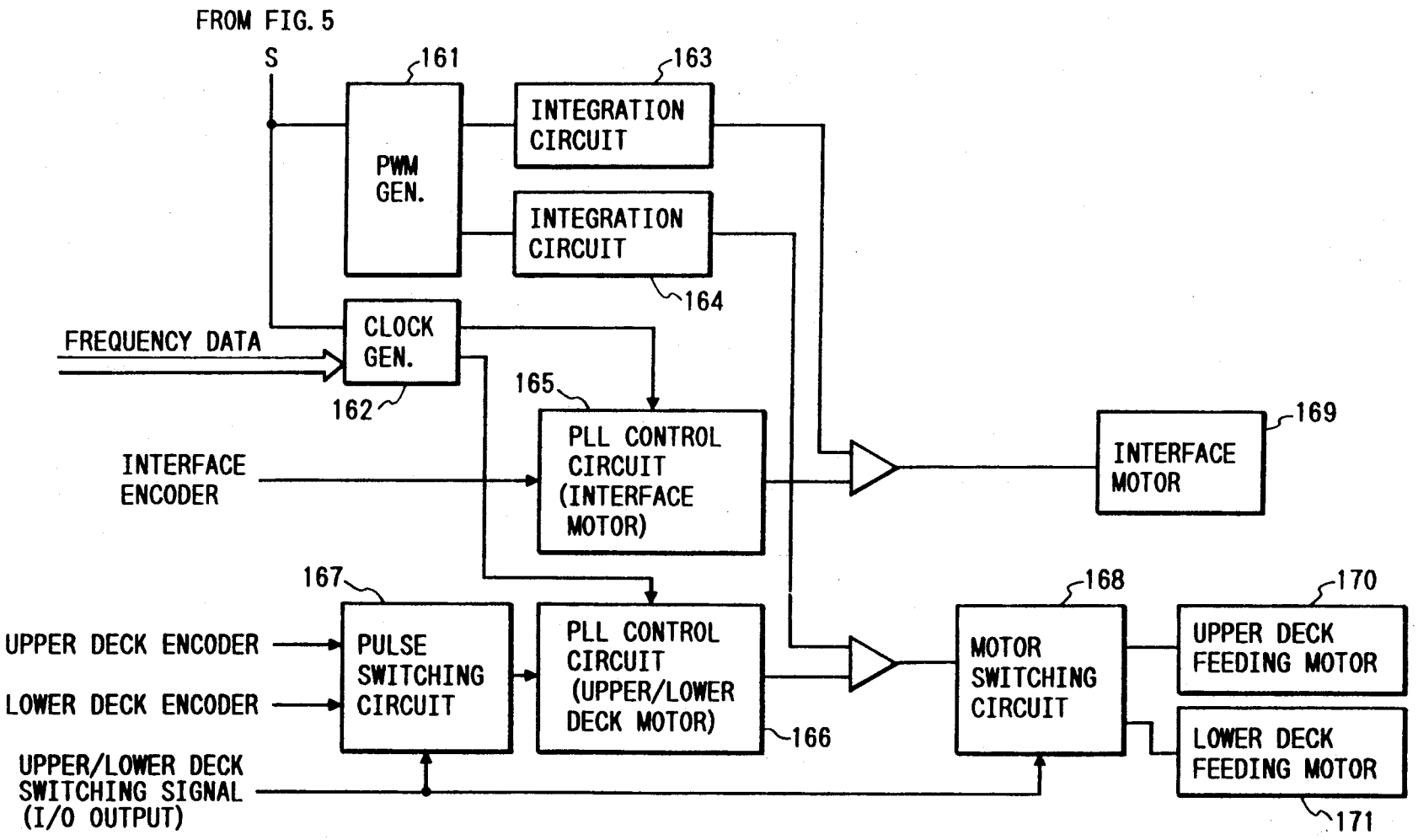
FIG. 7 is a block diagram showing part of the control circuit of the embodiment.

FIG. 1 is a diagram showing a copier system to which the present invention was applied. In FIG. 1, the copier is generally designated by reference numeral 1.

Reference numeral 2 represents a large capacity front loading deck (hereinafter called PFU) having three different decks including upper/middle/lower decks and a multi sheet manual feeding unit. The upper and middle decks are structured to be picked up in a sliding manner in order to improve the jamming release operation. Reference numeral 2*a* to 2*g* represent sensors for controlling transport timings of a sheet sent from PFU and monitoring jamming on a transport path.

Reference numeral 2*a* represents an upper deck sheet feeding sensor, reference numeral 2*b* represents a middle deck sheet feeding sensor, reference numeral 2*c* represents a middle deck sensor, reference numeral 2*d* represents a lower deck sheet feeding sensor, reference numeral 2*e* represents a lower deck sensor, reference numeral 2*f* represents an interface sensor 1, and reference numeral 2*g* represents an interface sensor 2.

Reference numeral 3 represents an automatic original feeding unit (hereinafter called RDF) with an original reversing mechanism.

Reference numeral 4 represents a sorter which sorts discharged sheets in any one of the modes (non-sort, sort, group) set by the copier.

FIGS. 2 to 7 are electric circuit block diagrams of the copier according to the embodiment of the present invention.

PFU 2 is constructed of CPU 101, ROM 102, RAM 103, I/O devices 104 and 107 and the like which constitute the controller for controlling the entirety of the copier.

First, sensors connected to the I/O device input unit 104 will be described.

(1) Sheet Detection Sensor for Multi 106

Detecting whether sheets are placed on the multi sheet manual feeding unit. (2) Upper/Middle/Lower Deck Sheet Sensors 107 to 109

Detecting whether a sheet is placed on any one of the upper/middle/lower decks.

(3) Opening and closing Switch for Multi 110

Detecting the open/close state of the cover of the multi sheet manual feeding unit.

(4) Upper/Middle/Lower Deck Opening and Closing Switches 111 to 113

Being depressed when any one of the upper/middle/-lower decks is to be pulled out.

(5) Upper/Middle/Lower Deck Upper Limit Detection Switches 114, 116, 118

Detecting whether any one of the upper/middle/-lower decks has been raised to an upper limit position (6) Upper/Middle/Lower Deck Lower Limit Detection Switches 115, 117, 119

Detecting whether any one of the upper/middle/-lower decks has been raised to a lower limit position (7) Upper/Middle/Lower Deck Sheet Surface sensors 120 to 122

Detecting that the upper surface of a sheet placed on any one of the upper/middle/lower decks is at a predetermined position (8) Upper/Middle/Lower Deck Set Switches 123 to 125

Detecting whether any one of the upper/middle/-lower decks has been pushed in and set correctly.

(9) Upper/Middle/Lower Deck Sheet Feeding Sensors 126, 127, 129

Being mounted on a sheet transport path and obtaining a timing signal necessary for the transport sequence of a sheet transported from any one of the upper/middle/lower decks

(10) Middle/Lower Sensors 128, 130

Like the definition (9)

(11) Lower One Pack Sensor 131

Detecting whether the upper surface of a sheet in the lower deck of a large capacity is at a predetermined position, at which time detection is performed in order not to lower the sheet upper surface by a predetermined length.

(12) Joint Switch 132

Detecting whether any one of the upper/middle decks is being fitted properly in PFU. The upper/lower decks are structured to be pulled out from PFU at the joint section with the image forming apparatus 1, in order to improve the jamming relief operation.

(13) Sheet Size Setting Switch 133

Setting the size of a sheet placed on any one of the upper/middle/lower decks.

(14) Upper Deck Feeding Motor Encoder 134

Comprising a clock disk coaxially mounted on the output shaft of a feeding motor commonly used by both the upper/middle decks and a photo interrupter, and generating a pulse signal synchronously with the rotation of the feeding motor.

(15) Lower Deck Feeding Motor Encoder 135

Comprising a clock disk coaxially mounted on the output shaft of a feeding motor for the lower deck and a photo interrupter, and generating a pulse signal synchronously with the rotation of the feeding motor.

(16) Interface Motor Encoder 136

Comprising a clock disk coaxially mounted on the output shaft of a feeding motor for an interface unit and a photo interrupter, and generating a pulse signal synchronously with the rotation of the feeding motor.

(17) Interface Sensors 1, 2 137, 138

Being mounted on the transport path of the interface unit, and obtaining a timing signal necessary for the transport sequence of a sheet.

Next, loads connected to the I/O device output unit will be described.

(1) Sheet Feeding Motor for Multi 139

Driving a multi sheet feeding unit.

(2) Pickup Solenoid for Multi 140

Pushing a pickup roller to a sheet, the pickup roller sending out a sheet placed on the multi sheet manual feeding unit.

(3) Upper/Middle/Lower Deck Pickup Solenoids 141 to 143

Pushing a pickup roller to a sheet, each pickup roller sending out a sheet placed on a corresponding one of the upper/middle/lower decks.

(4) Upper/Middle/Lower Deck Up and Down Motors 147 to 149

Being connected to motor forward and backward circuits 144 to 146 and raising any one of the upper/-middle/lower decks as the amount of sheets reduces and lowers for the supply of sheets.

(5) Upper/Middle/Lower Deck Clutches 150 to 152

Electromagnetic clutches for transmitting the rotation of the upper deck feeding motor to the upper/middle deck feeding unit, and the rotation of the lower deck feeding motor to the lower deck feeding unit.

(6) Upper/Middle/Lower Deck Lock Solenoids 153 to 155

Activating latches for setting the upper/middle/-lower decks to the paper feeding apparatus.

(7) Upper/Middle/Lower Deck Opening and Closing LEDs 156 to 158

Being flashed while the upper/middle/lower decks are lowered for pulling them out.

(8) Interface Clutches 1, 2 159, 160

Electromagnetic clutches for transmitting the rotation of the interface unit feeding motor to a plurality of drive motors mounted on the transport path of the interface unit.

Next, a PLL control unit for the feeding motors will be described.

In the sheet feeding apparatus of this embodiment, there are provided an upper deck feeding motor 170, a lower deck feeding motor 171, and an interface motor 109, which are subjected to a PLL control. The upper deck feeding motor 170 drives the feeding units of the upper/middle decks. The lower deck feeding motor 171 drives the feeding unit of the lower deck. The interface motor 169 drives the feeding unit at a junction unit transport path (interface unit) between the copier and the sheet feeding apparatus.

A clock generator 162 connected to CPU 101 generates clock pulses corresponding to the transport speeds of the upper/middle/lower decks and the transport speed of the feeding unit at the interface unit. The clock pulses are supplied to PLL control circuits 165 and 166.

The PLL control circuits 165 and 166 compare the frequencies and phases between the clock pulses and the encoder output pulses generated while the upper/middle deck feeding motors 170 and 171 rotate for driving the upper/middle/lower decks, and between the clock pulses and the encoder output pulses generated while the interface motor 169 rotates for driving the interface unit.

The obtained difference in the signals is compared with a sawtooth wave or triangular wave obtained by integrating a pulse outputted from a PWM pulse generator 161 connected to CPU 101, to thereby obtain a pulse duty ratio. The effective voltage applied to the feeding motor is changed with the pulse duty ratio, to make the feeding motor rotation speed constant.

A pulse switching circuit 167 operates to switch the drive operations of the upper/middle decks and the lower deck, by using a switching signal.

The clock pulse frequency of the clock generator 162 can be changed with frequency data supplied from CPU 101, to allow the motor rotation speed to be set to a desired value.

The operation of the embodiment will be described in detail with reference to the flow charts of FIGS. 10 to 39.

Figure 8:
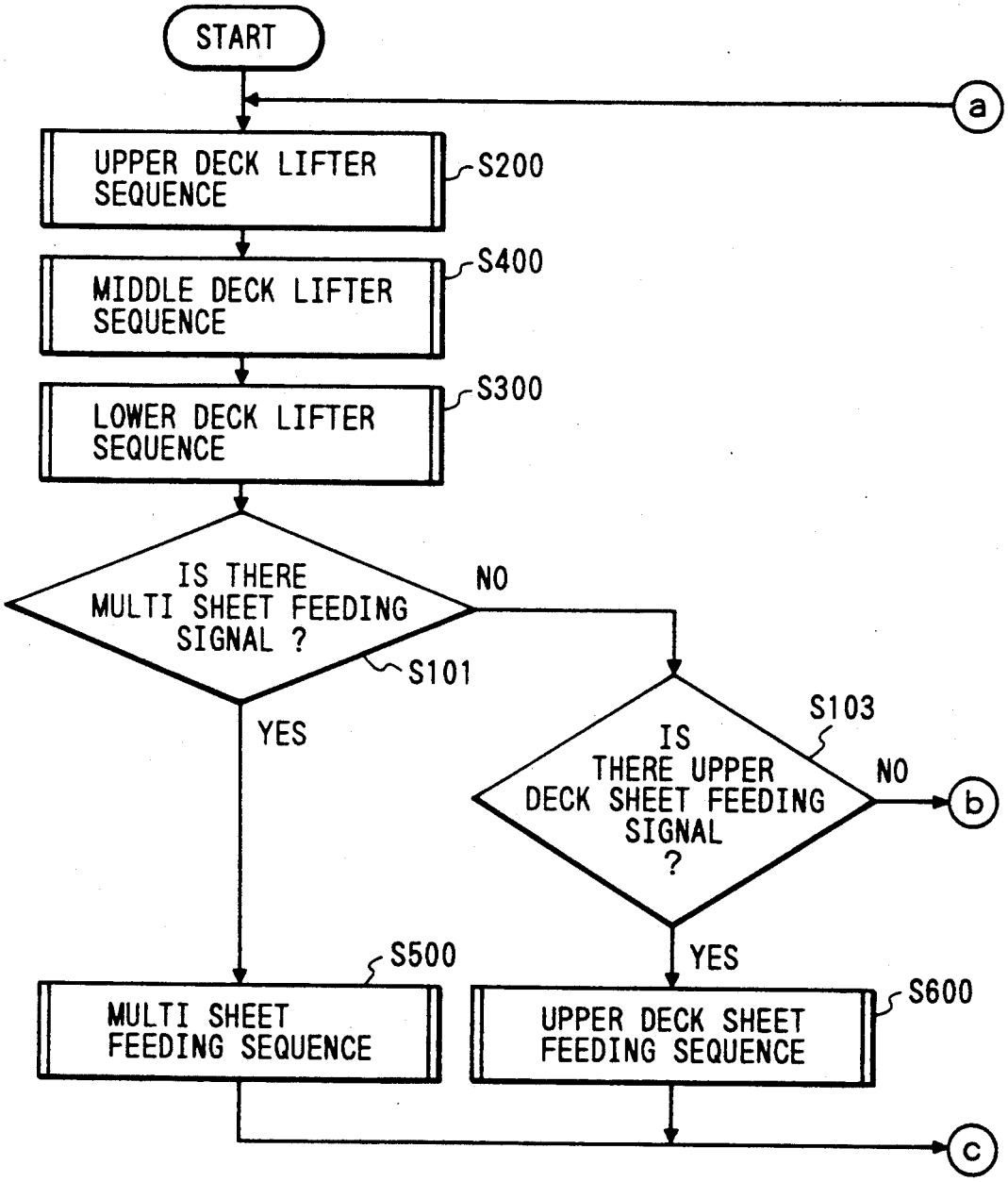
FIG. 8 is a flow chart showing part of the whole control procedure according to a first embodiment of the present invention.
Figure 9:
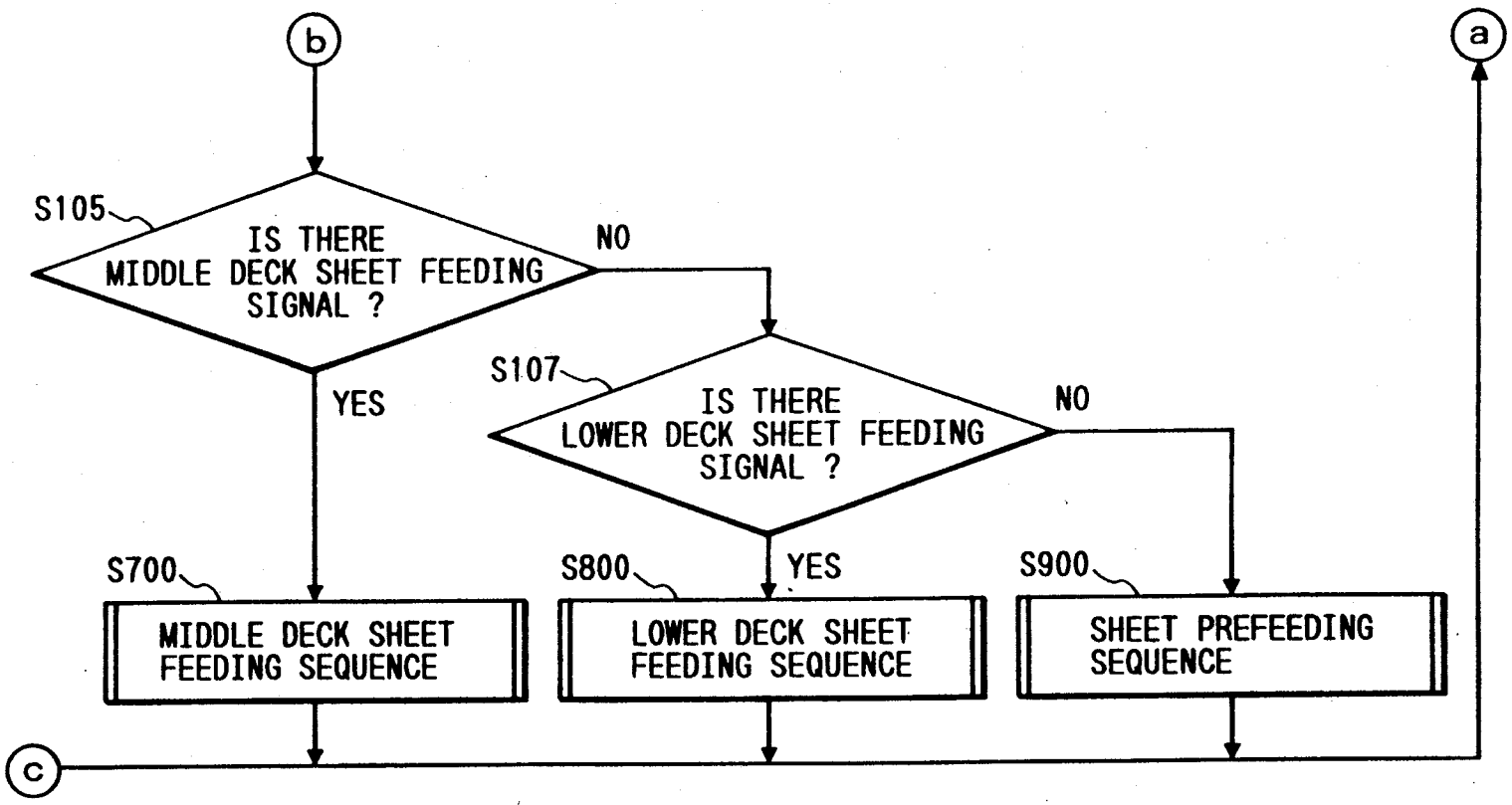
FIG. 9 is a flow chart showing part of the whole control procedure according to the first embodiment of the present invention.

First, an upper deck lifter sequence (step S200, hereinafter the term "step" will be omitted), a middle deck lifter sequence (S400), and a lower deck lifter sequence (S300) are performed as shown in the flow charts of FIGS. 8 and 9.

Next, it is checked whether there is a multi sheet feeding signal from the copier (S101). This multi sheet feeding signal is a sheet feeding request signal from the copier for the multi sheet feeder of PFU. In response to this signal, PFU starts feeding a sheet.

Similarly, an upper deck sheet feeding signal, middle deck sheet feeding signal, and lower deck sheet feeding signal are sheet feeding request signals for the upper, middle, and lower decks, respectively.

If there is a sheet feeding signal at S101, the control advances to a multi sheet feeding sequence at S500. If there is no sheet feeding signal, it is checked at S103 whether there is an upper deck sheet feeding signal If there is a sheet feeding signal at S103, the control advances to an upper deck sheet feeding sequence at S600. If there is no upper deck sheet feeding signal, it is checked at S105 whether there is a middle deck sheet feeding signal If there is a sheet feeding signal at S105, the control advances to a middle deck sheet feeding sequence at S700. If there is no sheet feeding signal, it is checked at S107 whether there is a lower deck sheet feeding signal If there is a sheet feeding signal at S107, the control advances to a lower deck sheet feeding sequence at S800, and, if not, the control advances to a sheet prefeeding sequence at S900. After completing each sequence, the control returns to the upper deck lifter sequence (S200)

Each sequence(S200 to S900) will be described.

Figure 10:
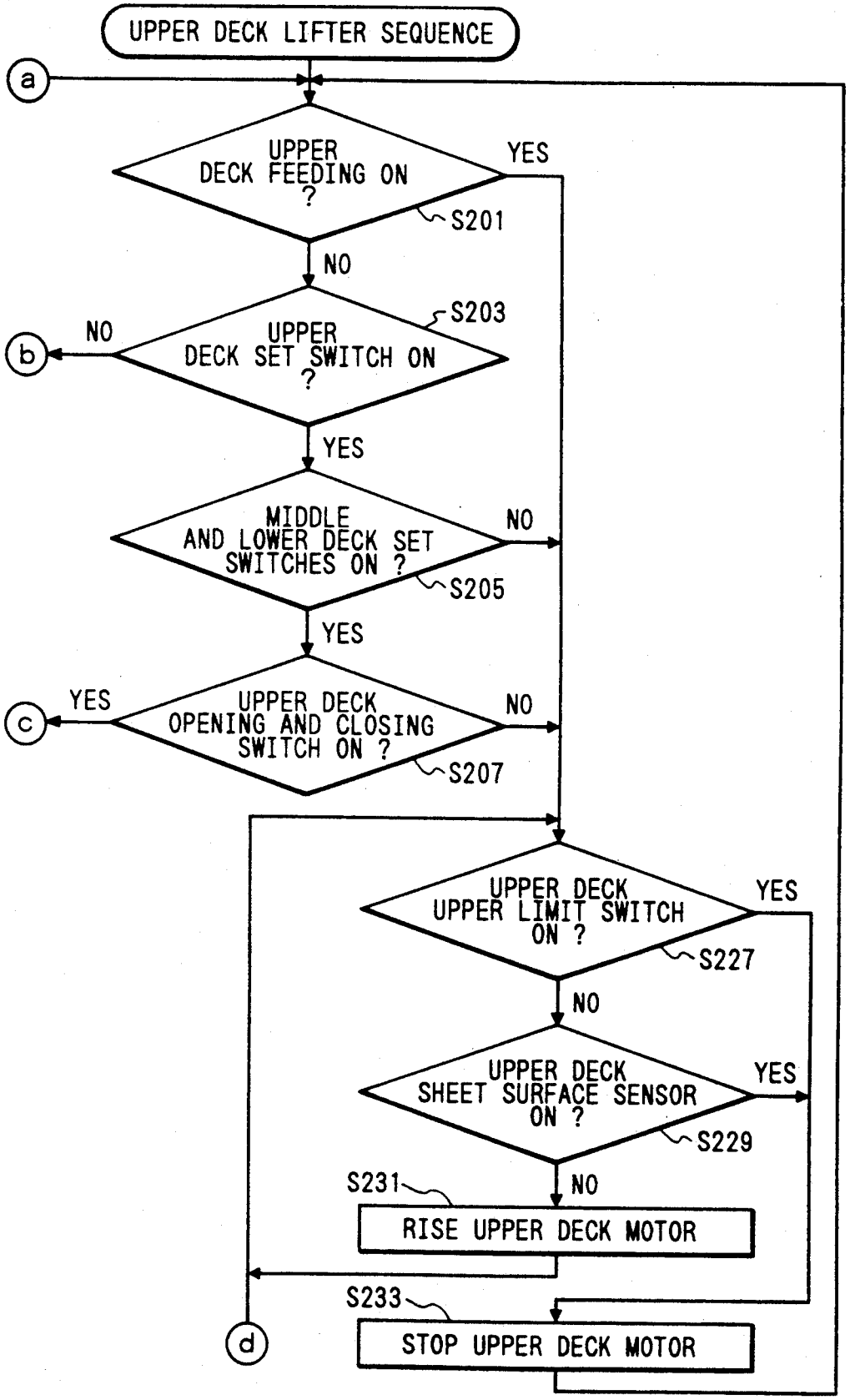
FIG. 10 is a flow chart showing part of an upper deck control operation.
Figure 11:
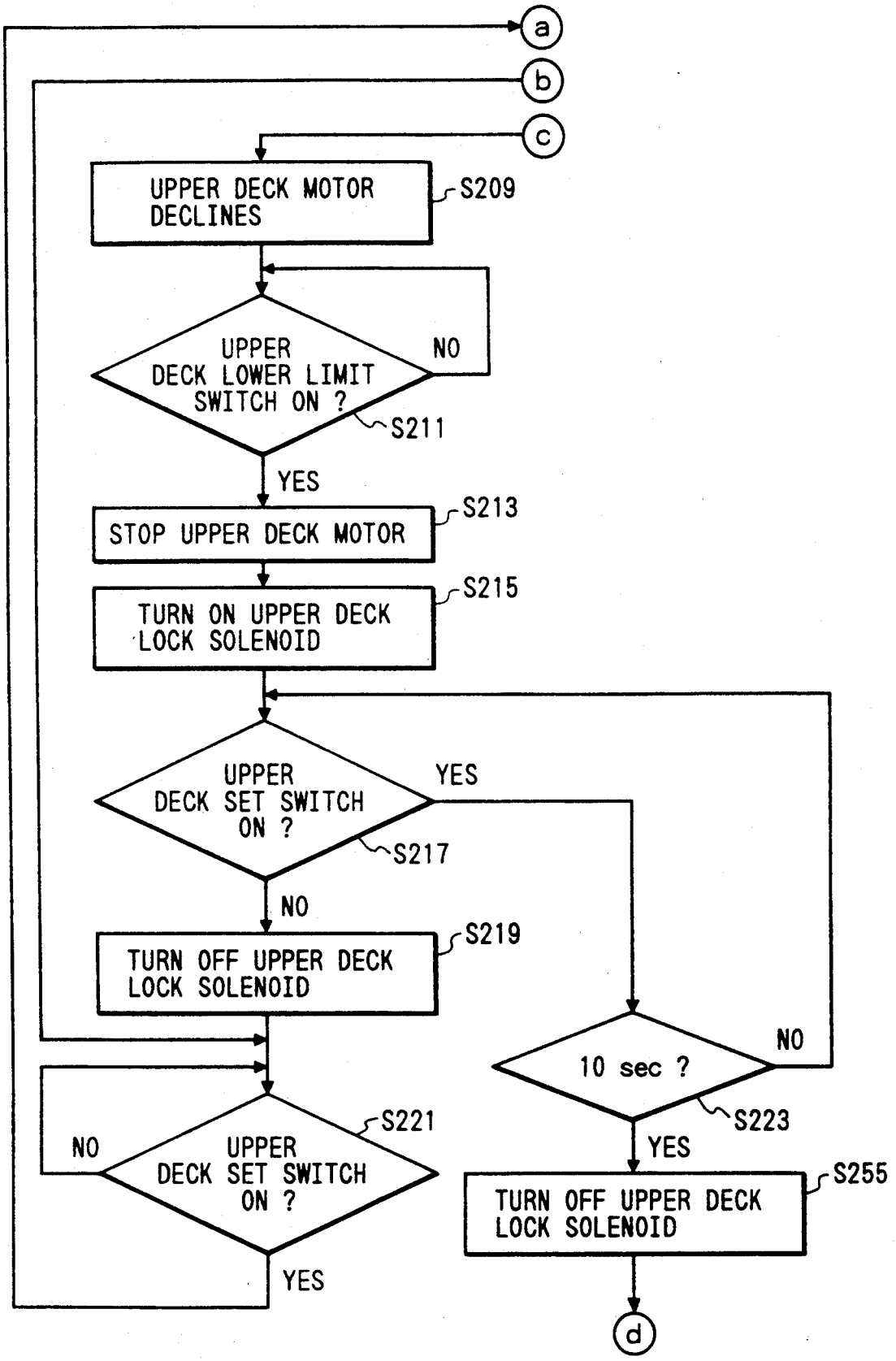
FIG. 11 is a flow chart showing part of the upper deck control operation.

FIGS. 10 and 11 are flow charts showing the upper deck lifter sequence (S200).

In the upper deck lifter sequence, it is first checked at S201 whether the upper deck is transporting a sheet. If the upper deck is transporting a sheet, the control advances to S227 and S229 to raise the upper deck lifter motor (S231) until the upper deck upper limit switch or upper deck sheet surface switch turns on. When the switch turns on, the upper deck lifter motor is stopped (S233).

If the upper deck is not transporting a sheet at S201, it is checked at S203 whether the upper deck set switch is turned on or off. If off, it means that the sheet stacker has been pulled out. In this case, the control advances to S221 to wait until the upper deck set switch turns on, i.e., the sheet stacker is set within the deck.

If the upper deck set switch is on at S203, it is checked at S205 whether any one of the middle and lower decks has been pulled out. If any one of the middle and lower decks has been pulled out, the control advances to S227. These steps are performed so as not to allow two or more stackers to be pulled out at the same time.

Namely, if two or more stackers with a number of sheets being stacked are pulled out at the same time, the center of gravity of the apparatus moves forward and a load is applied to the frame or the like of the apparatus, resulting in a unstable state of the apparatus.

If the middle and lower decks are being set properly within the apparatus at S205, it is checked at S207 whether the upper deck opening and closing switch was turned on or off. If off, the control advances to S227 in the similar manner described above.

If the upper deck opening and closing switch was depressed at S207, the upper deck lifter motor is lowered for the supply of sheets until the upper deck lower limit switch turns on (S209, S211, S213). When the upper deck lower limit switch turns on, the upper deck solenoid turns on.

In this state, a user can pull out the sheet stacker. It is possible to confirm whether the sheet stacker has been pulled out by checking at S217 whether the upper deck set switch has been turned on or off.

If the sheet stacker has been pulled out at S217, the upper deck lock solenoid turns off (S219), and the control waits until the upper deck set switch turns on (S221). If the on-state of the upper deck set switch continues for the period of 10 seconds at S217 (S223), the upper deck lock solenoid switch turns off, and the control advances to S227 to automatically raise the lifter motor.

The middle deck lifter sequence follows the upper deck lifter sequence, so that the flow chart for this sequence and the description thereof are omitted Next, the operation of the lower deck lifter will be described.

Figure 12:
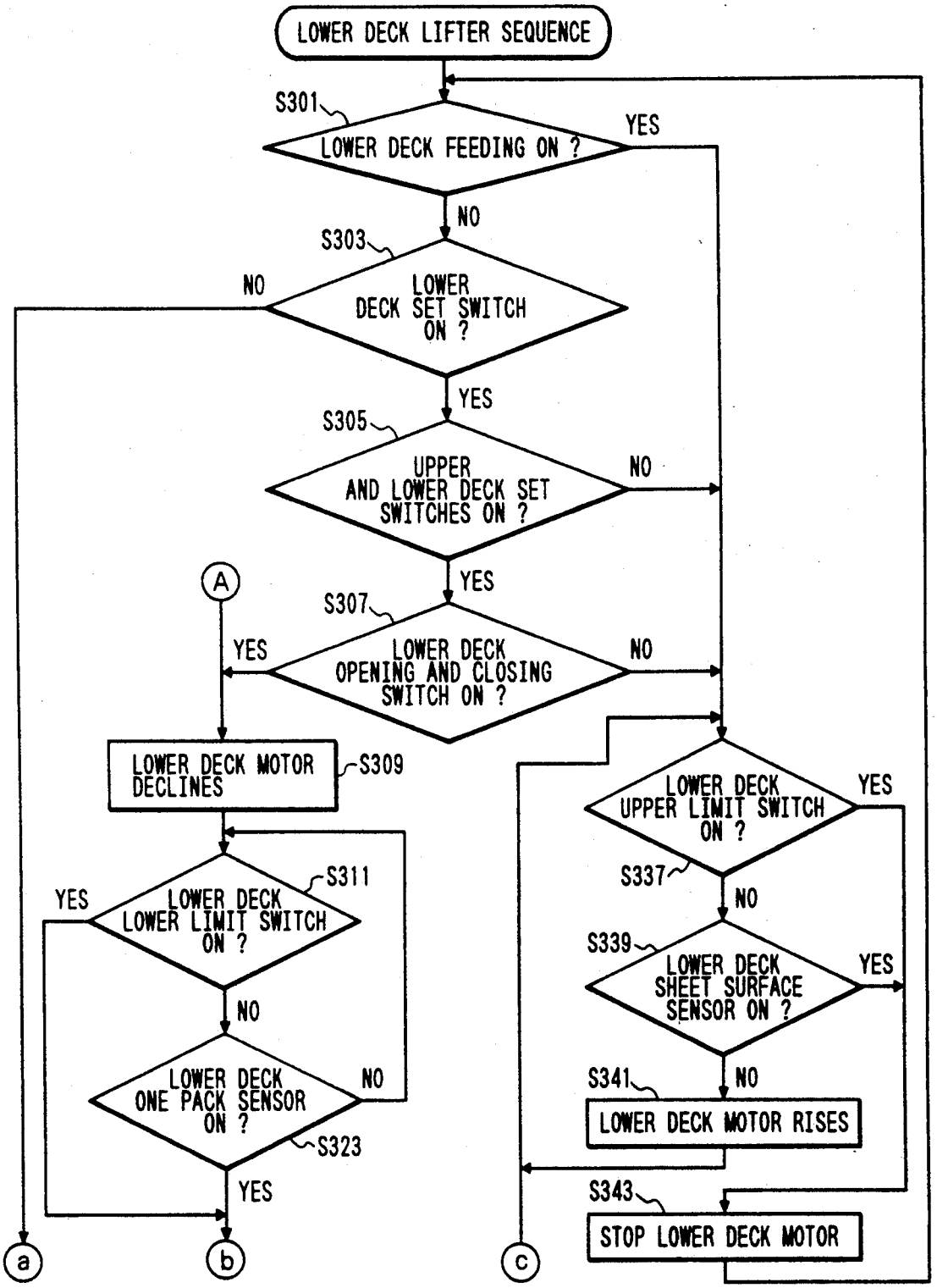
FIG. 12 is a flow chart showing part of a lower deck control operation.
Figure 13:
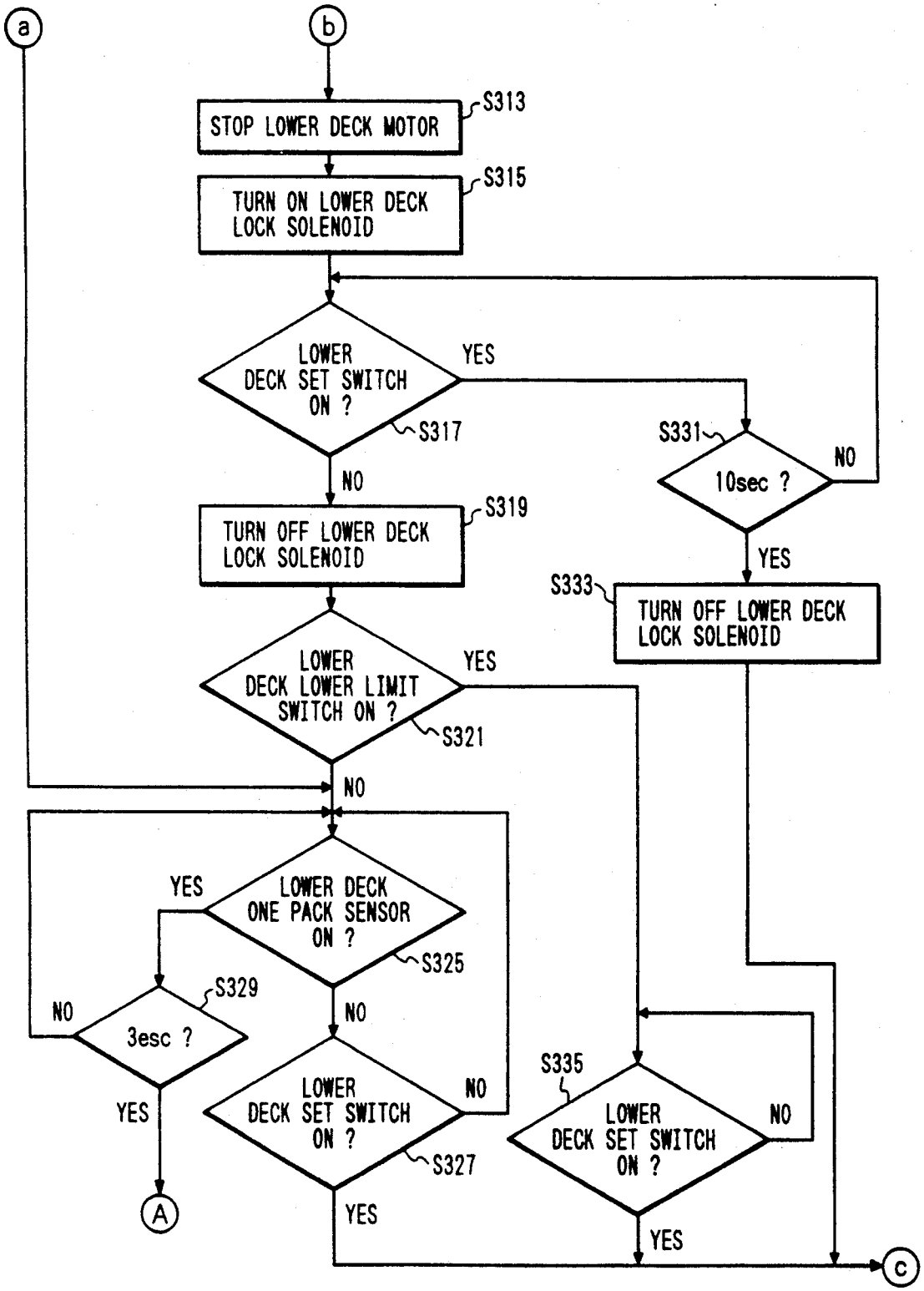
FIG. 13 is a flow chart showing part of the lower deck control operation.
Figure 14:
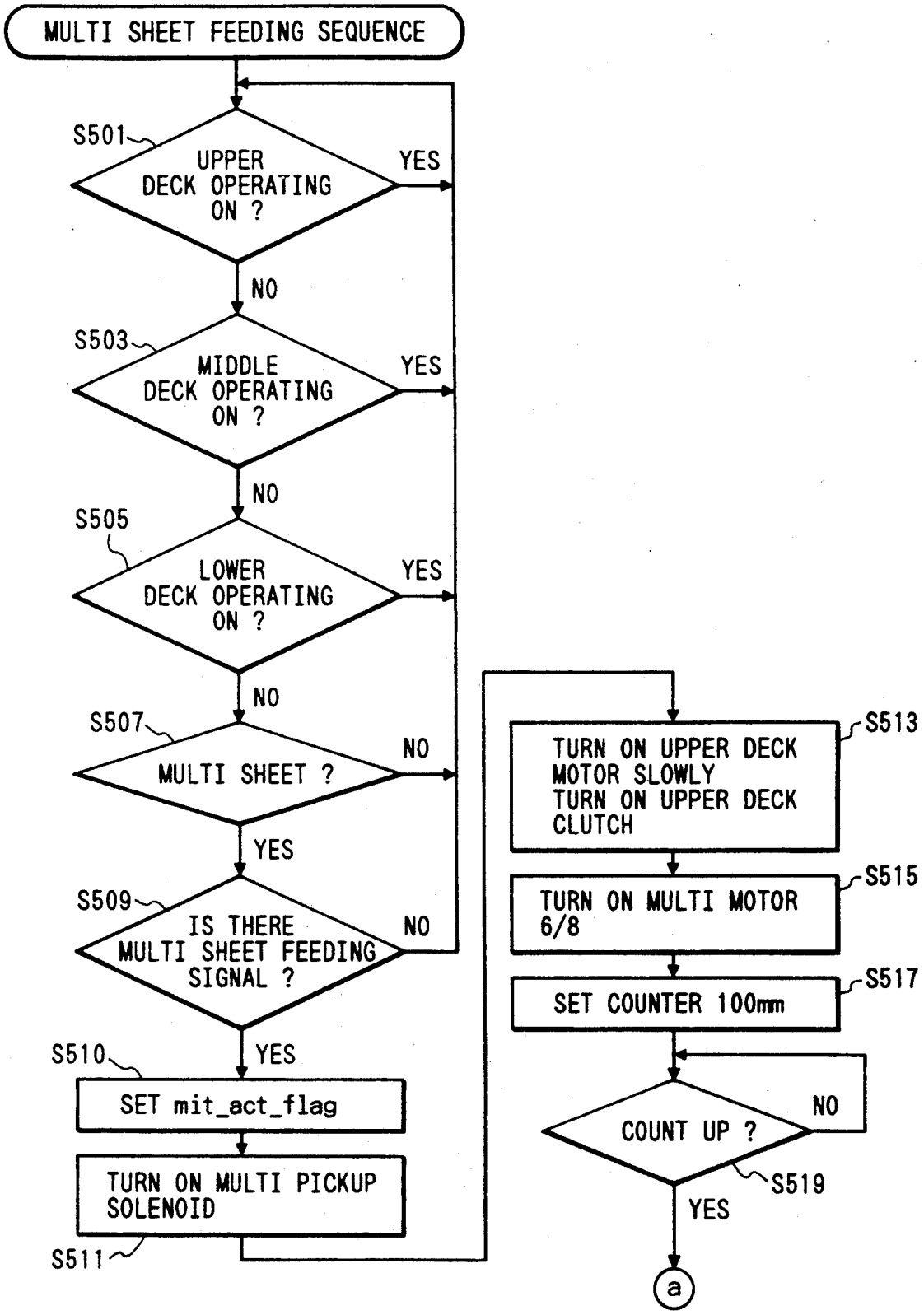
FIG. 14 is a flow chart showing part of a multi sheet feeding procedure.
Figure 15:
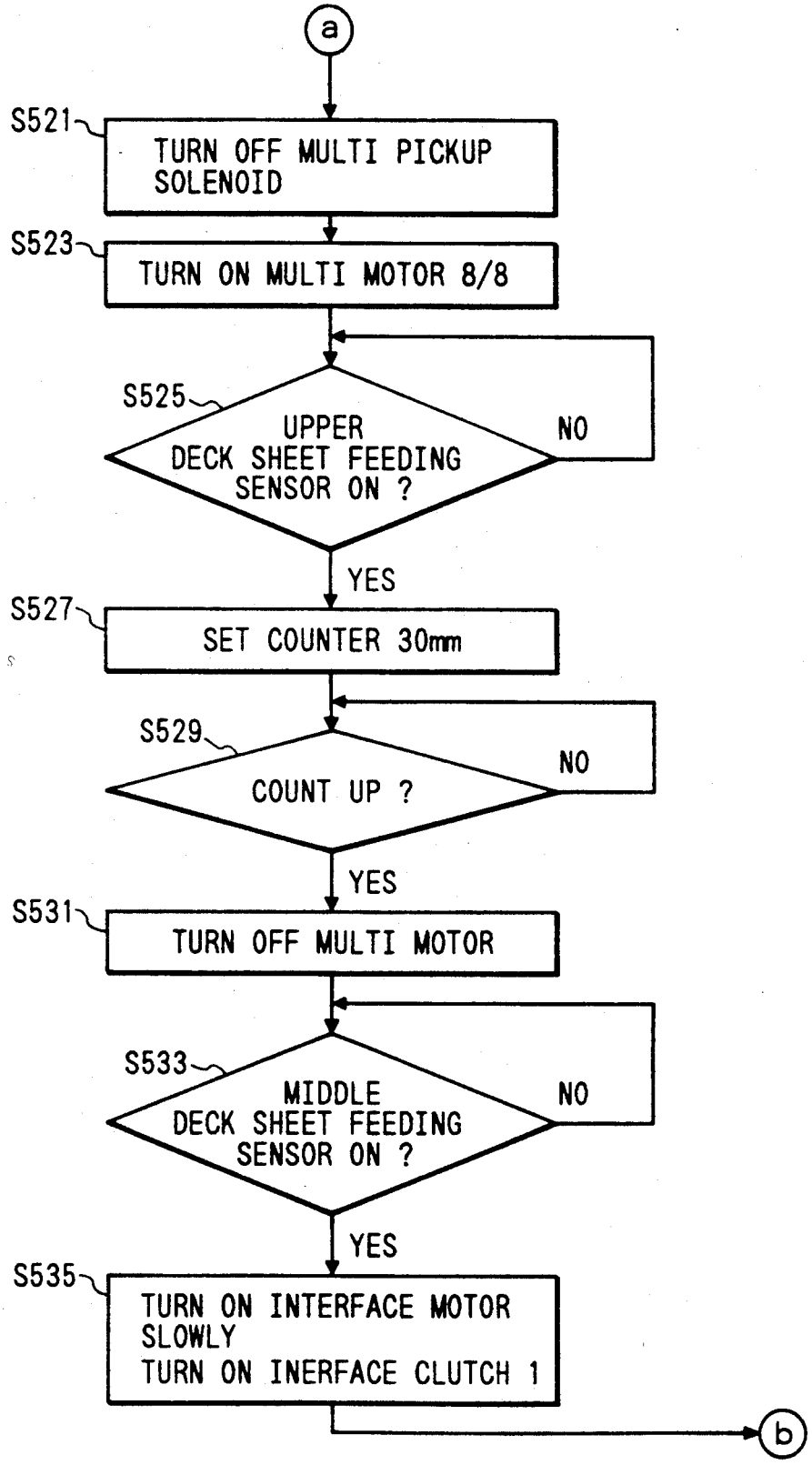
FIG. 15 is a flow chart showing part of the multi sheet feeding procedure.
Figure 16:
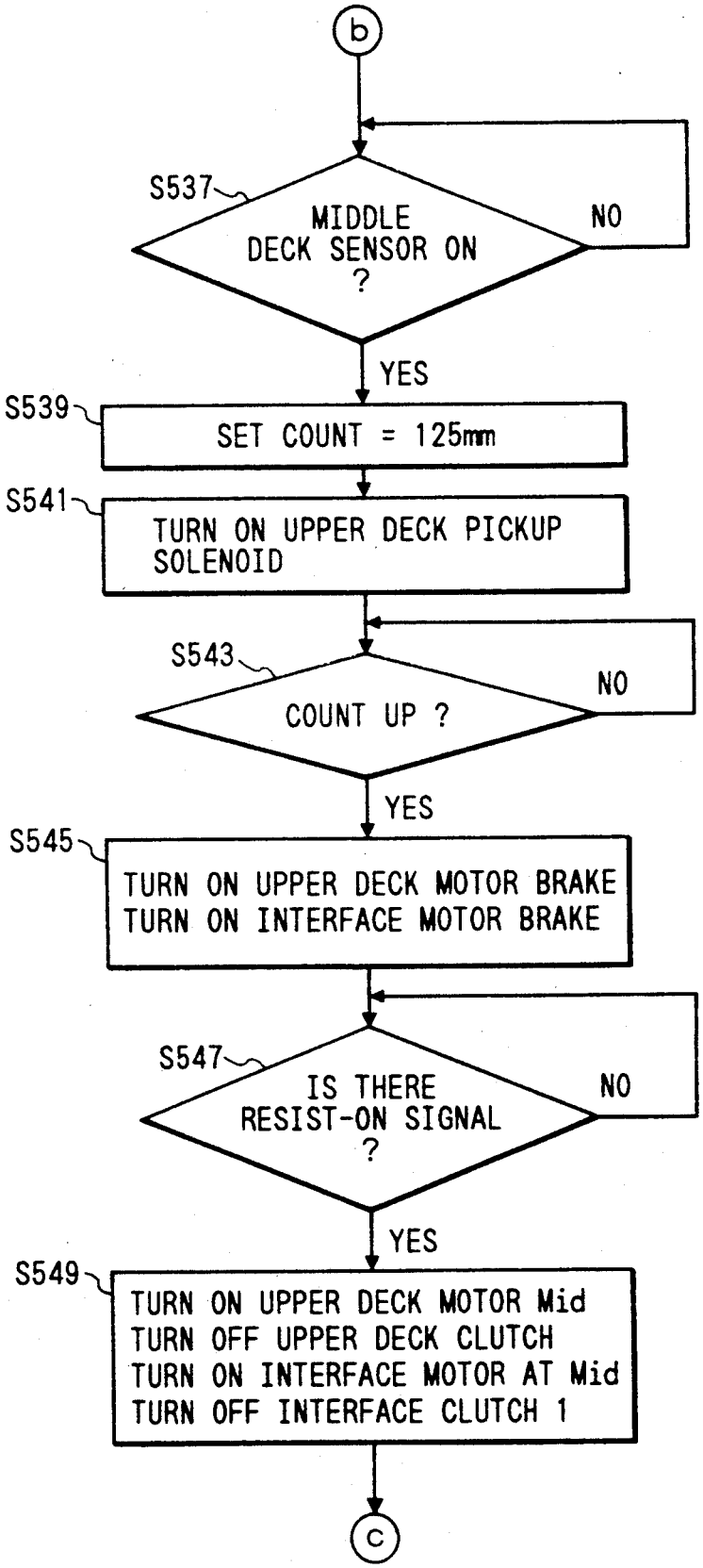
FIG. 16 is a flow chart showing part of the multi sheet feeding procedure.
Figure 17:
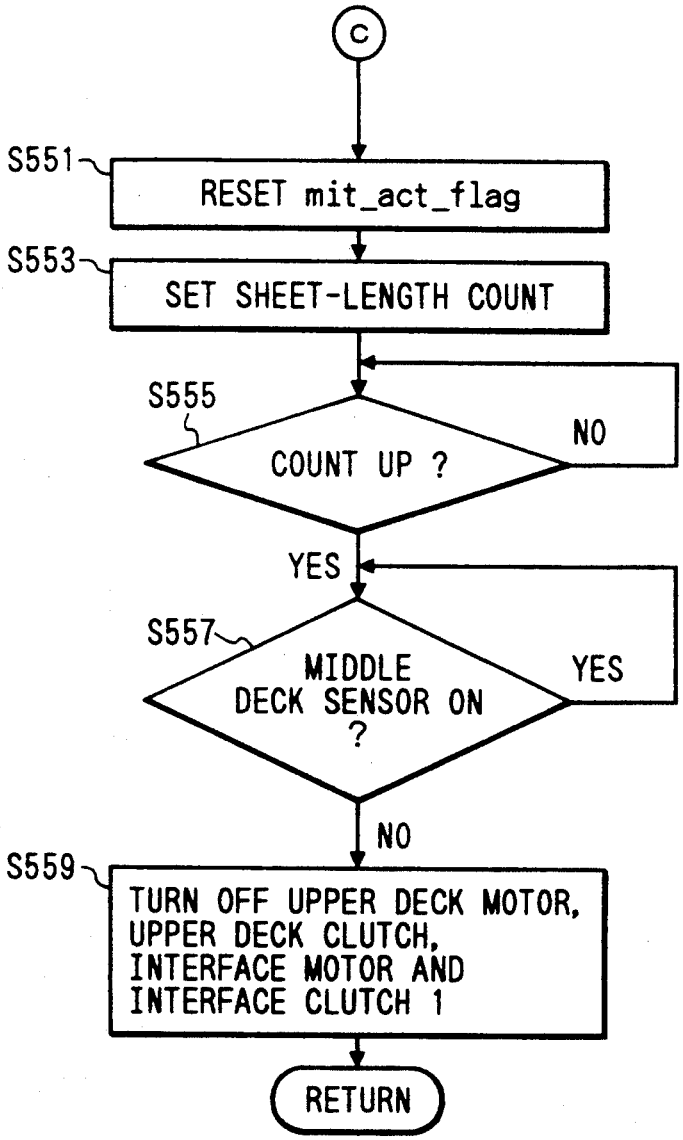
FIG. 17 is a flow chart showing part of the multi sheet feeding procedure.

FIGS. 12 and 13 are flow charts showing the lower deck lifter sequence (S300).

In the lower deck lifter sequence, it is first checked at S301 whether the lower deck is transporting a sheet. If the lower deck is transporting a sheet, the control advances to S337 and S339 to raise the lower deck lifter motor (S341) until the lower deck upper limit switch or lower deck sheet surface switch turns on. When the switch turns on, the lower deck lifter motor is stopped (S343).

If the lower deck is not transporting a sheet at S301, it is checked at S303 whether the lower deck set switch is turned on or off. If off, it means that the sheet stacker has been pulled out. In this case, the control advances to S325.

If the lower deck set switch is on at S303, it is checked at S305 whether any one of the upper and middle decks has been pulled out. If any one of the upper and middle decks has been pulled out, the control advances to S337. These steps are performed so as not to allow two or more decks to be pulled out at the same time.

If the upper and middle decks are being set properly within the apparatus at S305, it is checked at S307 whether the lower deck opening and closing switch was turned on or off. If off, the control advances to S337 in the similar manner described above. If the lower deck opening and closing switch was depressed at S307, the lower deck lifter motor is lowered for the supply of sheets until the lower deck lower limit switch turns on (S309, S311, S323, S313).

When the lower deck lower limit switch turns on or the lower limit one pack sensor turns off, the lower deck lifter motor is stopped and the lower deck solenoid turns on (S315). In this state, a user can pull out the sheet stacker.

It is possible to confirm whether the sheet stacker has been pulled out, by checking at S317 whether the lower deck set switch has been turned on or off. If the on-state of the lower deck set switch continues for the period of 10 seconds at S317 (S331), the lower deck lock solenoid switch turns off (S333), and the control advances to S337 to automatically raise the lifter motor.

If the sheet stacker has been pulled out at S317, the lower deck lock solenoid turns off (S319), and it is checked whether the lower deck lower limit switch has been depressed (S321). If depressed, the control advances to S335 to wait until the lower deck set switch is turned on.

If the lower deck lower limit switch is off at S321, it is checked at S325 whether the lower deck one pack sensor was turned on again or it is checked whether the lower deck set switch was turned on or off (S327). If the lower deck set switch is on, the control advances to S337 to raise the lifter.

If the lower deck one pack sensor is on again at S325, i.e., if sheets has been supplied, a 3-second waiting period follows to remove chatterings and, thereafter, the control returns to S309 (S325, S329). This 3 second period is provided so that a user will not be surprised.

Next, the flow charts showing an operation of feeding a sheet will be described.

First, the multi sheet feeding sequence for the multi sheet feeder will be described.

FIGS. 14 to 17 are flow charts showing the multi sheet feeding sequence for the multi sheet feeder to be executed by PFU. This sequence is executed when a multi sheet supply signal is received from the copier main circuit. As the initial sequence check, it is checked whether any one of the upper/middle/lower decks is stopping its operation and whether there are sheets on the multi sheet feeder (S501, S503, S505, S507). If there is a multi sheet feeding signal (S509), an operation of feeding sheets starts.

In order to indicate that the sheet feeding operation is being executed, a "mlt act flag" on a memory is set (S510). The multi pickup solenoid 140 is turned on to make the pickup roller contact with a sheet (S511).

Next, the upper deck motor 170 is rotated at a slow speed (about 350 mm/sec), the upper deck clutch 150 is turned on to rotate the upper deck feeding roller (S513), and at the same time the multi sheet feeding motor 139 is rotated at a duty ratio 6/8 (S515) to advance the sheet by 100 mm.

Since the encoder is mounted on the rotary shaft of the motor, it is possible for CPU 101 to know the length of the sheet advance from the fed-back output of the encoder. The multi pickup solenoid 140 is turned off (S521), the multi sheet feeding motor 139 is rotated at a duty ratio 8/8 (S523), the upper deck sheet feeding sensor 126 is turned on (S525) to advance the sheet by 30 mm, and then the multi sheet feeding motor is turned off (S527, S529, S531).

The sheet is fed by the upper deck sheet feeding roller. When the sheet turns on the middle deck sheet feeding sensor 127 (S533), the interface clutch 159 is turned on, (S535). When the middle deck sheet feeding sensor 127 turns on, the multi sheet pickup solenoid 140 is turned on for the transport of the next sheet (S537, S541).

When the sheet reaches the position in advance of the middle deck sheet feeding sensor 127 by 125 mm, the interface motor 169 is braked to stop the sheet (S545). At this time the sheet is stopped in the form of a loop in contact with the resist roller within the copier main body.

When a resist-on signal is received from the copier main circuit, the upper deck motor 170 and interface motor 169 are rotated at a middle speed (about 500 mm/sec). The upper deck clutch 150 is turned off and the interface clutch 159 is turned on (S549), to transport the sheet to the copier main body.

At this time, the "mlt act flag" on the memory is reset to permit another sheet feeding sequence (S551).

Next, the pulses corresponding to the sheet length are counted (S553, S555), and when the sheet turns off the middle deck sensor 128, the drive system is turned off (S557, S559). In this manner, feeding a single sheet from the multi sheet feeder is completed.

Next, the upper deck sheet feeding sequence will be described.

Figure 18:
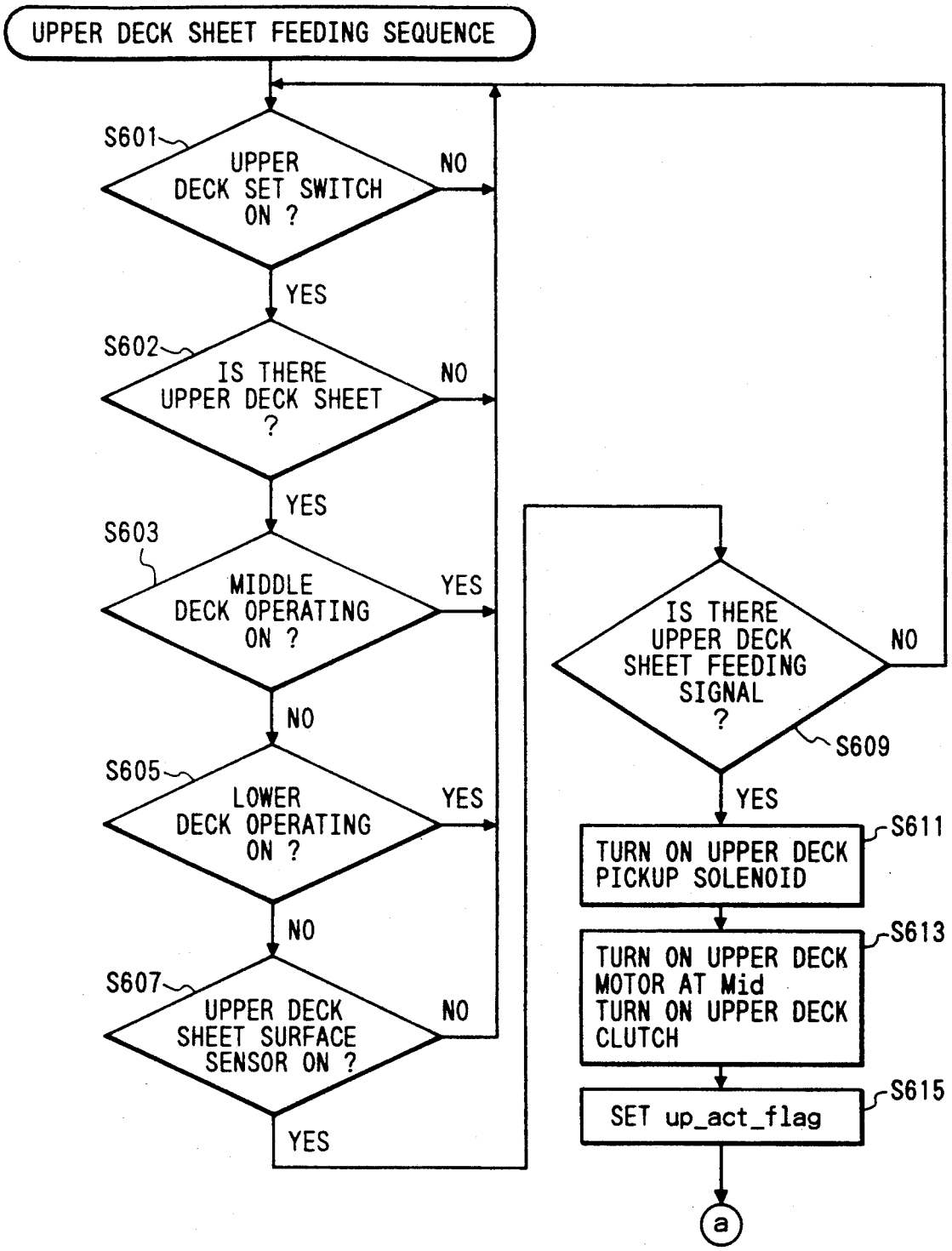
FIG. 18 is a flow chart showing part of an upper deck sheet feeding procedure.
Figure 19:
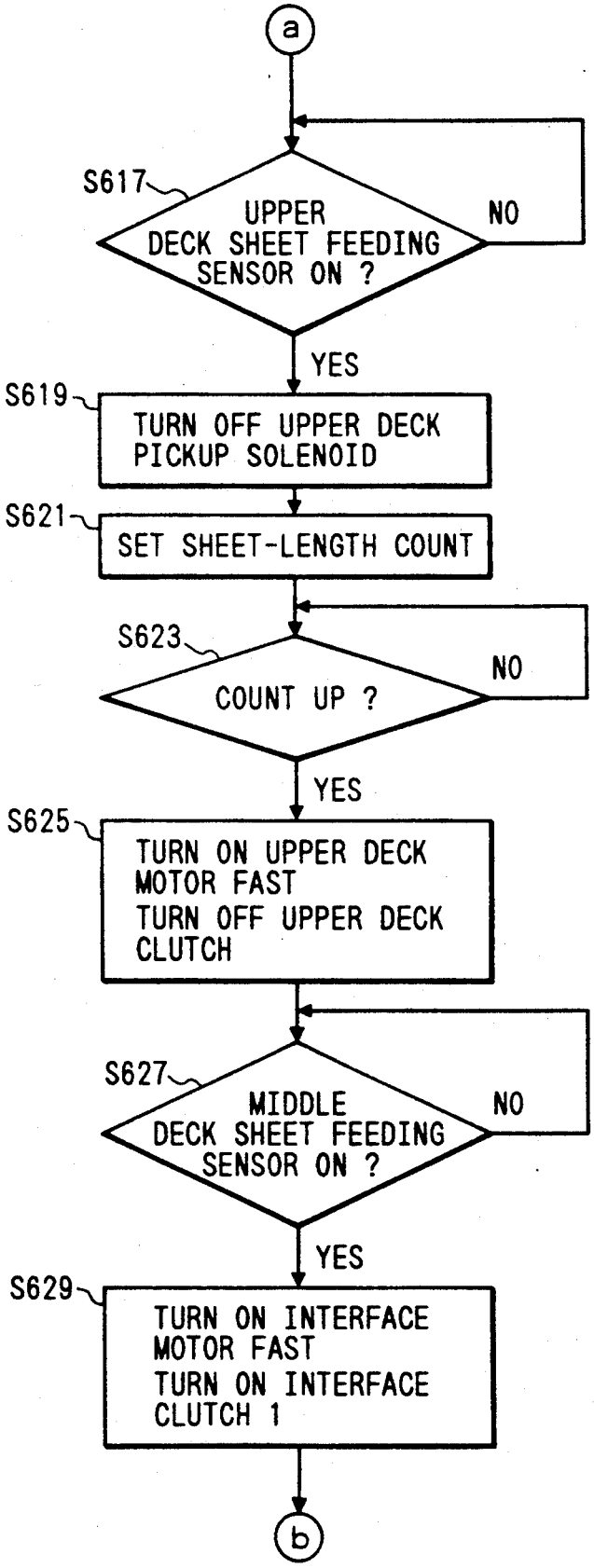
FIG. 19 is a flow chart showing part of the upper deck sheet feeding procedure.
Figure 20:
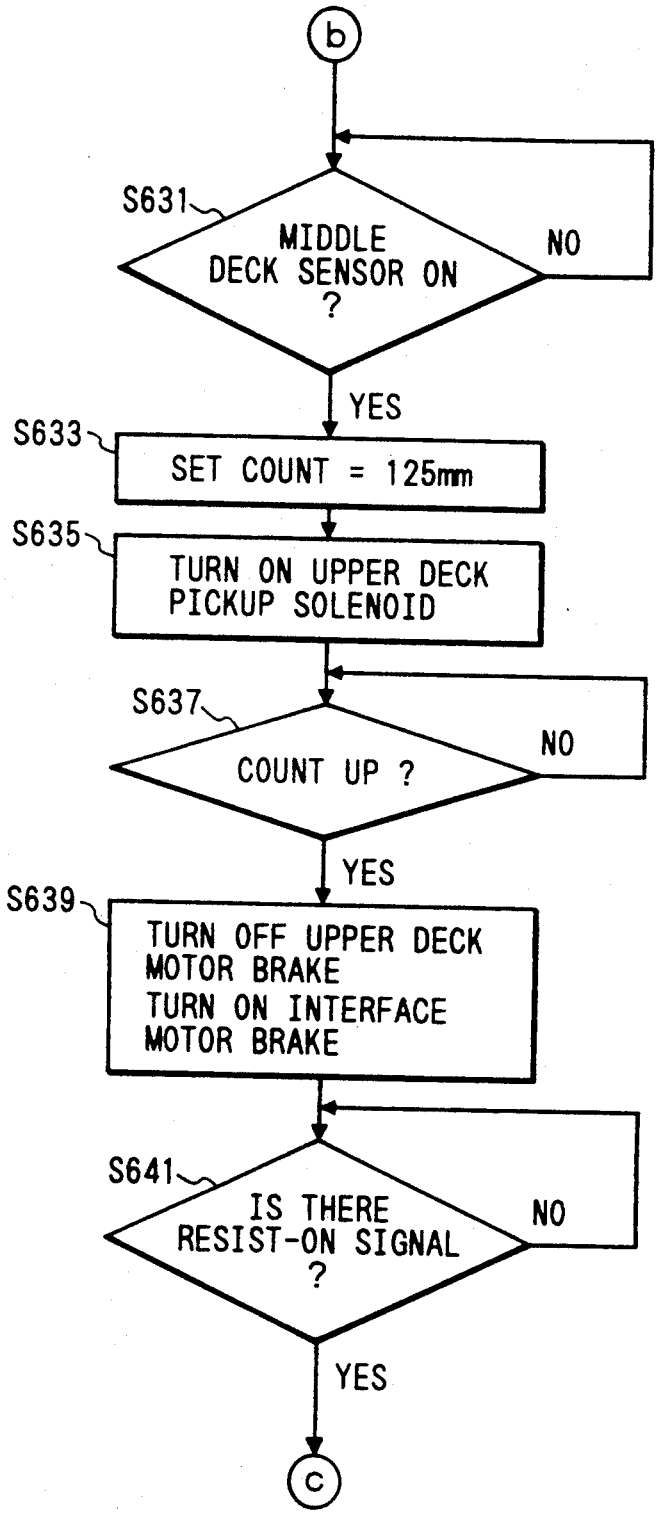
FIG. 20 is a flow chart showing part of the upper deck sheet feeding procedure.
Figure 21:
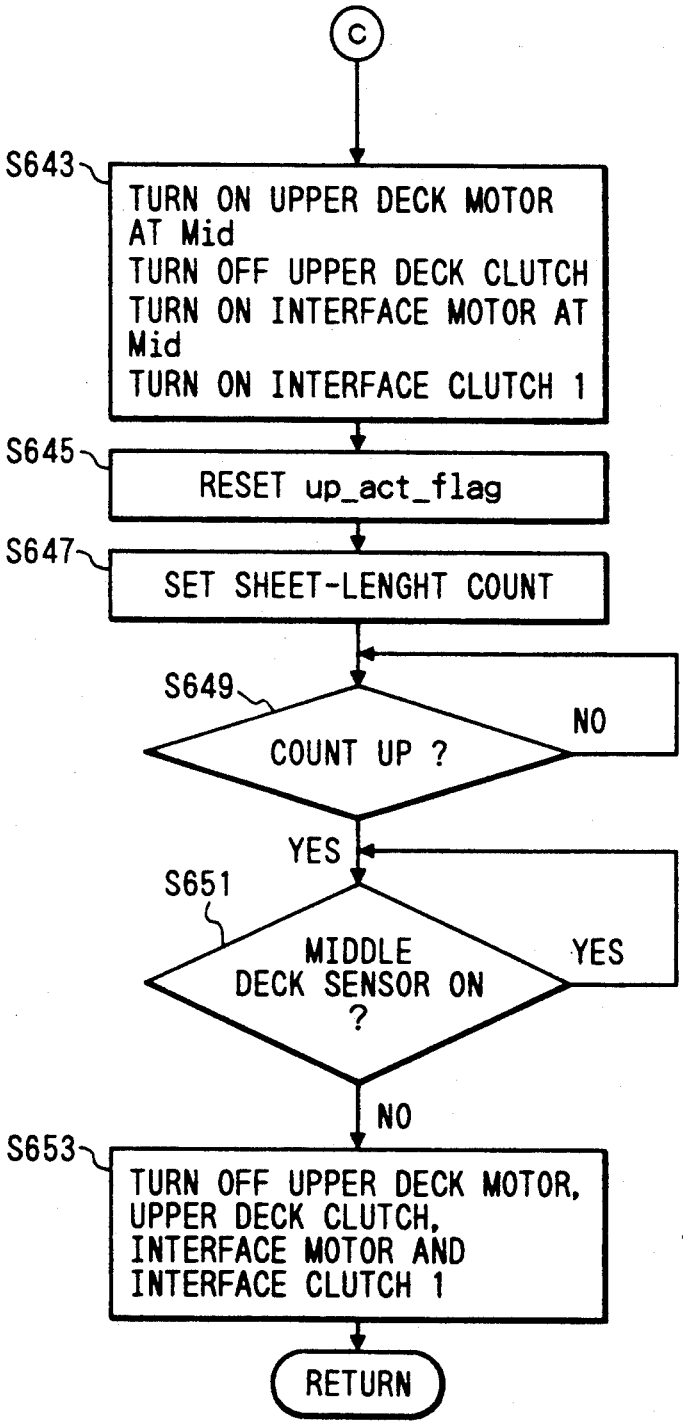
FIG. 21 is a flow chart showing part of the upper deck sheet feeding procedure.

FIGS. 18 to 20 are flow charts showing the upper deck sheet feeding sequence. This sequence is executed when an upper deck sheet supply signal is received from the copier main circuit. As the initial sequence check, it is checked whether the upper deck is being set, whether any one of the middle and lower decks is stopping its operation, whether there are sheets on the upper deck, and whether the lifter has been raised to allow sheet transport (S601, S602, S603, S605, S607). If there is an upper deck sheet feeding signal (S609), an operation of feeding sheets starts First, the upper deck pickup solenoid 141 is turned on to make the pickup roller contact with a sheet (S611). Next, the upper deck motor 170 is rotated at a middle speed (about 500 mm/sec), and the upper deck clutch 50 is turned on to rotate the upper deck feeding roller (S613).

In order to indicate that the sheet feeding operation for the upper deck is being executed, an "up act flag" on a memory is set (S615). The sheet is fed by the upper deck sheet feeding roller. When the sheet turns on the upper deck sheet feeding sensor 121, the upper deck pickup solenoid is turned off (S617, S619). The pulses corresponding to the sheet length are counted starting from when the upper deck sheet feeding sensor 126 turns on. When the count-up occurs (S621, S623), the rotation speed of the upper deck motor 170 is increased to a fast speed (about 750 mm/sec), and the upper deck clutch 150 is turned off (S625).

When the sheet turns on the middle deck sheet feeding sensor 127 (S627), the interface motor 169 is rotated at the fast speed, and the interface clutch 1 is turned on (S629). When the middle deck sheet feeding sensor 127 turns on, the upper deck sheet pickup solenoid 141 is turned on for the transport of the next sheet (S631, S635).

When the sheet reaches the position in advance of the middle deck sheet feeding sensor 127 by 125 mm, the upper deck motor 170 and interface motor 169 are braked to stop the sheet (S633, S637, S639). At this time the sheet is stopped in the form of a loop in contact with the resist roller within the copier main body.

When a resist-on signal is received from the copier main circuit (S641), the upper deck motor 170 and interface motor 169 are rotated at a middle speed (about 500 mm/sec). The upper deck clutch 150 is turned off and the interface clutch 1 is turned on (S643), to transport the sheet to the copier main body. At this time, the "up act flag" on the memory is reset to permit another sheet feeding sequence (S645).

Next, the pulses corresponding to the sheet length are counted (S647, S649), and when the sheet turns off the middle deck sensor 128, the drive system is turned off (S651, S653). In this manner, feeding a single sheet from the upper deck is completed.

Figure 22:
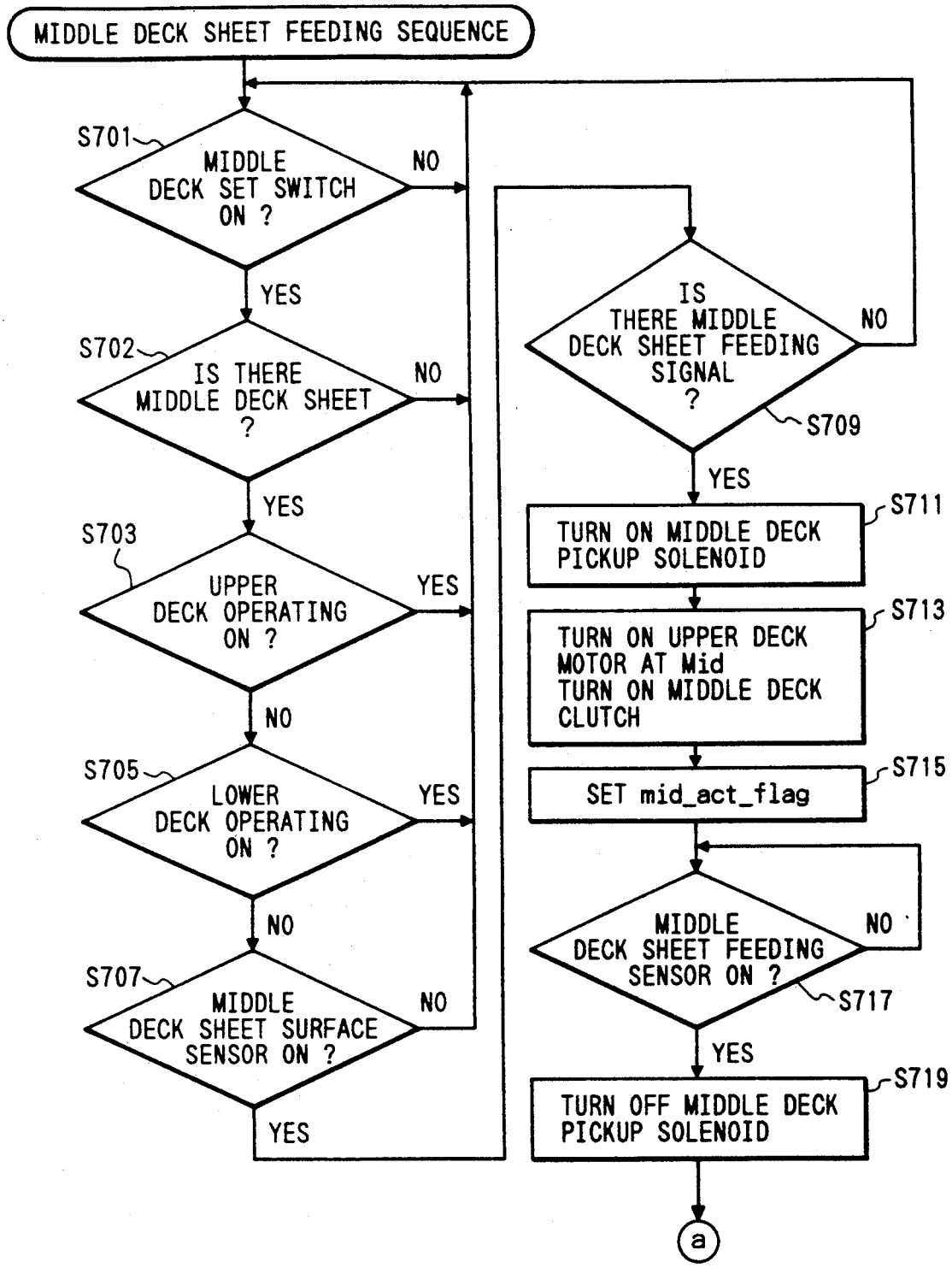
FIG. 22 is a flow chart showing part of a middle deck sheet feeding procedure.
Figure 23:
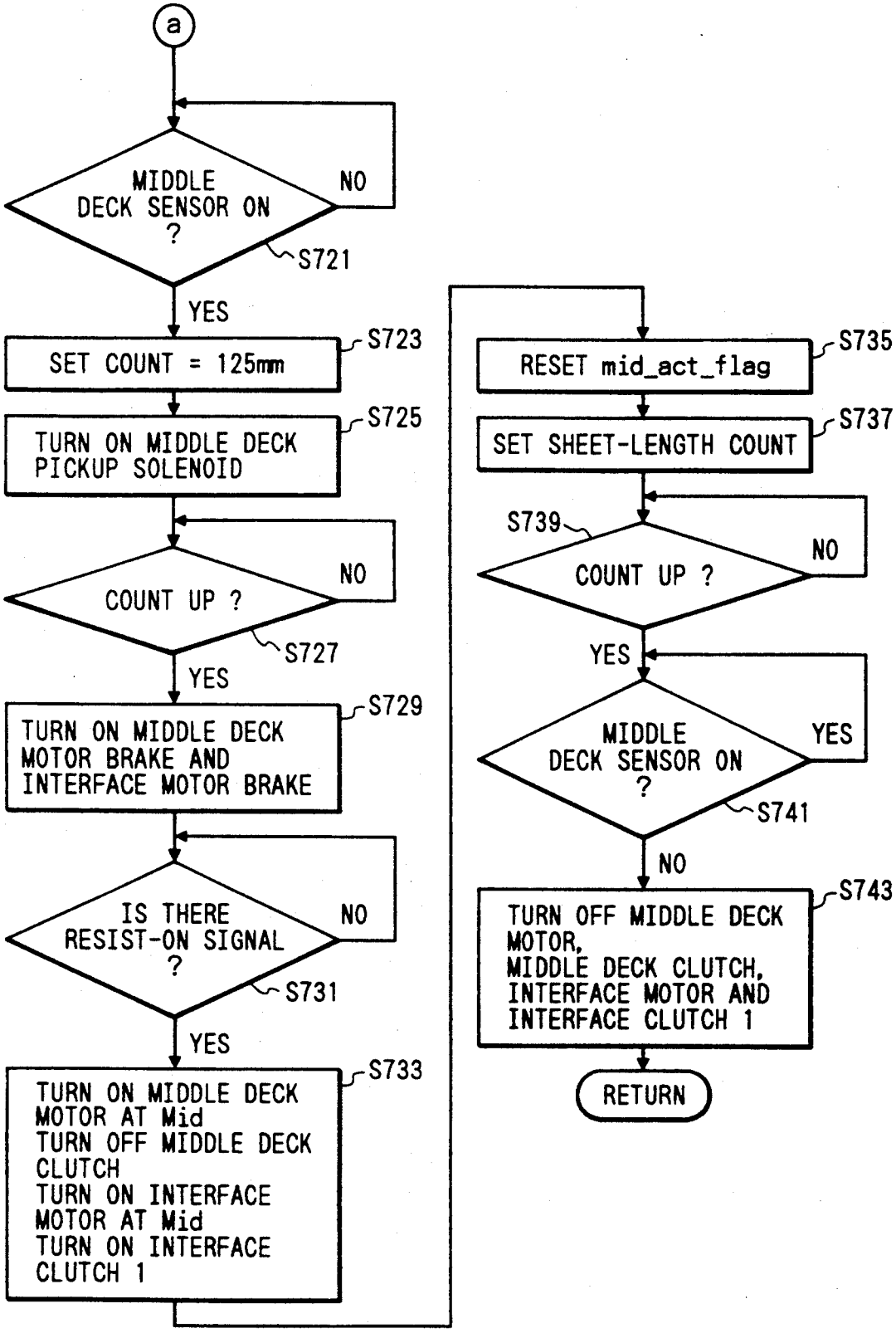
FIG. 23 is a flow chart showing part of the middle deck sheet feeding procedure.

Next, the middle deck sheet feeding sequence will be described. FIGS. 22 and 23 are flow charts showing the middle deck sheet feeding sequence. This sequence is executed when a middle deck sheet supply signal is received from the copier main circuit. As the initial sequence check, it is checked whether the middle deck is being set, whether any one of the upper and lower decks is stopping its operation, whether there are sheets on the middle deck, and whether the lifter has been raised to allow sheet transport (S701, S702, S703, S705, S707). If there is a middle deck sheet feeding signal (S709), an operation of feeding sheets starts.

First, the middle deck pickup solenoid 142 is turned on to make the pickup roller contact with a sheet (S711). Next, the upper deck motor 170 is rotated at a middle speed (about 500 mm/sec), and the middle deck clutch 151 is turned on to rotate the middle deck feeding roller (S713).

In order to indicate that the sheet feeding operation for the middle deck is being executed, a "mid act flag" on a memory is set (S715). The sheet is fed by the middle deck sheet feeding roller. When the sheet turns on the middle deck sheet feeding sensor 127, the middle deck pickup solenoid 142 is turned off (S717, S719). When the middle deck sensor 128 turns on, the pickup solenoid 142 is turned on for the transport of the next sheet (S721, S725).

When the sheet reaches the position in advance of the middle deck sheet feeding sensor 127 by 125 mm, the upper deck motor 170 and interface motor 169 are braked to stop the sheet (S723, S727, S729). At this time the sheet is stopped in the form of a loop in contact with the resist roller within the copier main body.

When a resist-on signal is received from the copier main circuit, the upper deck motor 170 and interface motor 169 are rotated at a middle speed (about 500 mm/sec). The middle deck clutch 151 is turned off and the interface clutch 159 is turned on (S733), to transport the sheet to the copier main body.

At this time, the "mid act flag" on the memory is reset to permit another sheet feeding sequence (S735).

Next, the pulses corresponding to the sheet length are counted (S737, S739), and when the sheet turns off the middle deck sensor 128, the drive system is turned off (S741, S743). In this manner, feeding a single sheet from the middle deck is completed.

Next, the lower deck sheet feeding sequence will be described.

Figure 24:
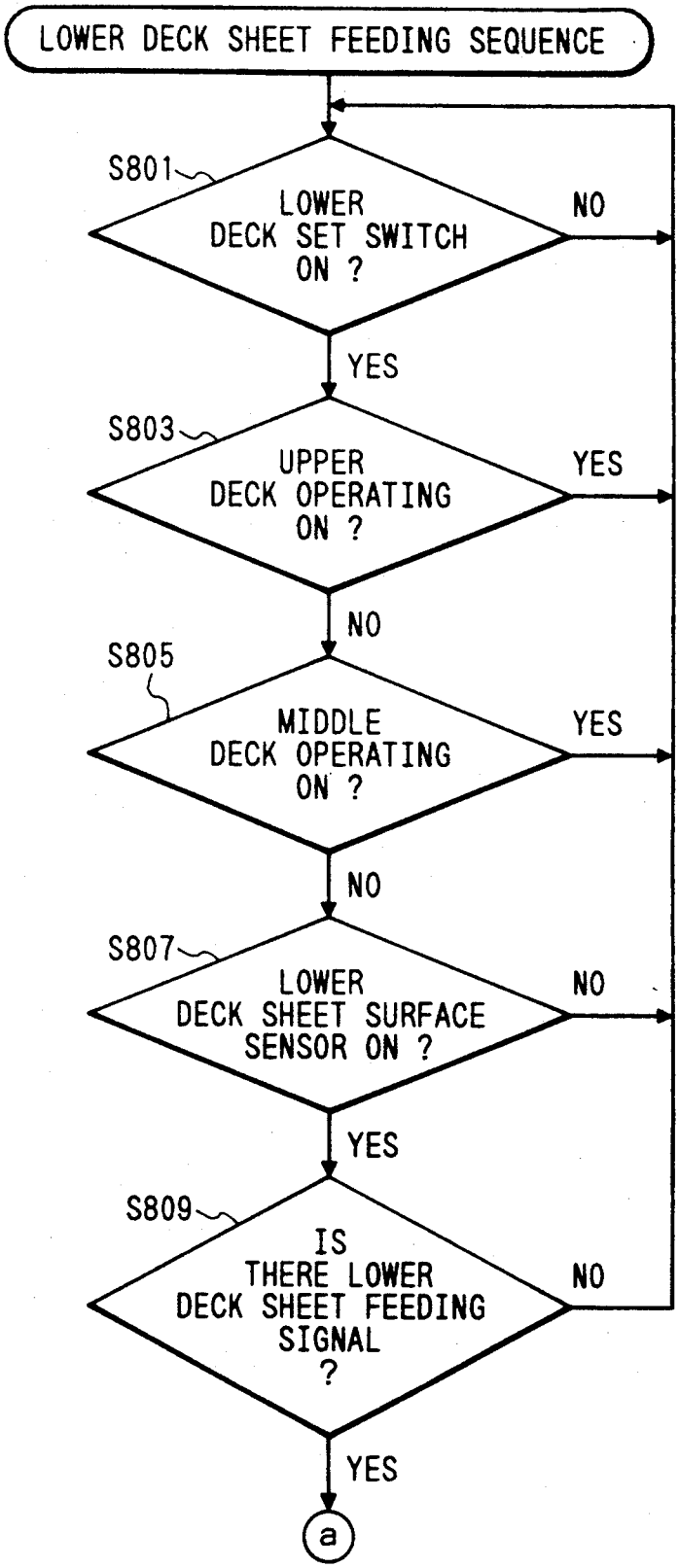
FIG. 24 is a flow chart showing part of a lower deck sheet feeding procedure.
Figure 25:
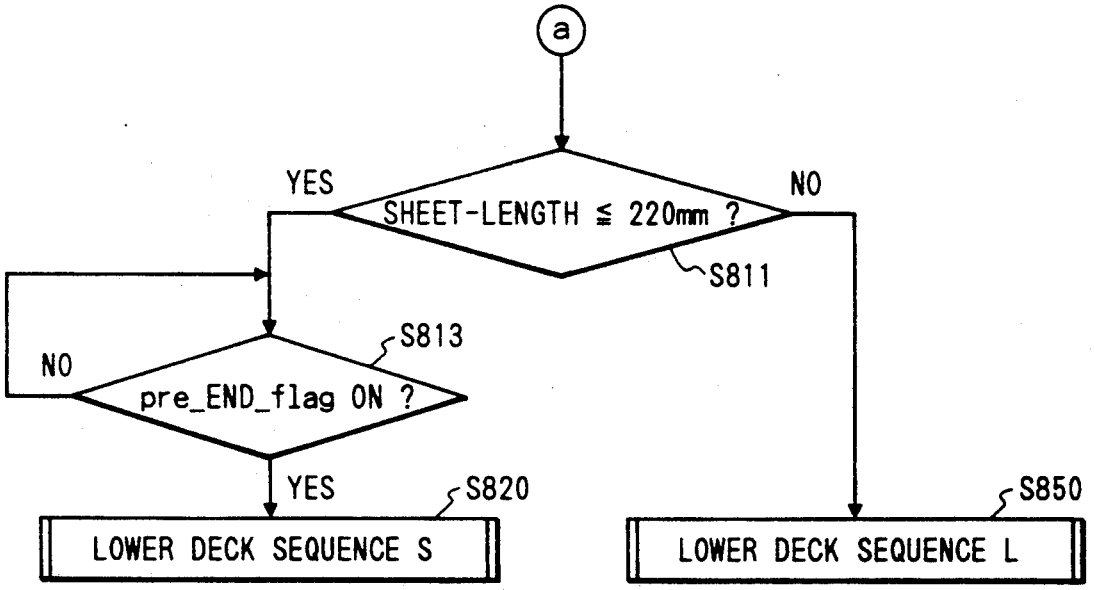
FIG. 25 is a flow chart showing part of the lower deck sheet feeding procedure.
Figure 26:
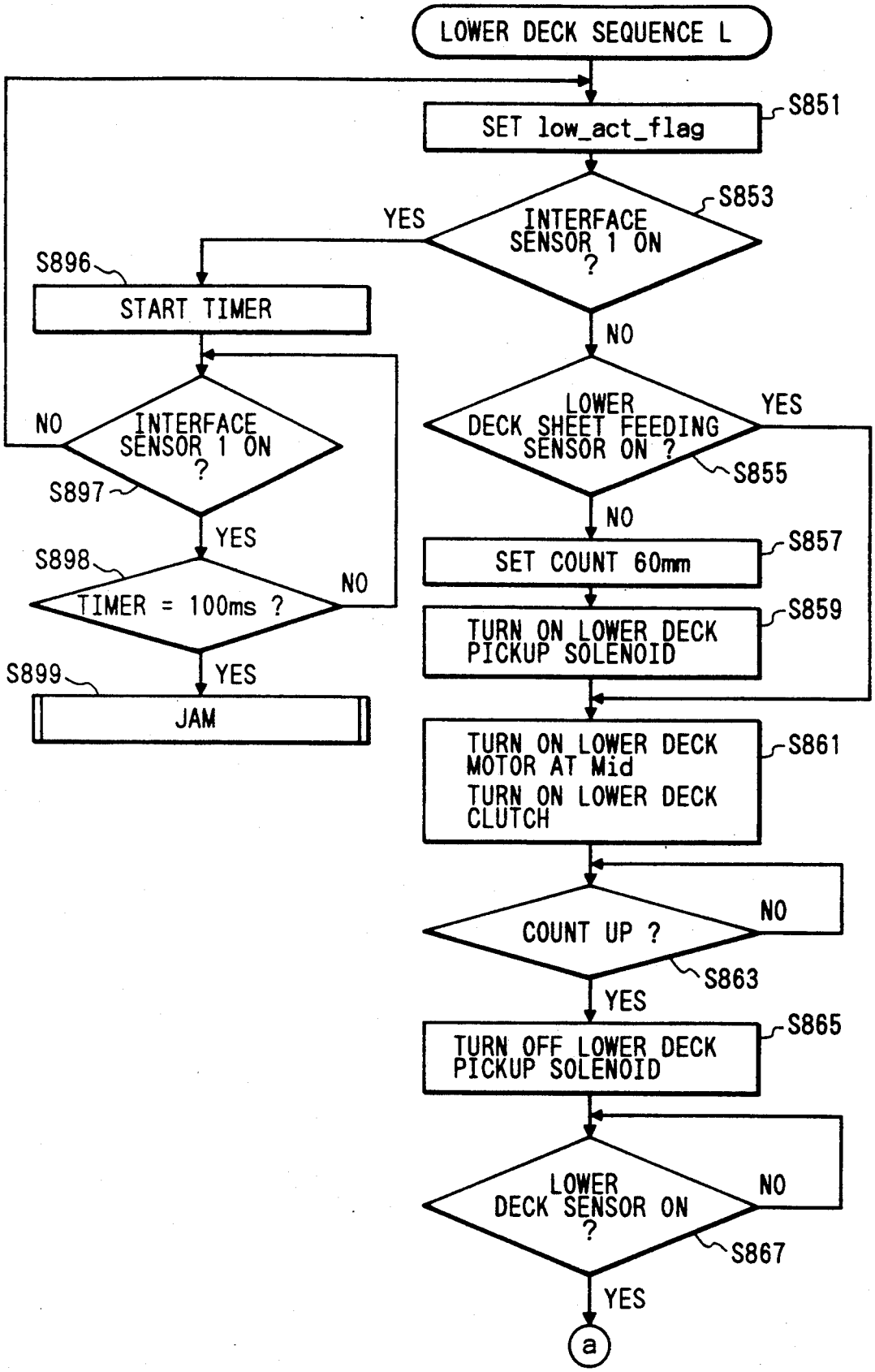
FIG. 26 is a flow chart showing part of a lower deck sheet feeding procedure for large size sheets.
Figure 27:
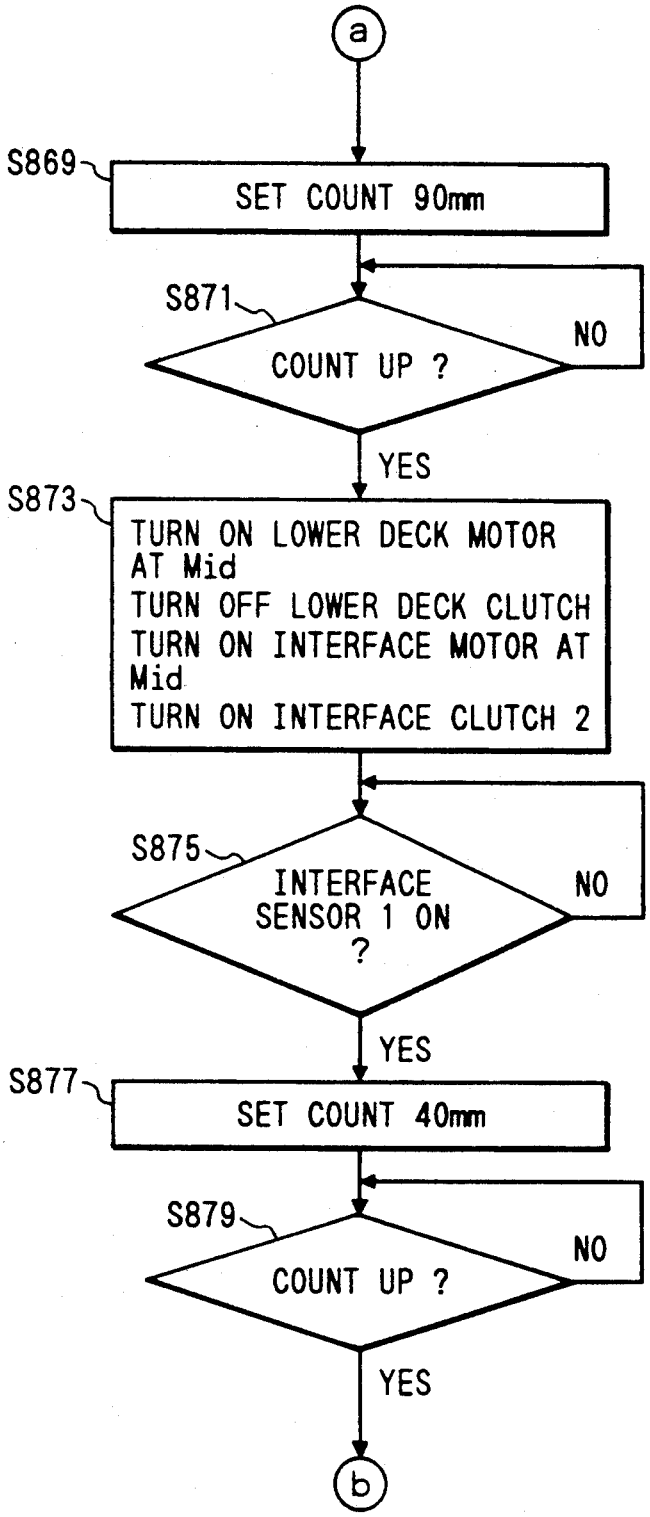
FIG. 27 is a flow chart showing part of the lower deck sheet feeding procedure for large size sheets.
Figure 28:
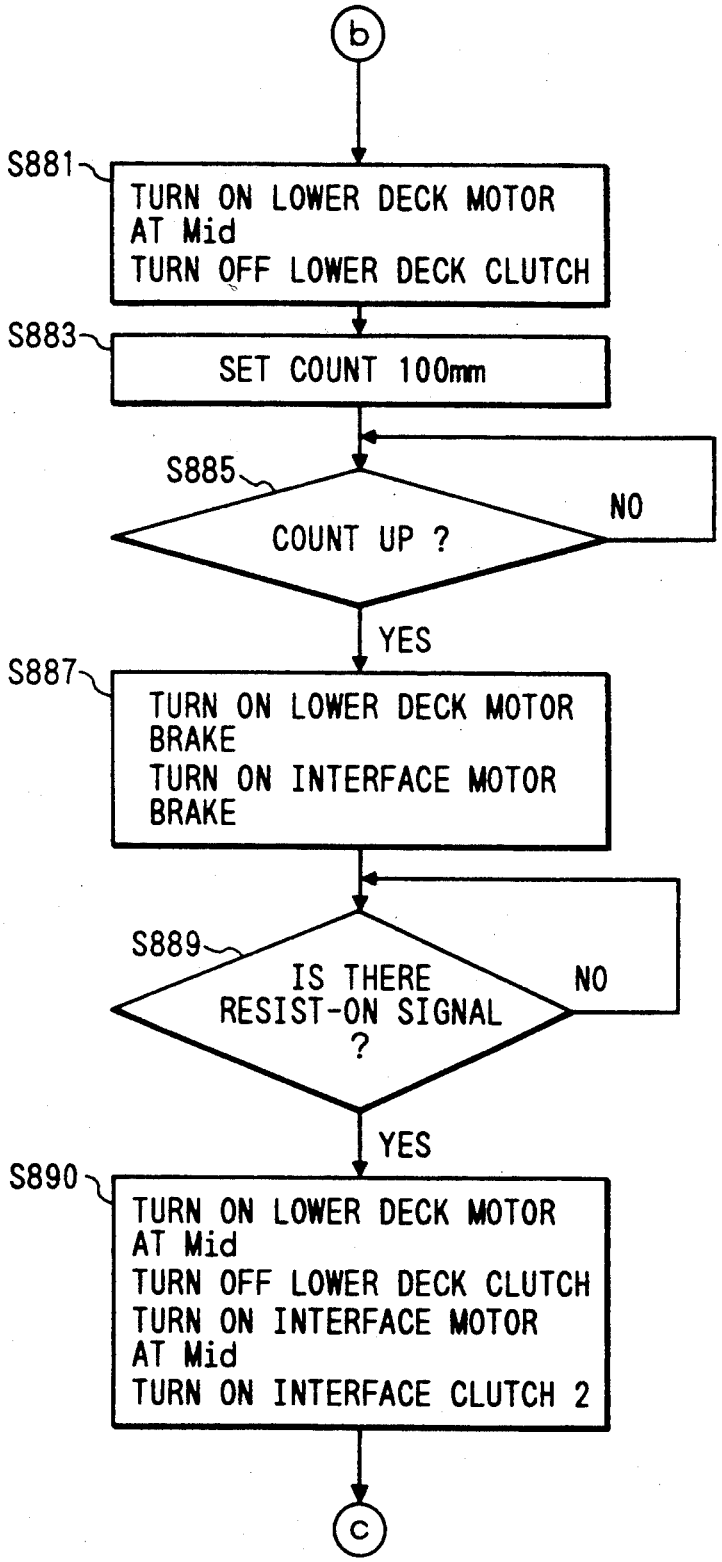
FIG. 28 is a flow chart showing part of the lower deck sheet feeding procedure for large size sheets.
Figure 29:
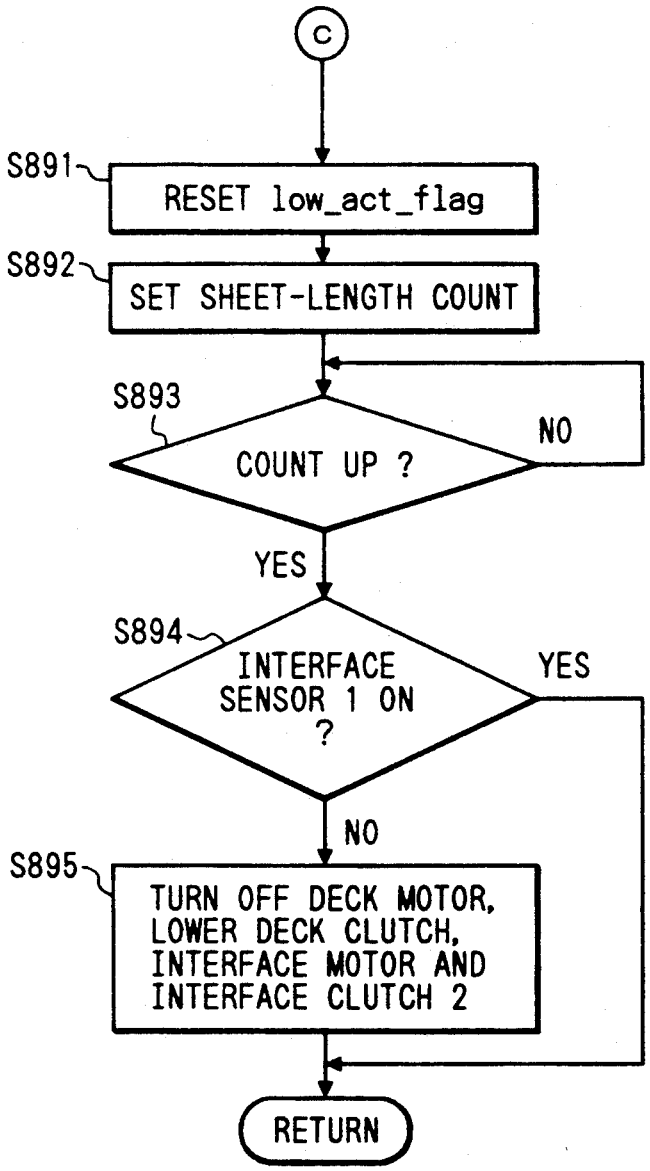
FIG. 29 is a flow chart showing part of the lower deck sheet feeding procedure for large size sheets.
Figure 30:
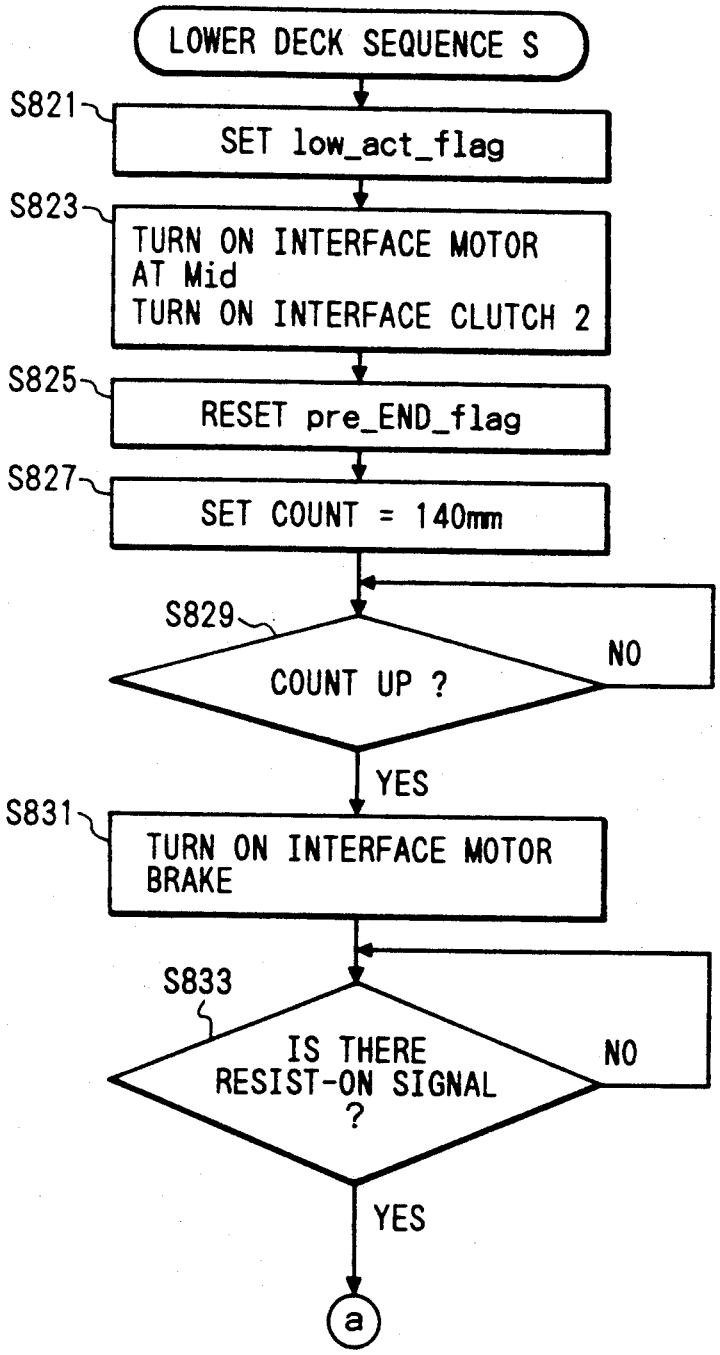
FIG. 30 is a flow chart showing part of a lower deck sheet feeding procedure for small size sheets.
Figure 31:
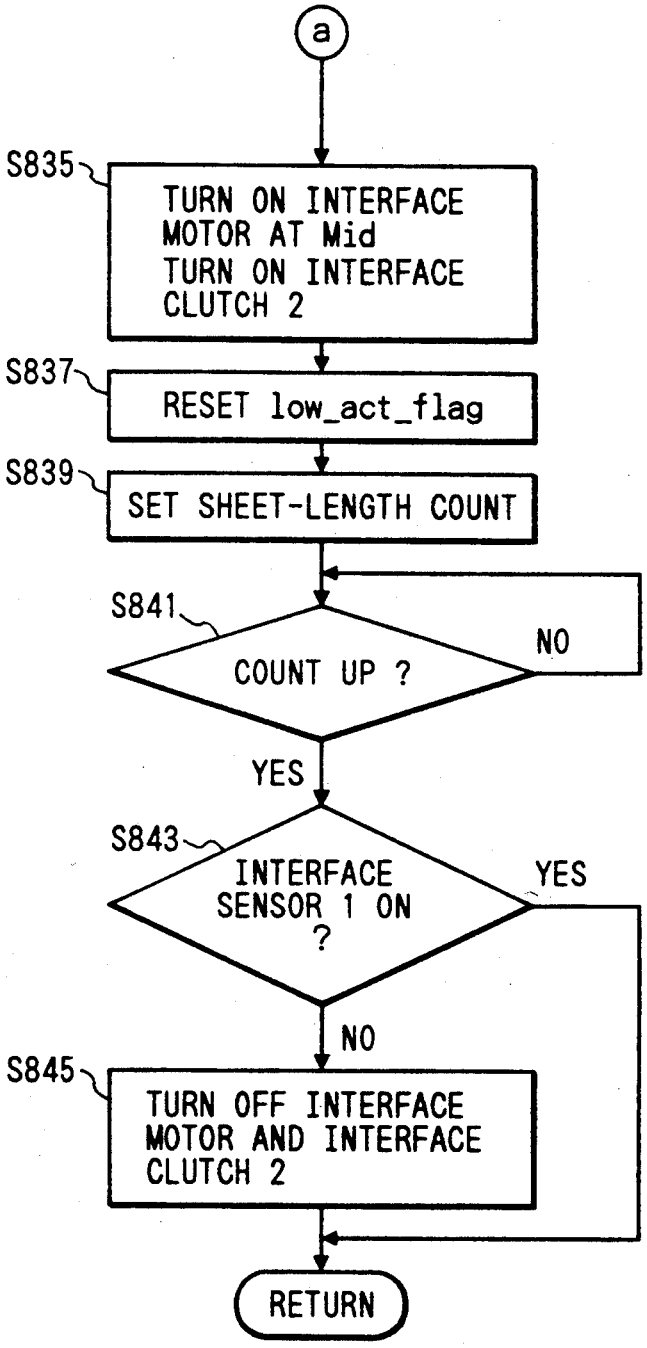
FIG. 31 is a flow chart showing part of the lower deck sheet feeding procedure for small size sheets.

FIGS. 24 and 25 are flow charts showing the lower deck sheet feeding sequence. This sequence is executed when a lower deck sheet supply signal is received from the copier main circuit.

As the initial sequence check, it is checked whether the lower deck is being set, whether any one of the upper and middle decks is stopping its operation, whether there are sheets on the lower deck, and whether the lifter has been raised to allow sheet transport (S801, S802, S803, S805, S807).

If there is a lower deck sheet feeding signal (S809), an operation of feeding sheets starts. In this case, if the length of a sheet in the lower deck is longer than 220 mm in the sheet transport direction, the sheet is transported from the sheet stacker in a similar manner to the multi sheet feeder, and upper/middle deck feeder. However, if the length of a sheet is shorter than 220 mm, a different sheet feeding sequence (sheet prefeeding sequence) is executed by placing a sheet on the transport path in advance.

In this embodiment, if the length of a sheet in the lower deck is longer than 220 mm in the sheet transport direction, the lower deck sheet feeding sequence L is performed after the initial sequence check. If the length of a sheet is shorter than 220 mm, after the initial sequence check, there are executed a flag check at S813 (flag being set in the memory), a lower deck sheet feeding sequence S, and a sheet prefeeding sequence (to be later described) (S811, S813, S820, S850).

First, the control operation for the case where the sheet length is longer than 220 mm in the sheet transport direction will be described with reference to the flow charts shown in FIGS. 24 to 29. After the initial sequence check (S801, S802, S803, S805, S807, S809), the sheet size is checked (S811) and the control advances to the lower deck sheet feeding sequence L.

In the lower deck sheet feeding sequence L, in order to indicate that the sheet feeding operation for the lower deck is being executed, a "low act flag" on a memory is set (S851). Next, it is checked whether a sheet is present within the interface unit. If present, a timer is started to check if the sensor turns off in 100 ms. If the sensor does not turn off, it is considered a jamming.

If the sensor turns off, the control returns to S851. If the sensor is off at S853, the control advances to S855 to check the lower deck sheet (insert) sensor 129. If this sensor is on, the control advances to S861; whereas if off, the count is set to 60 mm and the lower deck pickup solenoid 143 is turned on to make the pickup roller contact with a sheet (S859).

Next, the lower deck motor is rotated at a middle speed (about 500 mm/sec), and the lower deck clutch 152 is turned on to rotate the lower deck sheet feeding roller (S861). When the count-up is obtained, the lower deck pickup solenoid 143 is turned off (S863, S865) to wait until the lower deck sensor 130 turns on.

When the pulses corresponding to 90 mm have been counted starting from when the lower deck sensor 130 turned on (S867, S869, S871), the lower deck motor 171 and interface motor 169 are rotated at a middle speed (about 500 mm/sec), and the lower deck clutch 152 and interface clutch 2 (160) are turned on (S873).

When the sheet turns on the interface sensor/(137) and thereafter advances by 40 mm, the lower deck clutch is turned off (S875, S877, S879, S881). When the sheet advances further by 100 mm, the lower deck motor 171 and interface motor 169 are braked to stop the sheet (S883, S885, S887).

At this time, the sheet is stopped in the form of a loop in contact with the resist roller within the copier main body. When a resist-on signal is received from the copier main circuit (S889), the lower deck motor 171 and interface motor 169 are rotated at a middle speed (about 500 mm/sec). The lower deck clutch 152 and interface clutch 2 (160) are turned on (S890) to transport the sheet to the copier main body.

At this time, the "low act flag" on the memory is reset to permit another sheet feeding sequence (S891).

Next, the pulses corresponding to the sheet length are counted (S892, S893), and when the sheet turns off the interface sensor 1 (137), the drive system is turned off (S894, S895). In this manner, feeding a single sheet from the lower deck is completed.

Next, the control operation for the case where the sheet length is shorter than 220 mm in the sheet transport direction will be described with reference to the flow charts shown in FIGS. 24 and 25, 30 and 31. After the initial sequence check (S801, S803, S805, S807, S809), the sheet size is checked (S811) and the flag is checked (S813).

In the case where the length of a sheet in the lower deck is shorter than 220 mm, a sheet is always placed on the transport path during the standby state after the power was turned on, by executing the sheet prefeeding sequence to be described later. Upon reception of a sheet supply signal from the copier main circuit, the sheet on the transport path is fed to the copier main body and another sheet is placed on the transport path.

The flag checked at S813 is a flag which is set when a sheet has been placed to the transport path. Unless this flag is set, no sheet can be fed to the copier main body.

If the flag (pre ENDflag) is being set at S813, the lower deck sheet feeding sequence S is executed (S820).

In the lower deck sheet feeding sequence S, in order to indicate that the sheet feeding operation for the lower deck is being executed, a "low act flag" is set (S821). The interface motor 169 is rotated at a middle speed (about 500 mm/sec) and the interface clutch 2 (160) is turned on (S823). The "pre ENDflag" set on the memory is reset (S825).

When the sheet advances further by 140 mm, the interface motor 169 is braked to stop the sheet (S827, S829, S831). At this time the sheet is stopped in the form of a loop in contact with the resist roller within the copier main body.

When a resist-on signal is received from the copier main circuit (S833), the interface motor 169 is rotated at a middle speed (about 500 mm/sec). The interface clutch 2 (160) is turned on (S835) to transport the sheet to the copier main body.

At this time, the "low act flag" on the memory is reset to permit another sheet feeding sequence (S837). Next, the pulses corresponding to the sheet length are counted (S839, S841), and when the sheet turns off the interface sensor 1 (137), the drive system is turned off (S843, S845). In this manner, feeding a single sheet from the lower deck is completed.

Figure 32:
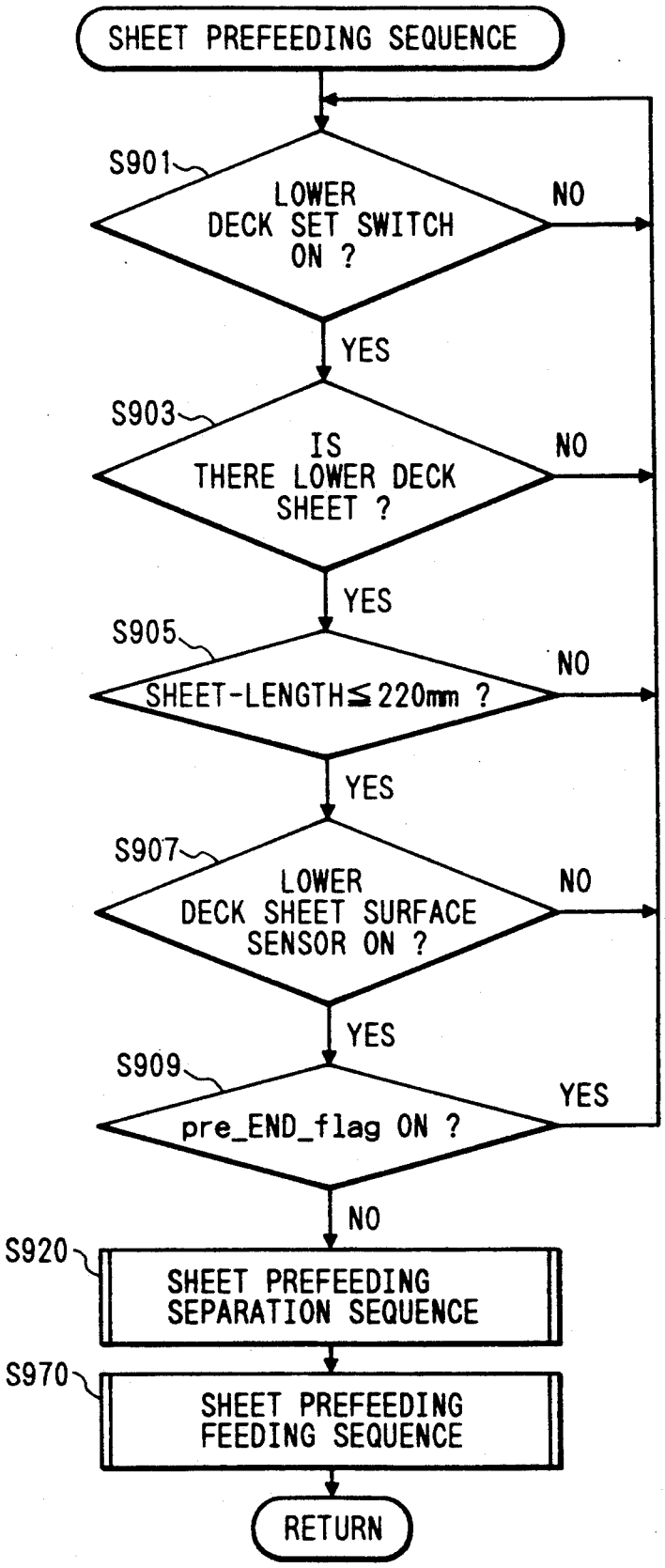
FIG. 32 is a flow chart showing a sheet prefeeding procedure.

Next, the sheet prefeeding sequence will be described with reference to FIG. 32. As the initial check for the sheet prefeeding sequence, it is checked whether the lower deck is being set, whether there are sheets on the lower deck, whether the lifter has been raised to allow sheet transport, and whether the sheet length is shorter than 220 mm in the sheet transport direction (S901, S903, S905, S907).

It is confirmed whether the "pre ENDflag" indicating a completion of a sheet transport to the transport path is on or off (S909). Thereafter, the sheet prefeeding separation sequence and sheet prefeeding sequence are carried out (S920, S970).

Figure 33:
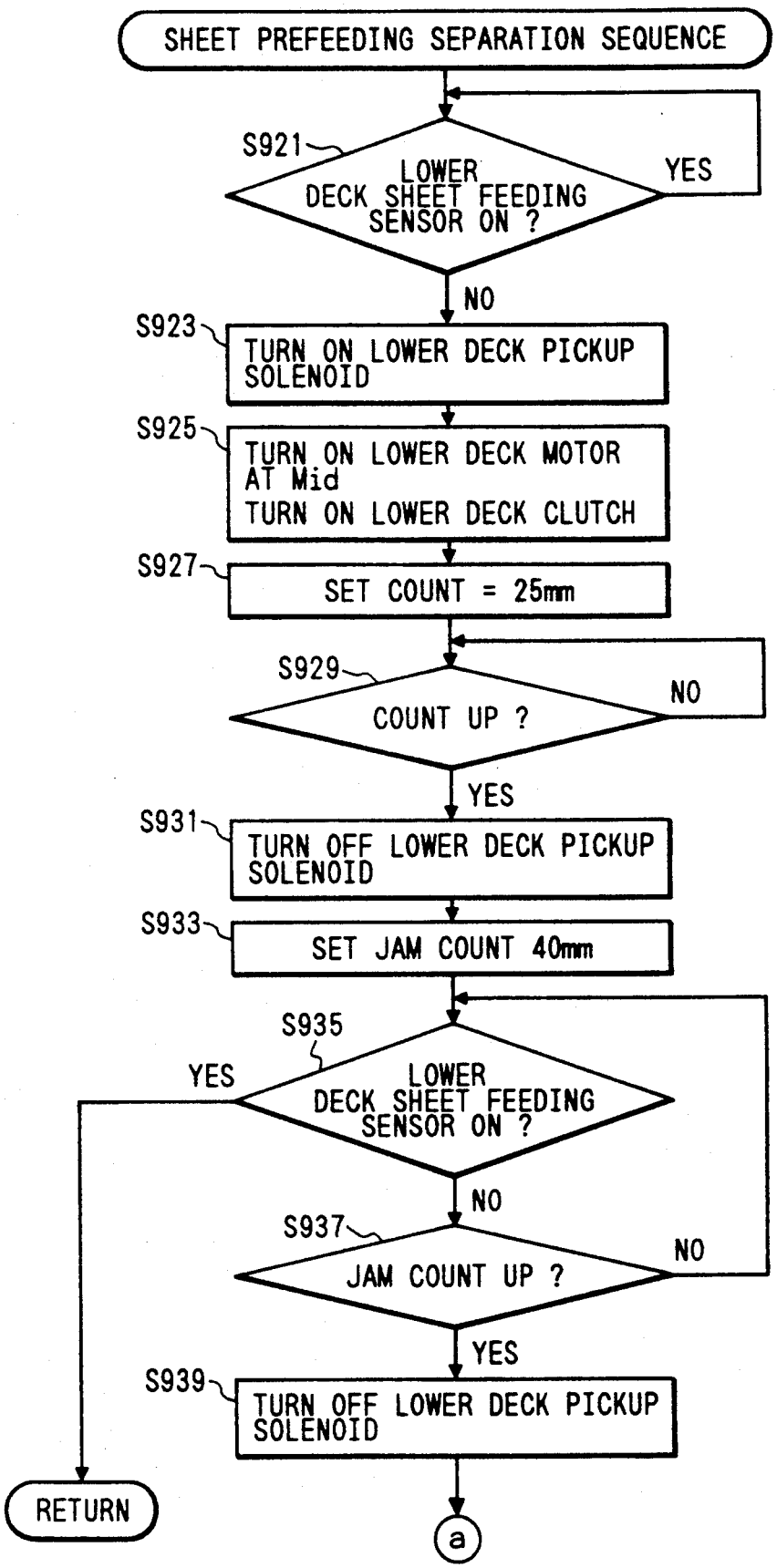
FIG. 33 is a flow chart showing part of a sheet prefeeding separation operation.
Figure 34:
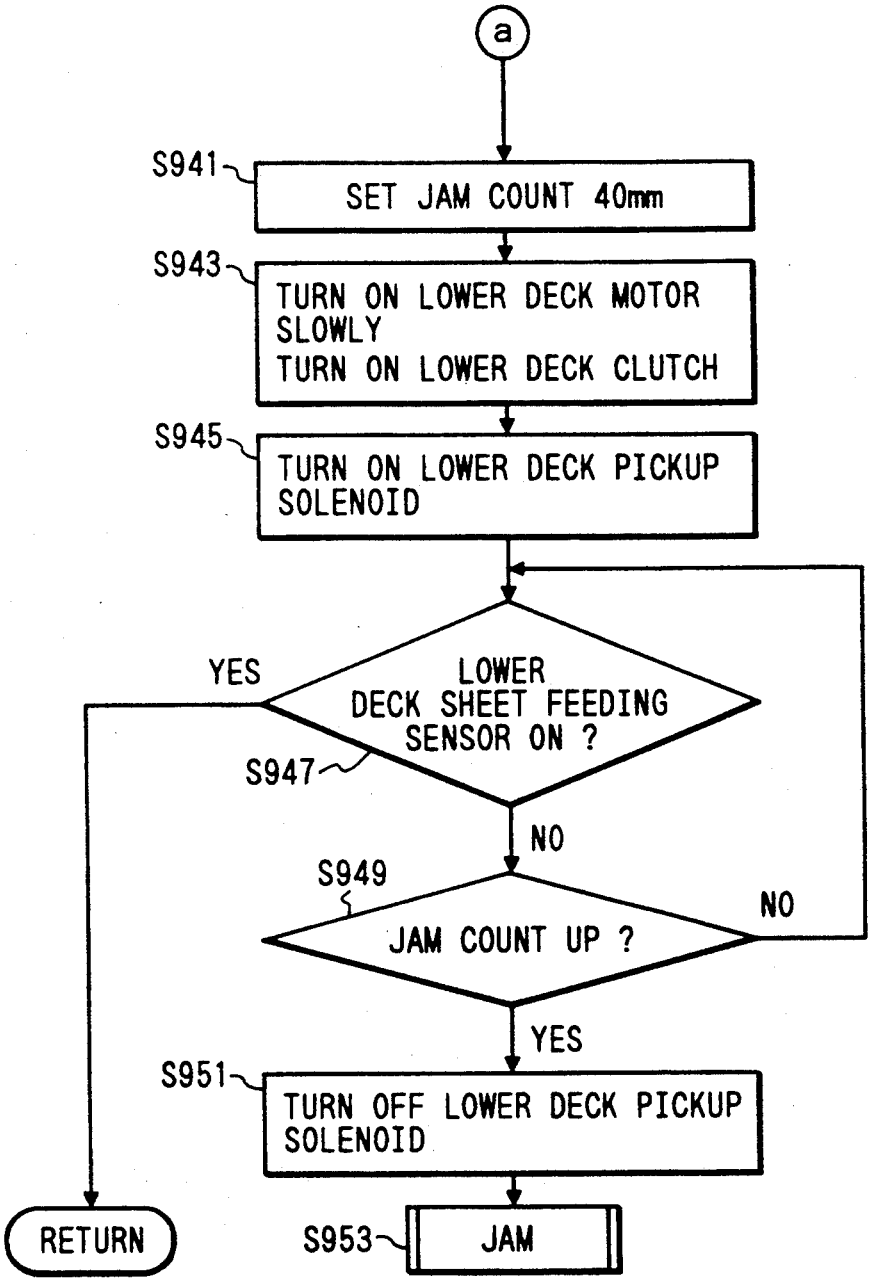
FIG. 34 is a flow chart showing part of the sheet prefeeding separation operation.

The sheet prefeeding separation sequence will be described with reference to FIGS. 33 and 34.

It is first checked whether the lower deck sheet feeding sensor 129 is on or off (S921). If on, the lower deck pickup solenoid 143 is turned on to make the pickup roller contact with a sheet (S923).

Next, the lower deck motor 171 is rotated at a middle speed (about 500 mm/sec) and the lower deck clutch 152 is turned on to rotate the lower deck sheet feeding roller (S925). A value corresponding to 25 mm is set as a count value. When a count-up occurs, the lower deck pickup solenoid 143 is turned off (S927, S929, S931).

Next, a value corresponding to 40 mm is set as a jamming count value (S933), and the control waits until the lower deck sheet sensor 129 turns on (S935). If this sensor 129 turns on within the time period corresponding to the jamming count value, the separation process is terminated (S937). If not, this is usually judged as a delay jamming of a fed sheet. In this embodiment, this is judged as a sheet pickup error, and the sheet pickup operation is executed again.

In this case, the rotation speed of the pickup roller is lowered not to make the roller slip and to ensure a reliable pickup operation. After the lower deck pickup solenoid 143 is turned off (S939), a new jamming count value corresponding to 40 mm is set (S941).

Next, the lower deck motor 171 is rotated at a slow speed (about 350 mm/sec), the lower deck clutch 152 is turned on to rotate the lower deck sheet feeding roller (S943), and the lower deck pickup solenoid 143 is turned on (S945). The control then waits until the lower deck sheet feeding sensor 129 turns on (S947). If this sensor turns on within the time period corresponding to the jamming count value, the separation operation is terminated (S949).

If the sensor does not turn on within the time period corresponding to the jamming count value, the lower deck pickup solenoid 143 is turned off (S951) to process it as a sheet jamming.

Figure 35:
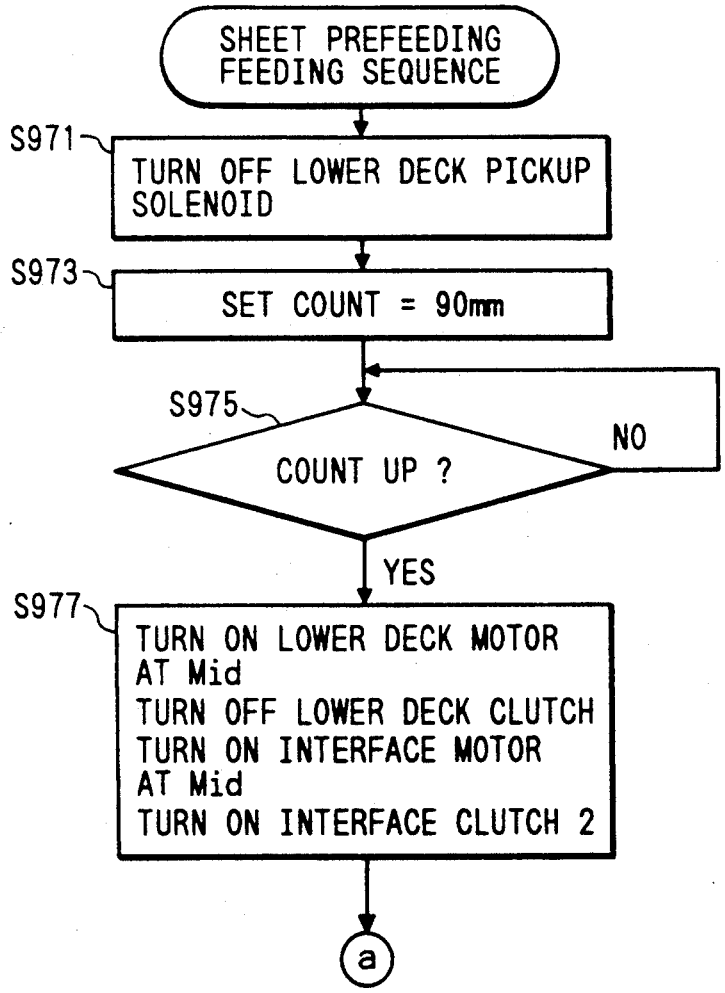
FIG. 35 is a flow chart showing part of a sheet prefeeding operation.
Figure 36:
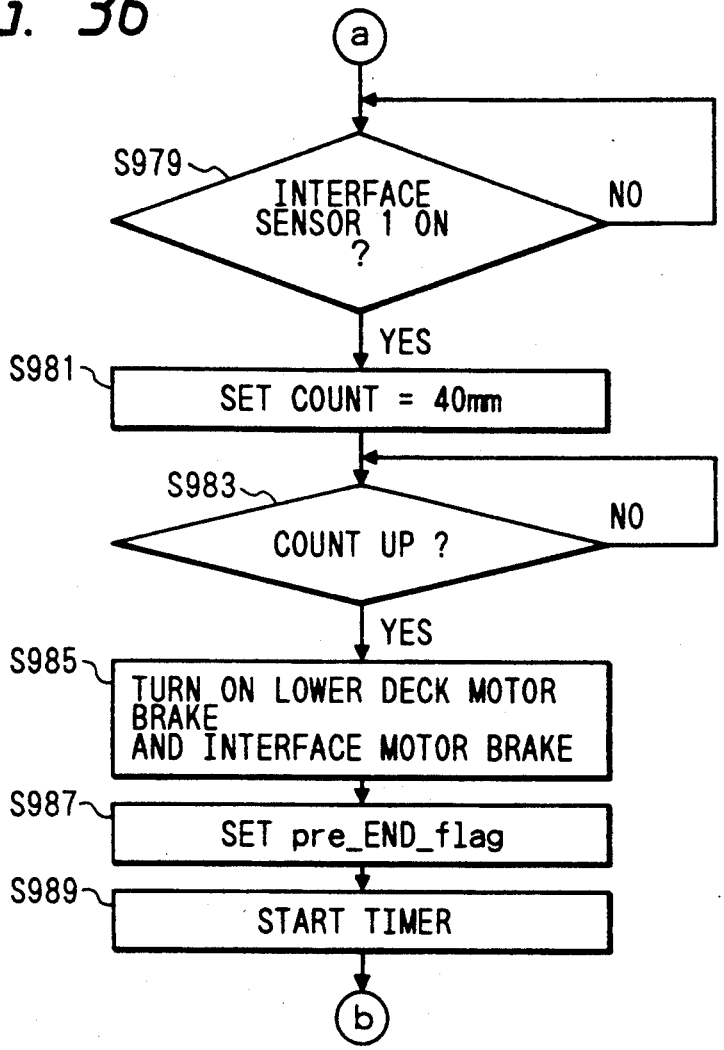
FIG. 36 is a flow chart showing part of the sheet prefeeding operation.
Figure 37:
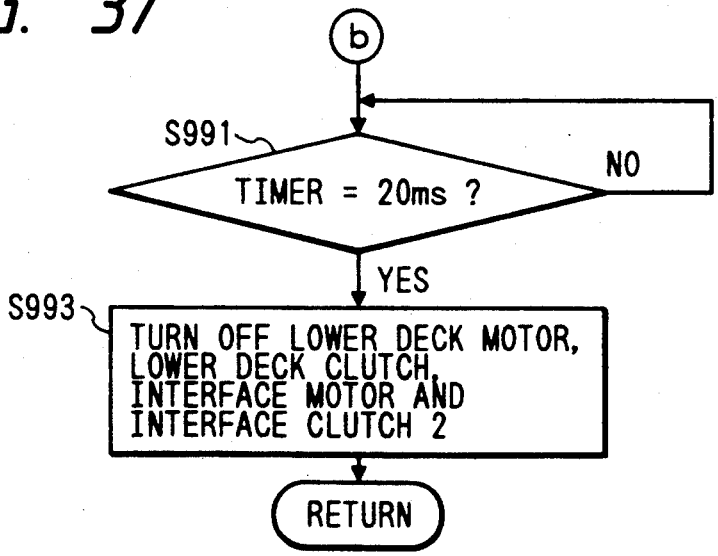
FIG. 37 is a flow chart showing part of the sheet prefeeding operation.

Next, the sheet prefeeding sequence will be described with reference to FIGS. 35 to 37.

First, the lower deck pickup solenoid 143 is turned off, and when the pulses corresponding to 90 mm have been counted (S971, S973, S975), the lower deck motor 171 and interface motor 169 are rotated at a middle speed (about 500 mm/sec) and the lower deck clutch 152 and interface clutch 2 (160) are turned on (S977).

When the sheet advances further by 40 mm from when the interfaces sensor 1 (137) turned on, the lower deck motor 171 and interface motor 169 are braked to stop the sheet (S979, S981, S983, S985).

In the above manner, sheet feeding on the transport path has been completed. The "pre ENDflag" on the memory indicating such a condition is set (S987). After 20 ms, the motor drive is turned off (S989, S991, S993).

2nd Embodiment

In the re-separation operation of the first embodiment, the separation speed is lowered until the re-separation operation has been completed, posing a problem of a temporarily deteriorated image forming efficiency. Namely, in the first embodiment, upon occurrence of a separation error of a sheet fed at a high speed, the re-separation operation is performed at a low rotation speed of the separation roller to ensure a stable operation. If there is a sheet on another feeding unit, having the transport path and feeding and driving mean), different from the feeding unit at which a separation error occurred, it is possible to feed this sheet without lowering the image forming efficiency caused by the lowered separation speed. This second embodiment will be described below.

Figure 38:
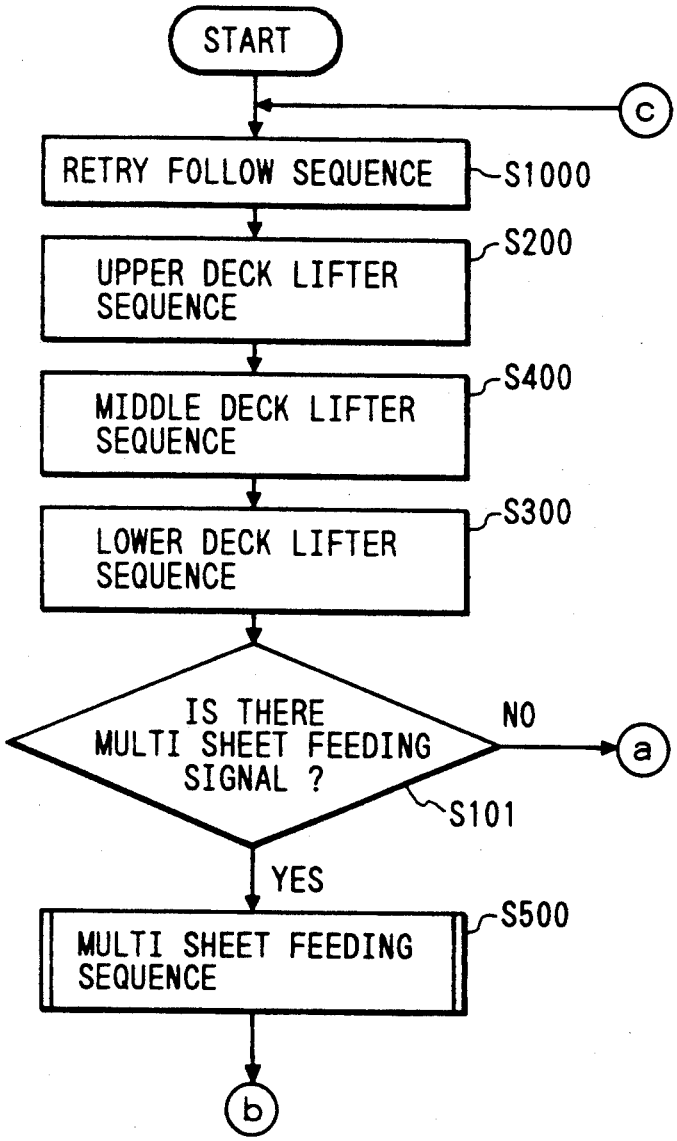
FIG. 38 is a flow chart showing part of the whole control procedure according to a second embodiment of the present invention.
Figure 39:
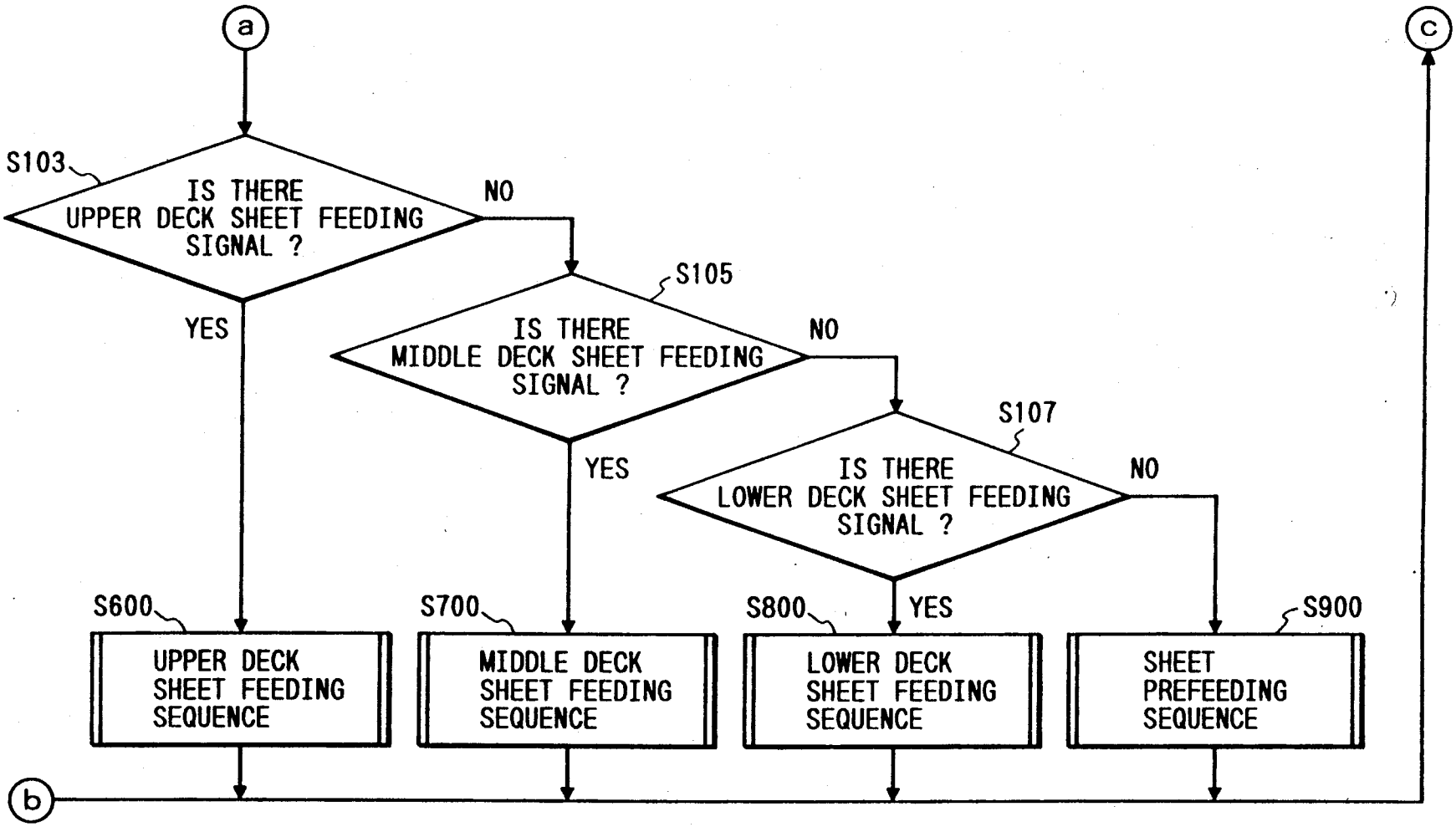
FIG. 39 is a flow chart showing part of the whole control procedure according to the second embodiment of the present invention.
Figure 40:
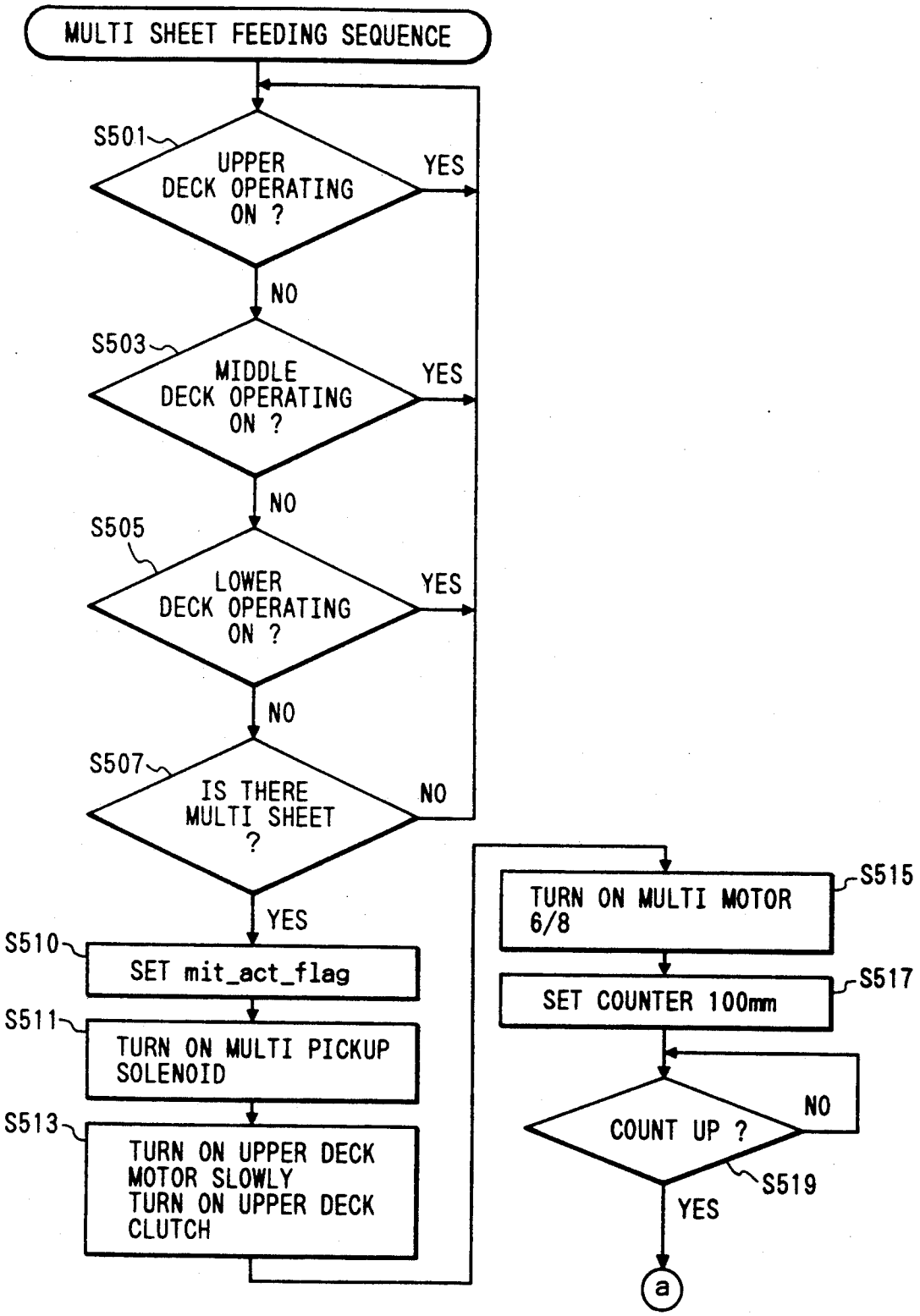
FIG. 40 is a flow chart showing part of a multi sheet feeding procedure according to the second embodiment.
Figure 41:
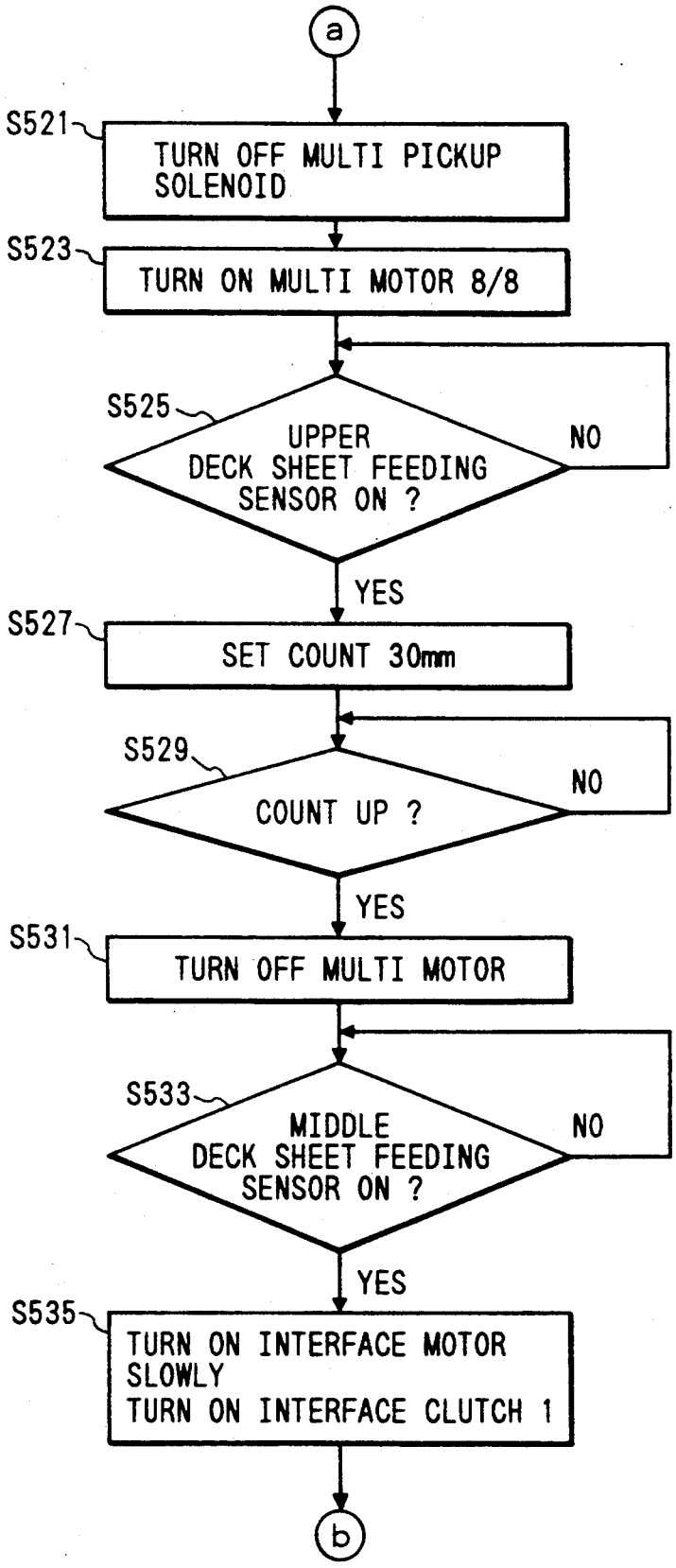
FIG. 41 is a flow chart showing part of the multi sheet feeding procedure according to the second embodiment.
Figure 42:
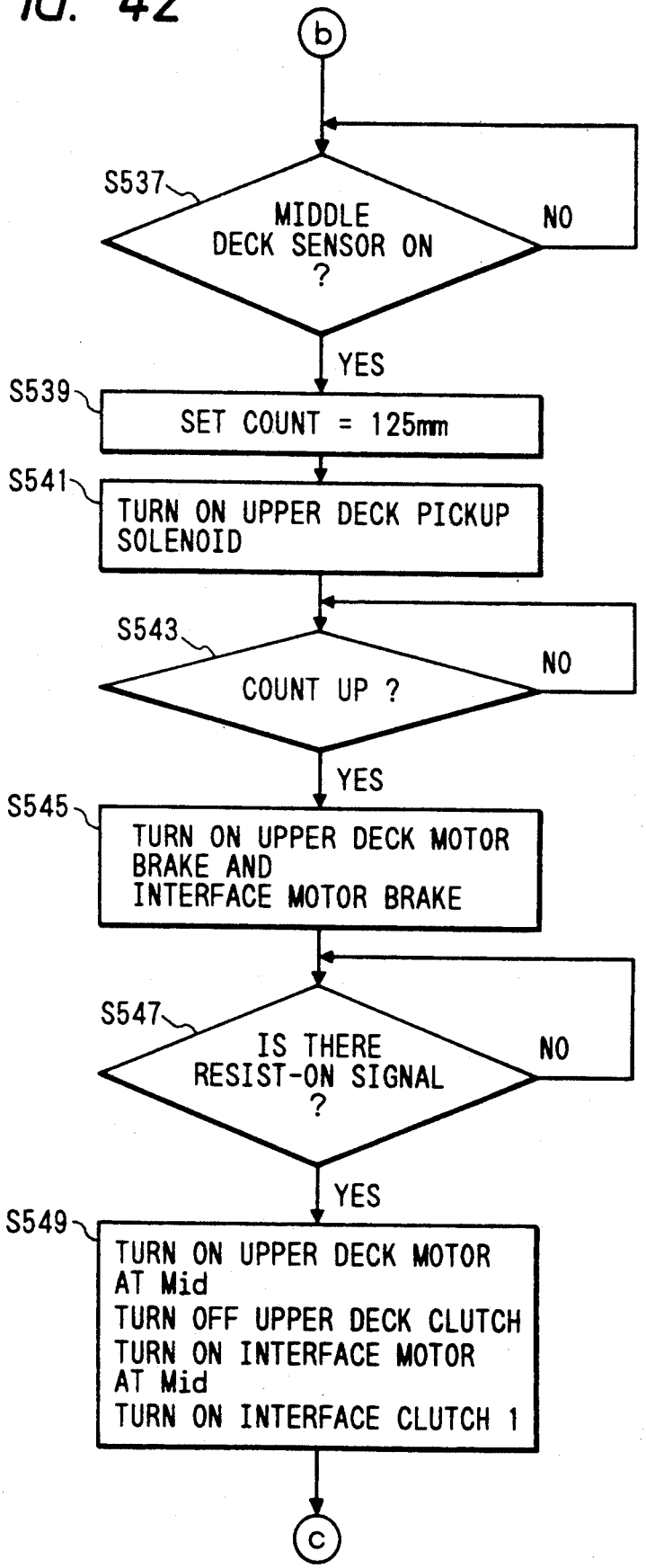
FIG. 42 is a flow chart showing part of the multi sheet feeding procedure according to the second embodiment.
Figure 43:
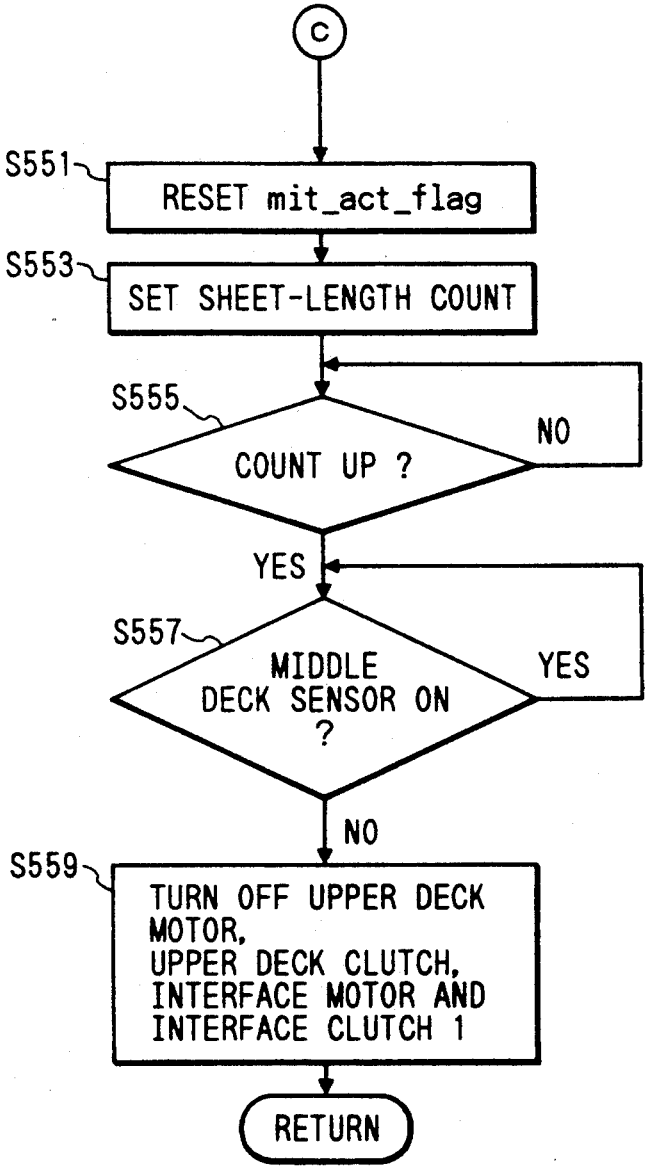
FIG. 43 is a flow chart showing part of the multi sheet feeding procedure according to the second embodiment.
Figure 44:
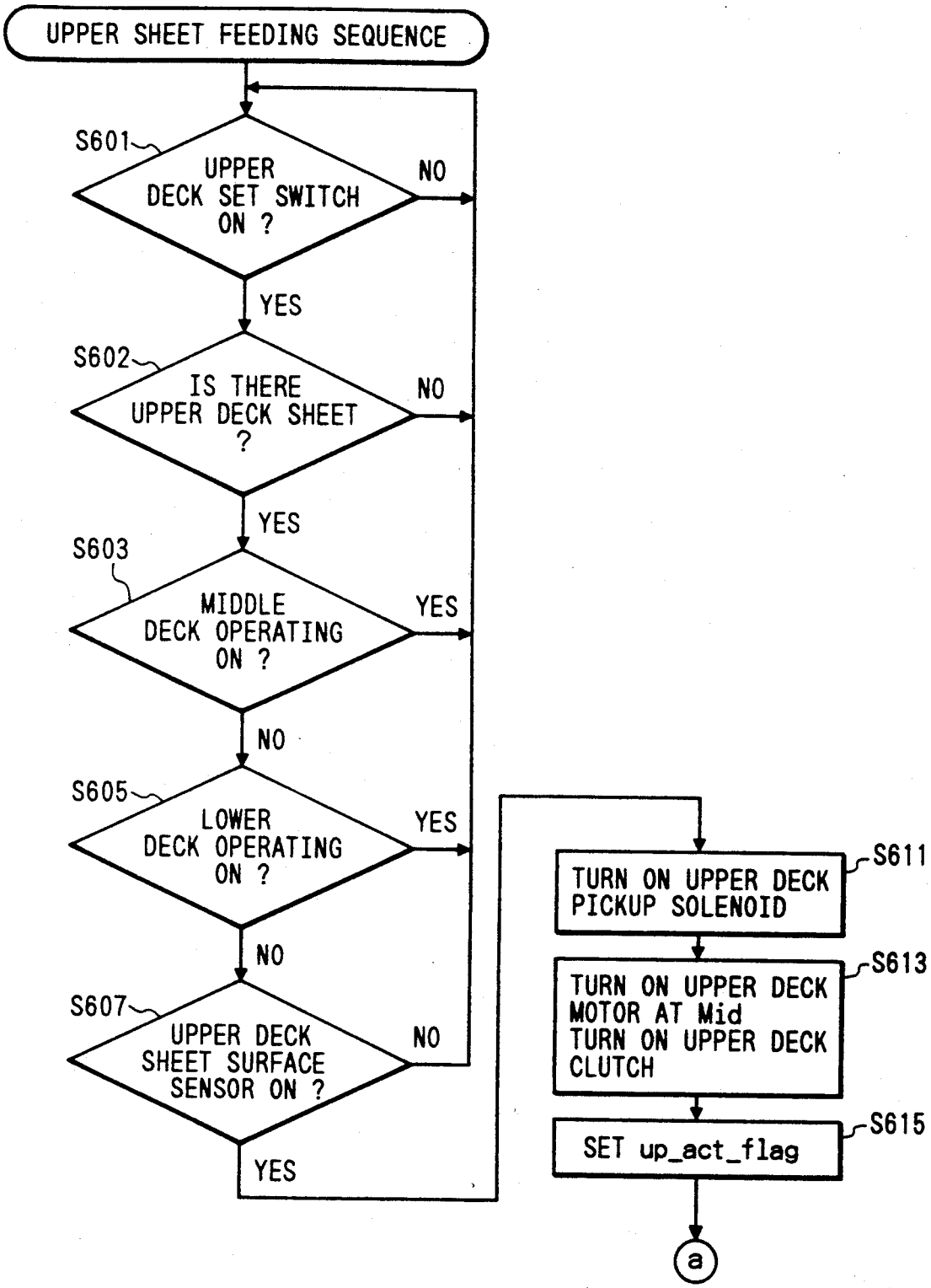
FIG. 44 is a flow chart showing part of an upper deck sheet feeding procedure according to the second embodiment.
Figure 45:
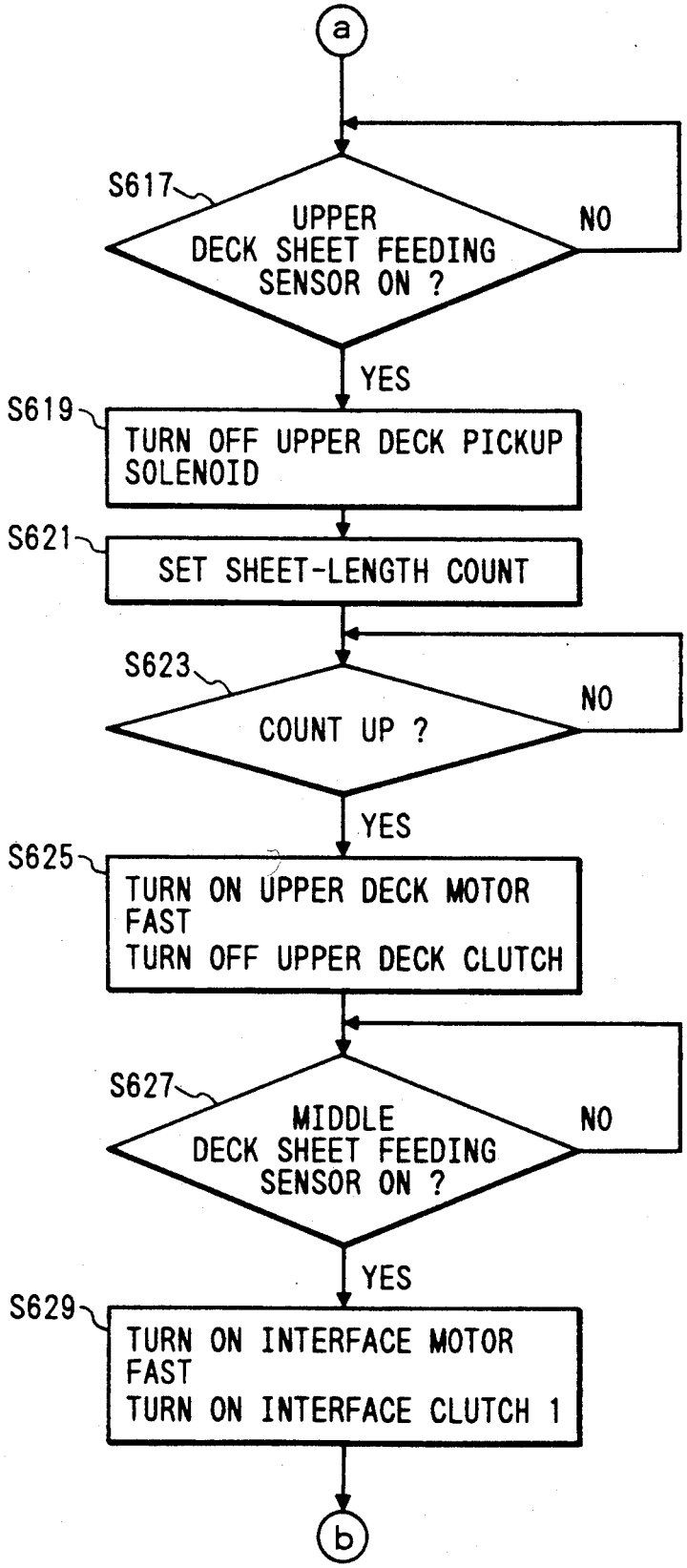
FIG. 45 is a flow chart showing part of the upper deck sheet feeding procedure according to the second embodiment.
Figure 46:
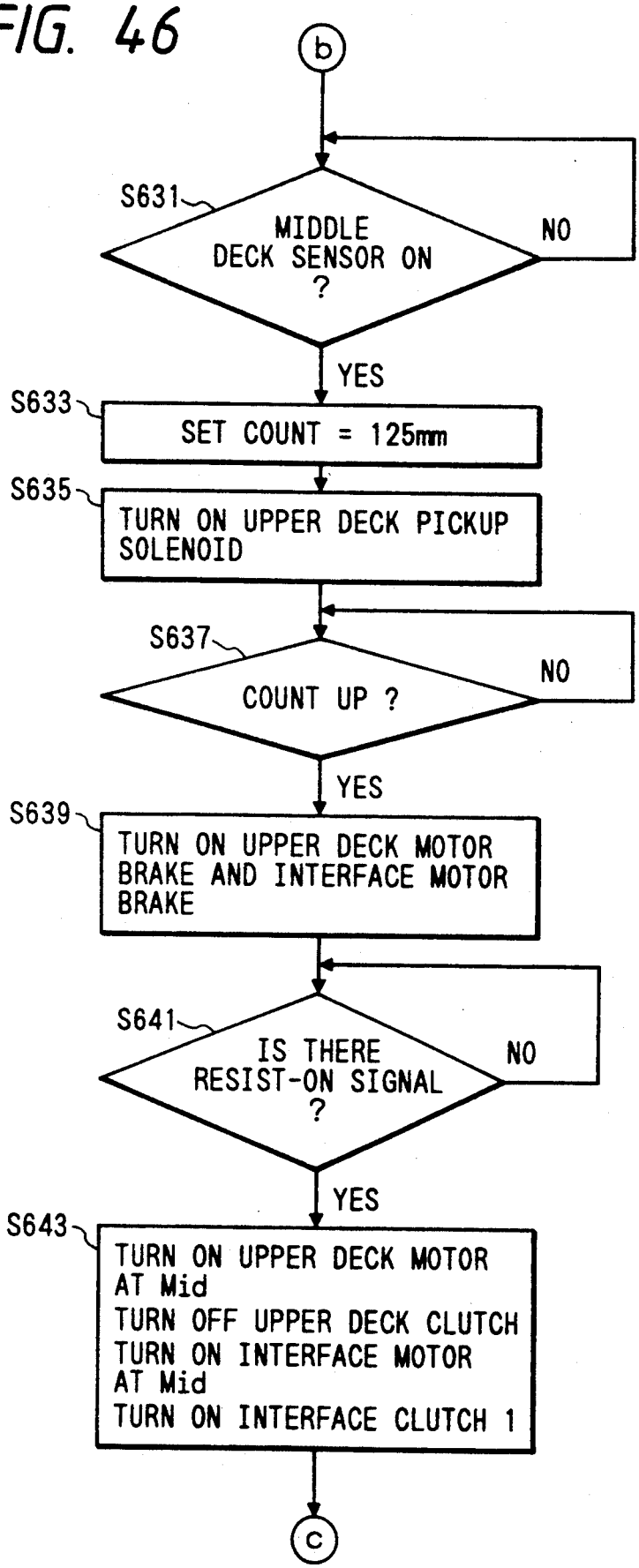
FIG. 46 is a flow chart showing part of the upper deck sheet feeding procedure according to the second embodiment.
Figure 47:
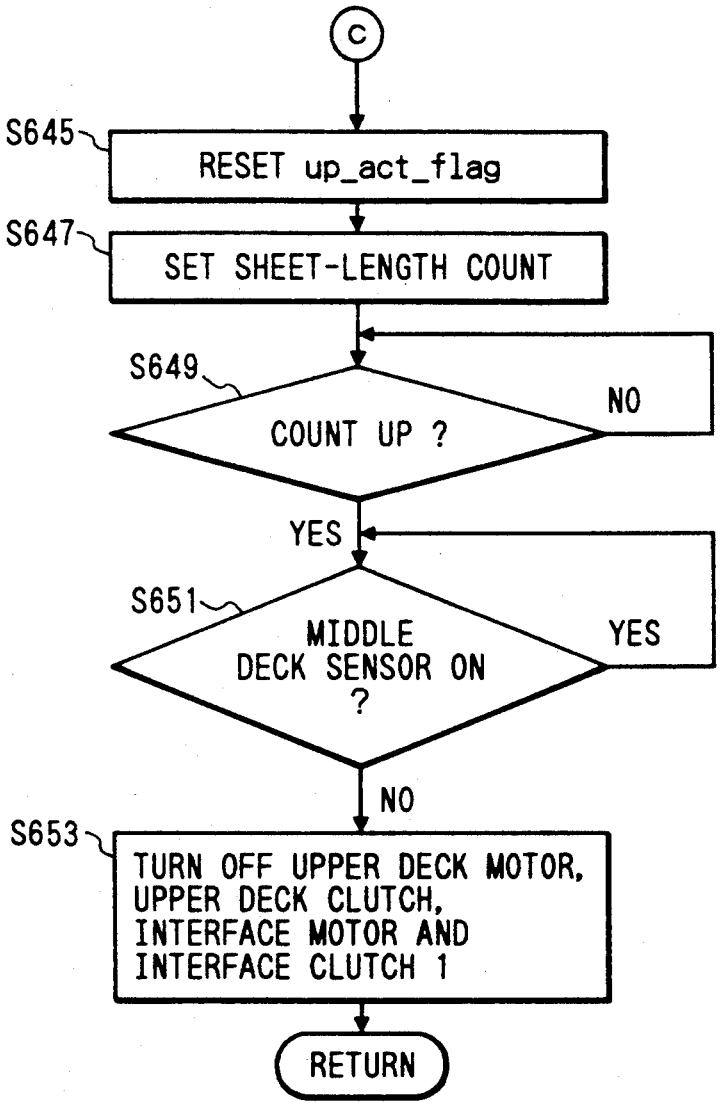
FIG. 47 is a flow chart showing part of the upper deck sheet feeding procedure according to the second embodiment.

First, a retry follow sequence (S1000), an upper deck lifter sequence (S200), a middle deck lifter sequence (S400), and a lower deck lifter sequence (S300) are performed as shown in the flow charts of FIGS. 38 and 39.

Next, it is checked whether there is a multi sheet feeding signal from the copier (S101). This multi sheet feeding signal is a sheet feeding request signal from the copier for the multi sheet feeder of PFU. In response to this signal, PFU starts feeding a sheet.

Similarly, an upper deck sheet feeding signal, middle deck sheet feeding signal, and lower deck sheet feeding signal are sheet feeding request signals for the upper, middle, and lower decks, respectively.

If there is a sheet feeding signal at S101, the control advances to a multi sheet feeding sequence at S500. If there is no sheet feeding signal, it is checked at S103 whether there is an upper deck sheet feeding signal.

If there is a sheet feeding signal at S103, the control advances to an upper deck sheet feeding sequence at S600. If there is no upper deck sheet feeding signal, it is checked at S105 whether there is a middle deck sheet feeding signal.

If there is a sheet feeding signal at S105, the control advances to a middle deck sheet feeding sequence at S700. If there is no sheet feeding signal, it is checked at S107 whether there is a lower deck sheet feeding signal. If there is a sheet feeding signal at S107, the control advances to a lower deck sheet feeding sequence at S800. If and if not, the control advances to a sheet prefeeding sequence at S900.

After completing each sequence, the control returns to the retry follow sequence (S1000).

Each sequence (S200 to S1100) will be described.

The flow charts of the first embodiment shown in FIGS. 10 and 11 for the upper deck lifter sequence (S200) are applicable to the second embodiment. The contents of the control operation are the same as the first embodiment, and so the description thereof is omitted.

The control operation of the lower deck lifter is the same as shown in FIGS. 12 and 13, and so the description thereof is omitted.

Next, the flow charts showing an operation of feeding a sheet will be described.

First, the multi sheet feeding sequence for the multi sheet feeder will be described. FIGS. 40 to 43 are flow charts showing the multi sheet feeding sequence for the multi sheet feeder.

This sequence is executed when a multi sheet supply signal is received from the copier main circuit. As the initial sequence check, it is checked whether any one of the upper/middle/lower decks is stopping its operation and whether there are sheets on the multi sheet feeder (S501, S503, S505, S507).

If there is any sheet, an operation of feeding the sheet starts. In order to indicate that the sheet feeding operation for the multi sheet feeder is being executed, a "mlt act flag" on a memory is set (S510). The multi pickup solenoid 140 is turned on to make the pickup roller contact with a sheet (S511).

Next, the upper deck motor 170 is rotated at a slow speed (about 350 mm/sec), the upper deck clutch 150 is turned on to rotate the upper deck feeding roller (S513), and at the same time the multi sheet feeding motor 139 is rotated at a duty ratio 6/8 (S515) to advance the sheet by 100 mm (S517, S519). Since the encoder is mounted on the rotary shaft of the motor, it is possible for CPU 101 to know the length of the sheet advance from the fed-back output of the encoder.

The multi pickup solenoid 140 is turned off (S521), the multi sheet feeding motor 139 is rotated at a duty ratio 8/8 (S523), the upper deck sheet feeding sensor 126 is turned on (S525) to advance the sheet by 30 mm, and then the multi sheet feeding motor is turned off (S527, S529, S531). The sheet is fed by the upper deck sheet feeding roller. When the sheet turns on the middle deck sheet feeding sensor 127 (S533), the interface motor 169 is rotated at the slow speed, and the interface clutch 159 is turned on (S535).

When the middle deck sheet feeding sensor 127 turns on, the pickup solenoid 141 is turned on for the transport of the next sheet (S537, S541). When the sheet reaches the position in advance of the middle deck sheet feeding sensor 127 by 125 mm, the upper deck sheet feeding motor 170 and interface motors 169 are braked to stop the sheet (S545).

At this time the sheet is stopped in the form of a loop in contact with the resist roller within the copier main body.

When a resist-on signal is received from the copier main circuit (S731), the upper deck motor 170 and interface motor 169 are rotated at a middle speed (about 500 mm/sec). The upper deck clutch 150 is turned off and the interface clutch 160 is turned on (S549), to transport the sheet to the copier main body.

At this time, the "mlt act flag" on the memory is reset to permit another sheet feeding sequence (S551).

Next, the pulses corresponding to the sheet length are counted (S553, S555), and when the sheet turns off the middle deck sensor 128, the drive system is turned off (S557, S559). In this manner, feeding a single sheet from the multi sheet feeder is completed.

Next, the upper deck sheet feeding sequence will be described. FIGS. 44 to 47 are flow charts showing the upper deck sheet feeding sequence. This sequence is executed when an upper deck sheet supply signal is received from the copier main circuit. As the initial sequence check, it is checked whether the upper deck is being set, whether any one of the middle and lower decks is stopping its operation, whether there are sheets on the upper deck, and whether the lifter has been raised to allow sheet transport (S601, S602, S603, S605, S607). If there is an upper deck sheet feeding signal, an operation of feeding sheets starts.

First, the upper deck pickup solenoid 141 is turned on to make the pickup roller contact with a sheet (S611). Next, the upper deck motor 170 is rotated at a middle speed (about 500 mm/sec), the upper deck clutch 150 is turned on to rotate the upper deck feeding roller (S613).

In order to indicate that the sheet feeding operation for the upper deck is being executed, an "up act flag" on a memory is set (S615). The sheet is fed by the upper deck sheet feeding roller. When the sheet turns on the upper deck sheet feeding sensor 126, the upper deck pickup solenoid 141 is turned off (S617, S619). The pulses corresponding to the sheet length are counted starting from when the upper deck sheet feeding sensor 126 turns on, and when the count-up occurs (S621, S623), the rotation speed of the upper deck motor 170 is increased to a fast speed (about 750 mm/sec), and the upper deck clutch 150 is turned off (S625).

When the sheet turns on the middle deck sheet feeding sensor 127 (S627), the interface motor 169 is rotated at the fast speed, and the interface clutch 1 (159) is turned on (S629). When the middle deck sheet feeding sensor 127 turns on, the upper deck sheet solenoid 141 is turned on for the transport of the next sheet (S631, S635). When the sheet reaches the position in advance of the middle deck sheet feeding sensor 127 by 125 mm, the upper deck motor 170 and interface motor 169 are braked to stop the sheet (S633, S637, S639).

At this time the sheet is stopped in the form of a loop in contact with the resist roller within the copier main body. When a resist-on signal is received from the copier main circuit (S641), the upper deck motor 170 and interface motor 169 are rotated at a middle speed (about 500 mm/sec). The upper deck clutch 150 is turned off and the interface clutch 160 is turned on (S643), to transport the sheet to the copier main body.

At this time, the "up act flag" on the memory is reset to permit another sheet feeding sequence (S645). Next, the pulses corresponding to the sheet length are counted (S647, S649), and when the sheet turns off the middle deck sensor 128, the drive system is turned off (S651, S653). In this manner, feeding a single sheet from the upper deck is completed.

Figure 48:
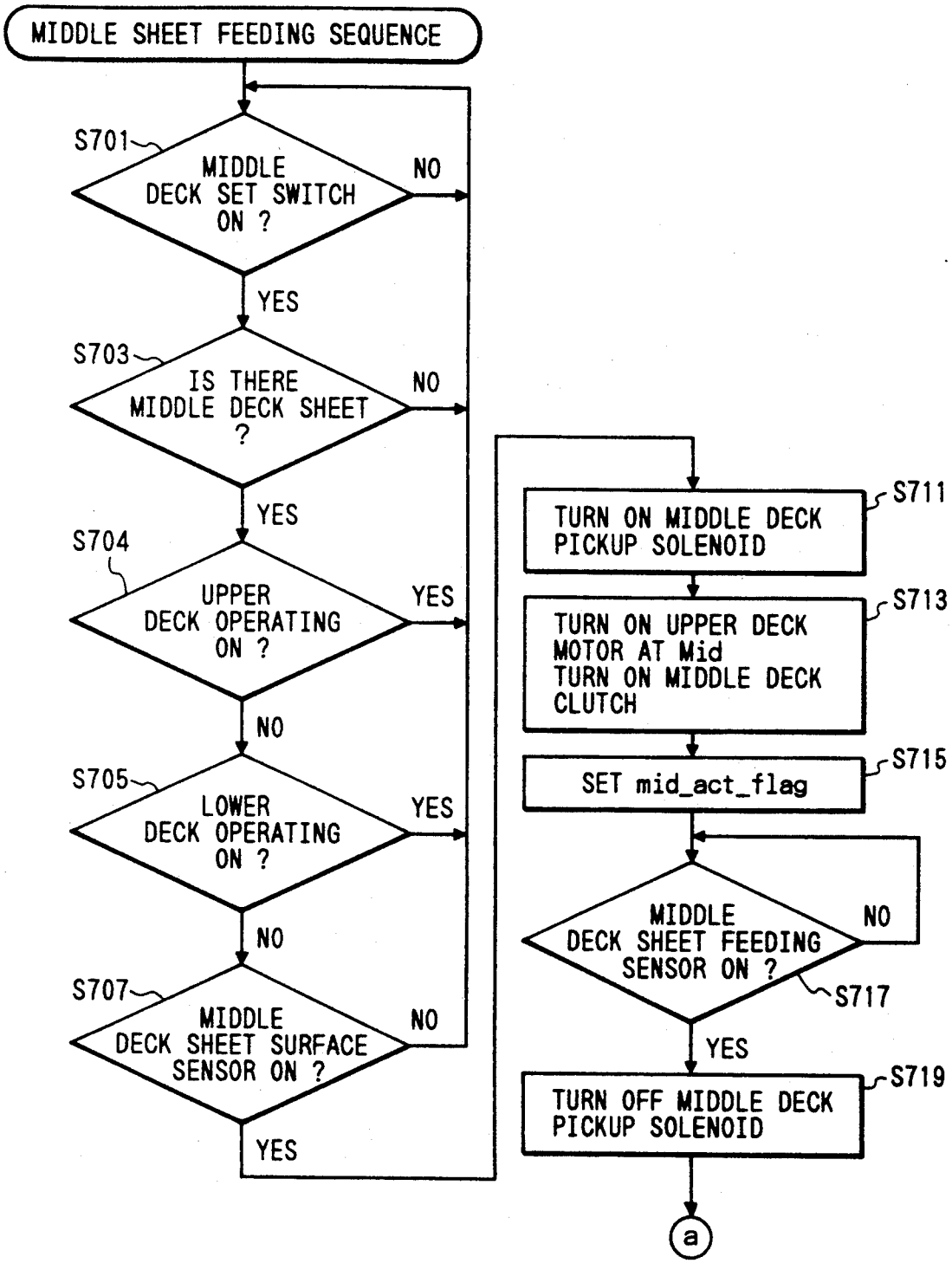
FIG. 48 is a flow chart showing part of a middle deck sheet feeding procedure according to the second embodiment.
Figure 49:
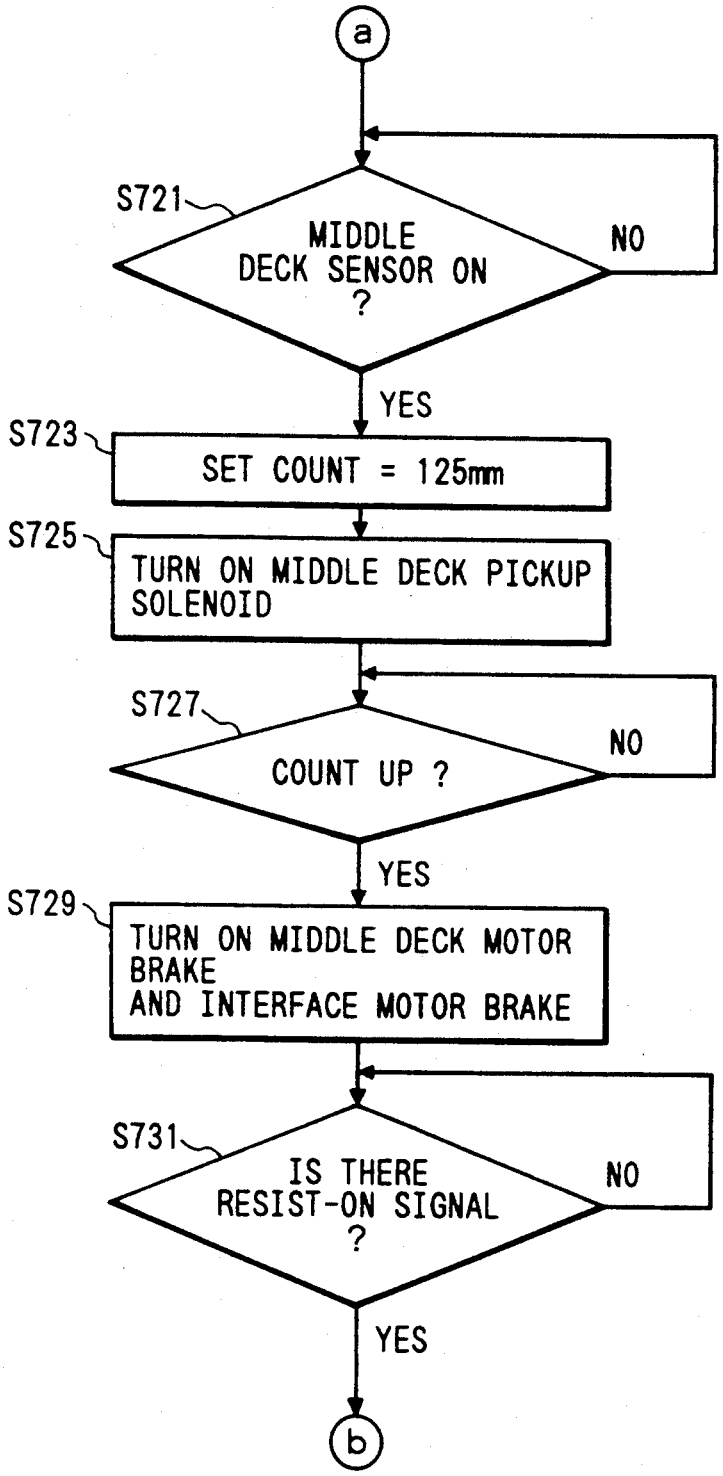
FIG. 49 is a flow chart showing part of the middle deck sheet feeding procedure according to the second embodiment.
Figure 50:
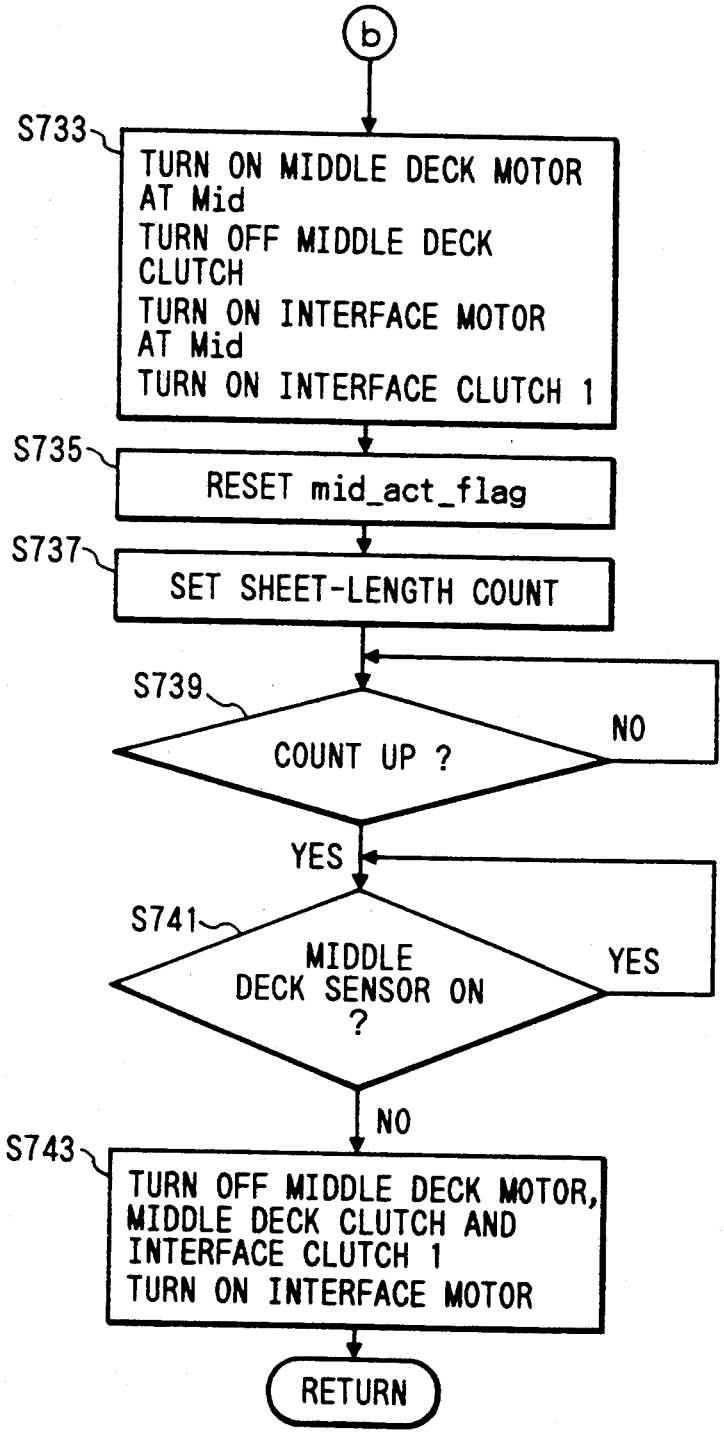
FIG. 50 is a flow chart showing part of the middle deck sheet feeding procedure according to the second embodiment.

Next, the middle deck sheet feeding sequence will be described. FIGS. 48 to 50 are flow charts showing the middle deck sheet feeding sequence.

This sequence is executed when a middle deck sheet supply signal is received from the copier main circuit. As the initial sequence check, it is checked whether the middle deck is being set, whether any one of the upper and lower decks is stopping its operation, whether there are sheets on the middle deck, and whether the lifter has been raised to allow sheet transport (S701, S702, S703, S705, S707). Then, an operation of feeding sheets starts.

First, the middle deck pickup solenoid 142 is turned on to make the pickup roller contact with a sheet (S711). Next, the upper deck motor 170 is rotated at a middle speed (about 500 mm/sec), and the middle deck clutch 151 is turned on to rotate the middle deck feeding roller (S713). In order to indicate that the sheet feeding operation for the middle deck is being executed, a "mid act flag" on a memory is set (S715).

The sheet is fed by the middle deck sheet feeding roller. When the sheet turns on the middle deck sheet feeding sensor 127, the middle deck pickup solenoid 142 is turned off (S717, S719). When the middle deck sensor 128 turns on, the pickup solenoid 142 is turned on for the transport of the next sheet (S721, S725). When the sheet reaches the position in advance of the middle deck sheet feeding sensor 127 by 125 mm, the upper deck motor 170 and interface motor 169 are braked to stop the sheet (S723, S727, S729).

At this time the sheet is stopped in the form of a loop in contact with the resist roller within the copier main body. When a resist-on signal is received from the copier main circuit (S731), the upper deck motor 170 and interface motor 169 are rotated at a middle speed (about 500 mm/sec). The middle deck clutch 151 is turned off and the interface clutch 159 is turned on (S733), to transport the sheet to the copier main body.

At this time, the "mid act flag" on the memory is reset to permit another sheet feeding sequence (S735). Next, the pulses corresponding to the sheet length are counted (S737, S739), and when the sheet turns off the middle deck sensor 128, the drive system is turned off (S741, S743). In this manner, feeding a single sheet from the middle deck is completed.

Next, the lower deck sheet feeding sequence will be described.

Figure 51:
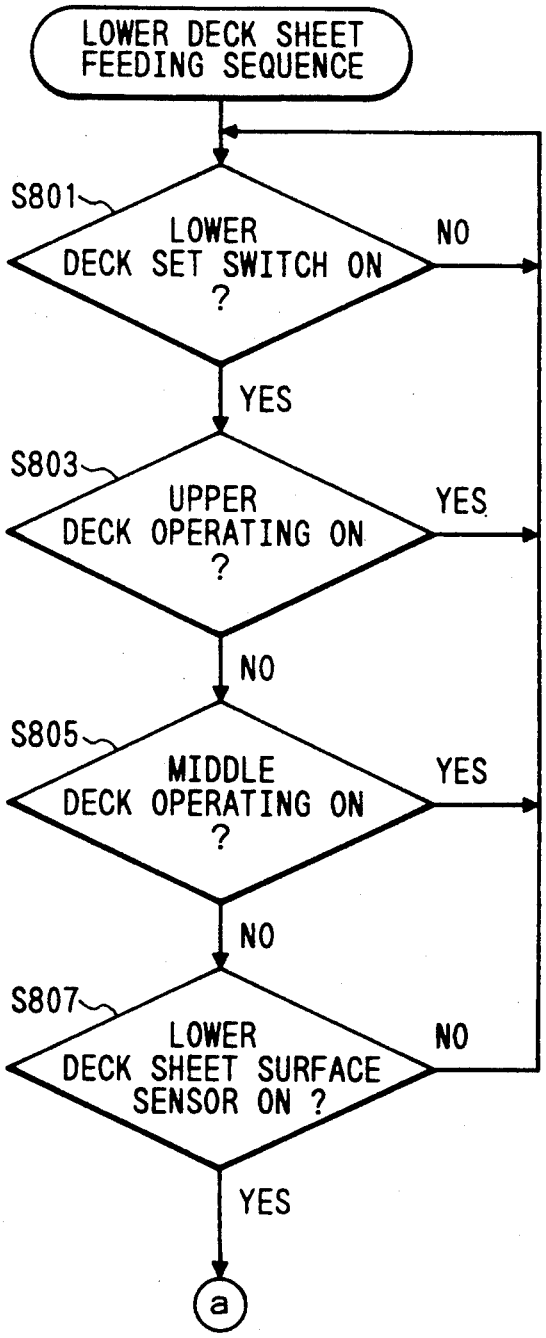
FIG. 51 is a flow chart showing part of a lower deck sheet feeding procedure according to the second embodiment.
Figure 52:
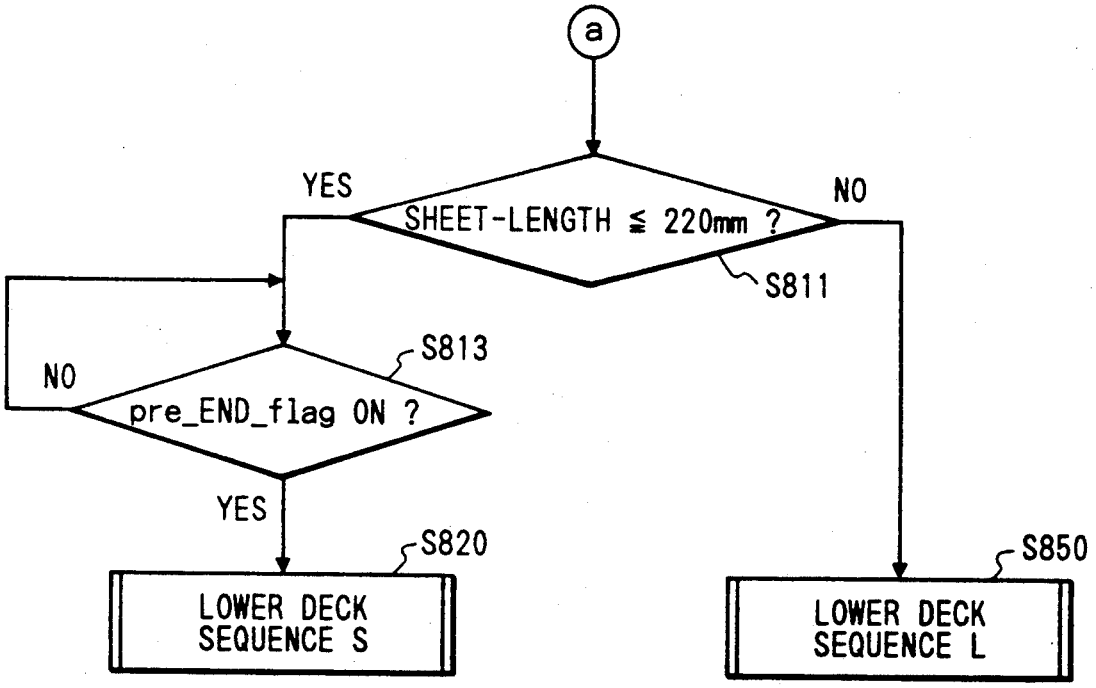
FIG. 52 is a flow chart showing part of the lower deck sheet feeding procedure according to the second embodiment.

FIGS. 51 and 52 are flow charts showing the lower deck sheet feeding sequence. This sequence is executed when a lower deck sheet supply signal is received from the copier main circuit.

As the initial sequence check, it is checked whether the lower deck is being set, whether any one of the upper and middle decks is stopping its operation, whether there are sheets on the lower deck, and whether the lifter has been raised to allow sheet transport (S801, S803, S805, S807). Then, an operation of feeding sheets starts.

In this case, if the length of a sheet in the lower deck is longer than 220 mm in the transport direction, the sheet is transported from the sheet stacker in the similar manner as the cases of the multi sheet feeder and upper/middle deck feeders. However, if the length of a sheet is shorter than 220 mm, a different sheet feeding sequence (sheet prefeeding sequence) is executed by placing a sheet on the transport path in advance.

In this embodiment, if the length of a sheet in the lower deck is longer than 220 mm in the sheet transport direction, the lower deck sheet feeding sequence L is performed after the initial sequence check. If the length of a sheet is shorter than 220 mm, after the initial sequence check, there are executed a flag check at S813 (flag being set in the memory), a lower deck sheet feeding sequence S, and a sheet prefeeding sequence (to be later described) (S811, S813, S820, S850).

First, the control operation for the case where the sheet length is longer than 220 mm in the sheet transport direction will be described with reference to the flow charts shown in FIGS. 51 and 52 and FIGS. 26 and 27 of the first embodiment. After the initial sequence check (S801, S803, S805, S807, S809), the sheet size is checked (S811) and the control advances to the lower deck sheet feeding sequence L.

In the lower deck sheet feeding sequence L, in order to indicate that the sheet feeding operation for the lower deck is being executed, a "low act flag" on a memory is set (S851). Next, it is checked from the interface sensor 1 (137) whether a sheet is present within the interface unit. If present, a timer is started to check if the interface sensor 1 (137) turns off in 100 ms. If the sensor does not turn off, it is considered a jamming.

If the sensor turns off, the control returns to S851. If the sensor 137 is off at S853, the control advances to S855 to check the lower deck sheet (insert) sensor 129. If this sensor 129 is on, the control advances to S861; if off, the count is set to a value corresponding to 60 mm and the lower deck pickup solenoid 143 is turned on to make the pickup roller contact with a sheet (S859).

Next, the lower deck motor 171 is rotated at a middle speed (about 500 mm/sec), and the lower deck clutch 152 is turned on to rotate the lower deck sheet feeding roller (S861). When the count-up is obtained, the lower deck pickup solenoid 143 is turned off (S863, S865) to wait until the lower deck sensor 130 turns on.

When the pulses corresponding to 90 mm have been counted starting from when the lower deck sensor 130 turned on (S867, S869, S871), the lower deck motor 171 and interface motor 169 are rotated at a middle speed (about 500 mm/sec), and the lower deck clutch 152 and interface clutch 2 (160) are turned on (S873). When the sheet turns on the interface sensor 1 (137) and thereafter advances by 40 mm, the lower deck clutch 152 is turned off (S875, S877, S879, S881). When the sheet advances further by 100 mm, the lower deck motor 171 and interface motor 169 are braked to stop the sheet (S883, S885, S887).

At this time the sheet is stopped in the form of a loop in contact with the resist roller within the copier main body. When a resist-on signal is received from the copier main circuit (S889), the lower deck motor 171 and interface motor 169 are rotated at a middle speed (about 500 mm/sec). The lower deck clutch 152 and interface clutch 2 (160) are turned on (S890) to transport the sheet to the copier main body.

At this time, the "low act flag" on the memory is reset to permit another sheet feeding sequence (S891). Next, the pulses corresponding to the sheet length are counted (S892, S893), and when the sheet turns off the interface sensor 1 (137), the drive system is turned off (S894, S895). In this manner, feeding a single sheet from the lower deck is completed.

Next, the control operation for the case where the sheet length is shorter than 220 mm in the sheet transport direction will be described with reference to the flow charts shown in FIGS. 51 and 52, and FIGS. 30 and 31 of the first embodiment. After the initial sequence check (S801, S803, S805, S807, S809), the sheet size is checked (S811) and the flag is checked (S813).

In the case where the length of a sheet in the lower deck is shorter than 220 mm, a sheet is always placed on the transport path during the standby state after the power is turned on, by executing the sheet prefeeding sequence to be described later. Upon reception of a sheet supply signal from the copier main circuit, the sheet on the transport path is fed to the copier main body and another sheet is placed on the transport path.

The flag checked at S813 is a flag which is set when a sheet has been placed on the transport path. Unless this flag is set, no sheet can be fed to the copier main body.

If the flag (pre ENDflag) is being set at S813, the lower deck sheet feeding sequence S is executed (S820).

In the lower deck sheet feeding sequence S, in order to indicate that the sheet feeding operation for the lower deck is being executed, a "low act flag" is set (S821). The interface motor 169 is rotated at a middle speed (about 500 mm/sec) and the interface clutch 2 (160) is turned on (S823). The "pre ENDflag" set on the memory is reset (S825). When the sheet advances further by 140 mm, the interface motor 169 is braked to stop the sheet (S827, S829, S831).

At this time, the sheet is stopped in the form of a loop in contact with the resist roller within the copier main body.

When a resist-on signal is received from the copier main circuit (S833), the interface motor 169 is rotated at a middle speed (about 500 mm/sec). The interface clutch 2 (160) is turned on (S835) to transport the sheet to the copier main body.

At this time, the "low act flag" on the memory is reset to permit another sheet feeding sequence (S837).

Next, the pulses corresponding to the sheet length are counted (S839, S841), and when the sheet turns off the interface sensor 1 (137), the drive system is turned off (S843, S845). In this manner, feeding a single sheet from the lower deck is completed.

Next, the sheet prefeeding sequence will be described with reference to FIG. 32 of the first embodiment.

As the initial check for the sheet prefeeding sequence, it is checked whether the lower deck is being set, whether there are sheets on the lower deck, whether the lifter has been raised to allow sheet transport, and whether the sheet length is shorter than 220 mm in the sheet transport direction (S901, S903, S905, S907).

It is confirmed whether the "pre ENDflag" indicating a completion of a sheet transport to the transport path is on or off (S909). Thereafter, the sheet prefeeding separation sequence and sheet prefeeding sequence are carried out (S920, S970).

Figure 53:
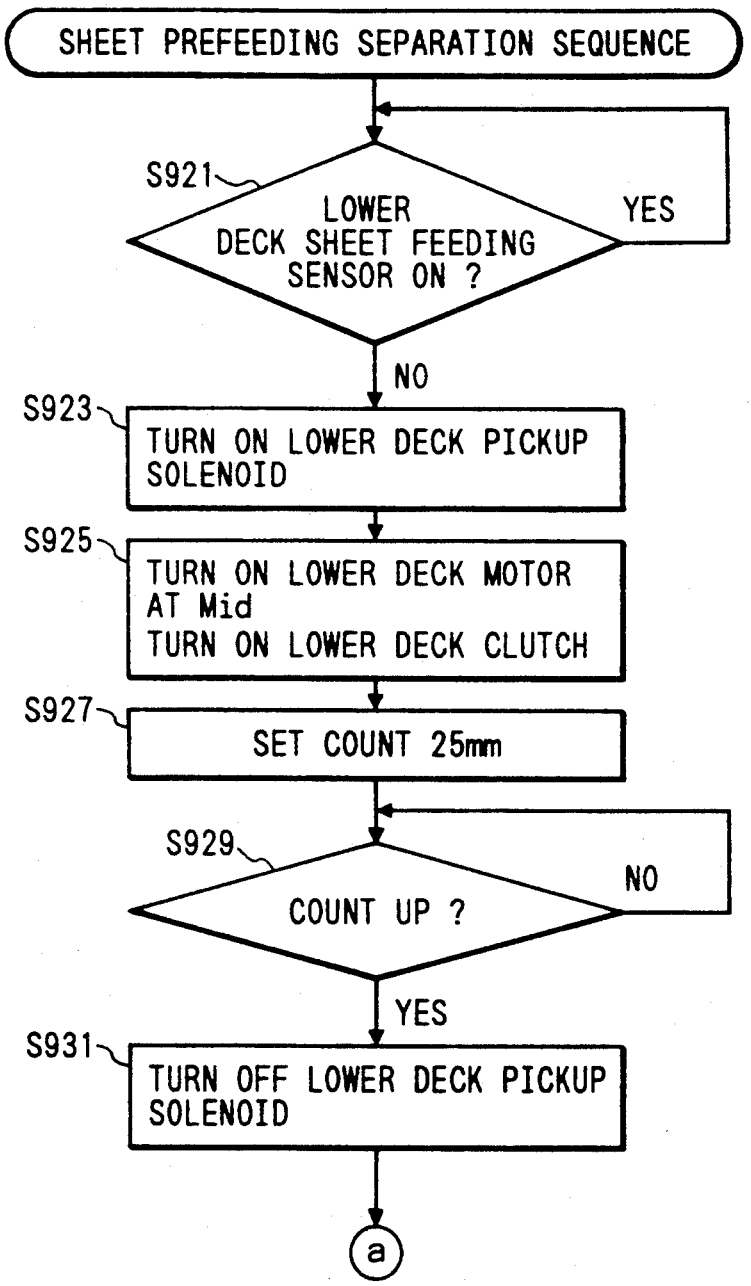
FIG. 53 is a flow chart showing part of a sheet prefeeding separation operation according to the second embodiment.
Figure 54:
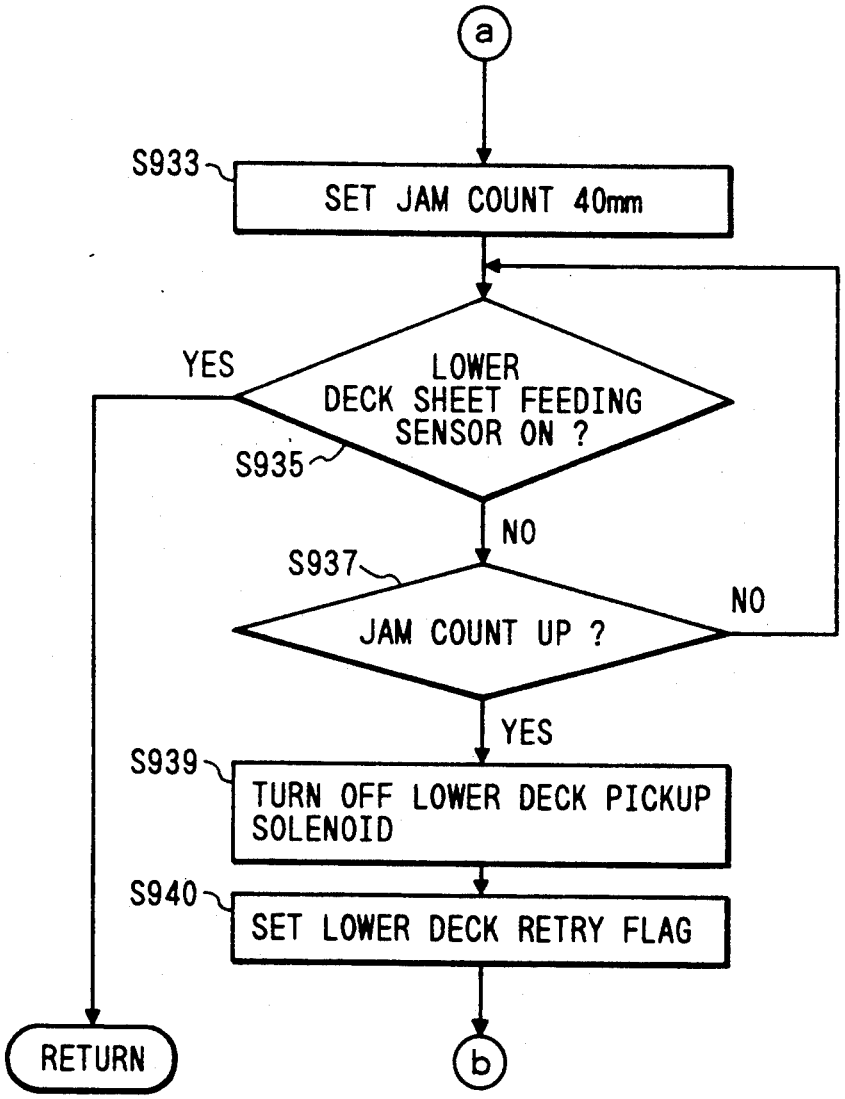
FIG. 54 is a flow chart showing part of the sheet prefeeding separation operation according to the second embodiment.
Figure 55:
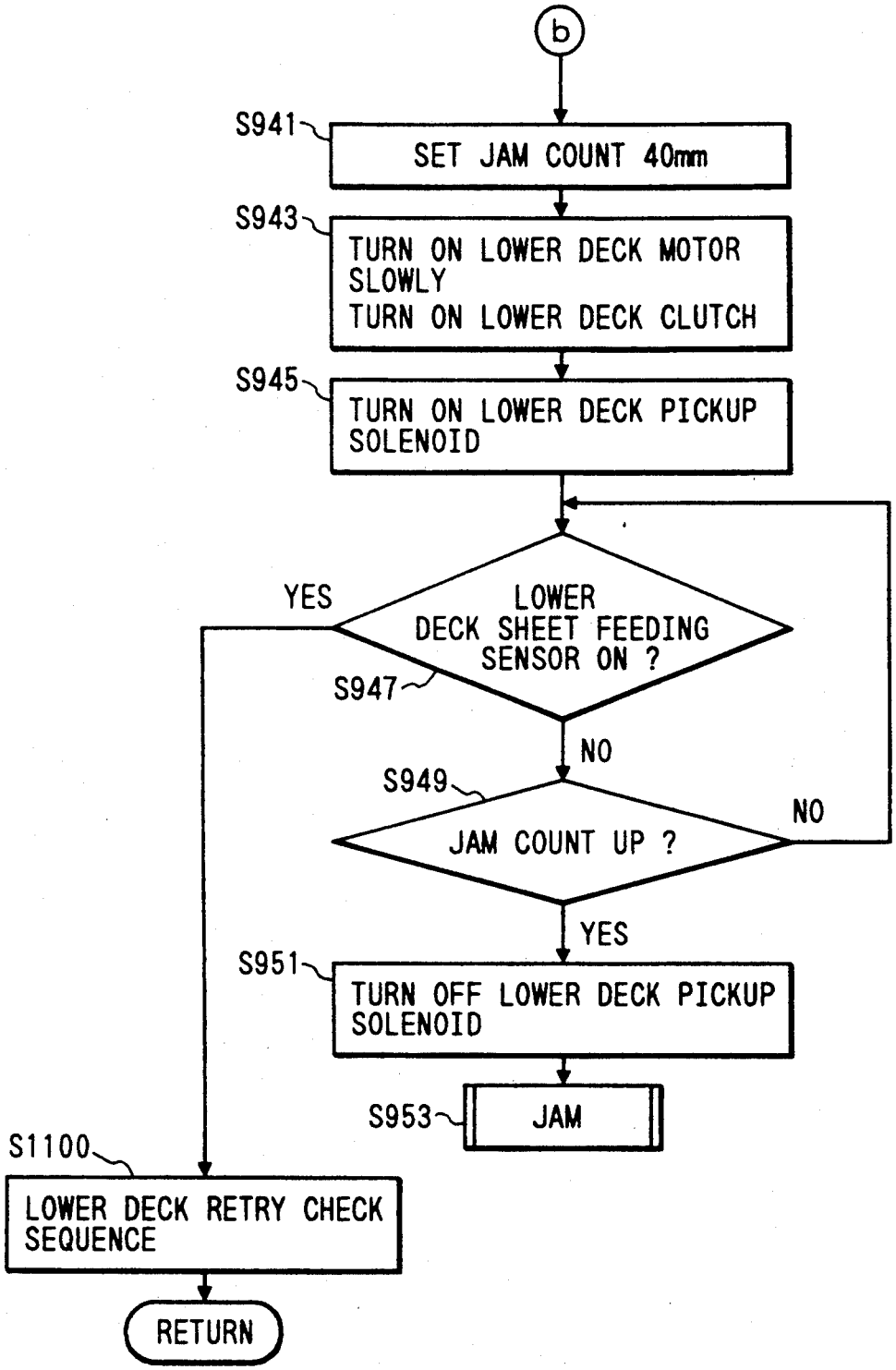
FIG. 55 is a flow chart showing part of the sheet prefeeding separation operation according to the second embodiment.

The sheet prefeeding separation sequence will be described with reference to FIGS. 53 to 55.

It is first checked whether the lower deck sheet feeding sensor 129 is on or off (S921). If on, the lower deck pickup solenoid 143 is turned on to make the pickup roller contact with a sheet (S923). Next, the lower deck motor 171 is rotated at a middle speed (about 500 mm/sec) and the lower deck clutch 152 is turned on to rotate the lower deck sheet feeding roller (S925).

A value corresponding to 25 mm is set as a count value. When a count-up occurs, the lower deck pickup solenoid 143 is turned off (S927, S929, S931). Next, a value corresponding to 40 mm is set as a jamming count value (S933), and the control waits until the lower deck sheet sensor 129 turns on (S935). If this sensor 129 turns on within the time period corresponding to the jamming count value, the separation process is terminated (S937).

If not, this is usually judged as a delay jamming of a fed sheet. In this embodiment, this is judged as a sheet pickup error, and sheet pickup operation is executed again.

If it is possible to feed a sheet from another deck before the re-separation operation starts, then the sheet is fed from the other deck. At this time, the lower retry flag indicating that the re-separation operation is being executed at the lower deck is set (S940) (the operations of the other decks will be later described when explaining the retry follow sequence).

For the lower deck, the rotation speed of the pickup roller is reduced so as not to make the roller slip and to ensure a reliable pickup operation. After the lower deck pickup solenoid 143 is turned off (S939), a new jamming count value corresponding to 40 mm is set (S941). Next, the lower deck motor 171 is rotated at a slow speed (about 350 mm/sec), the lower deck clutch 152 is turned on to rotate the lower deck sheet feeding roller (S943), and the lower deck pickup solenoid 143 is turned on (S945).

The control then waits until the lower deck sheet feeding sensor 129 turns on (S947). If this sensor turns on within the time period corresponding to the jamming count value, the separation operation is terminated to advance to a lower deck retry check sequence (S1100).

If the sensor does not turn on within the time period corresponding to the jamming count value (S949), the lower deck pickup solenoid 143 is turned off (S951) to process it as a sheet jamming (S953).

Figure 56:
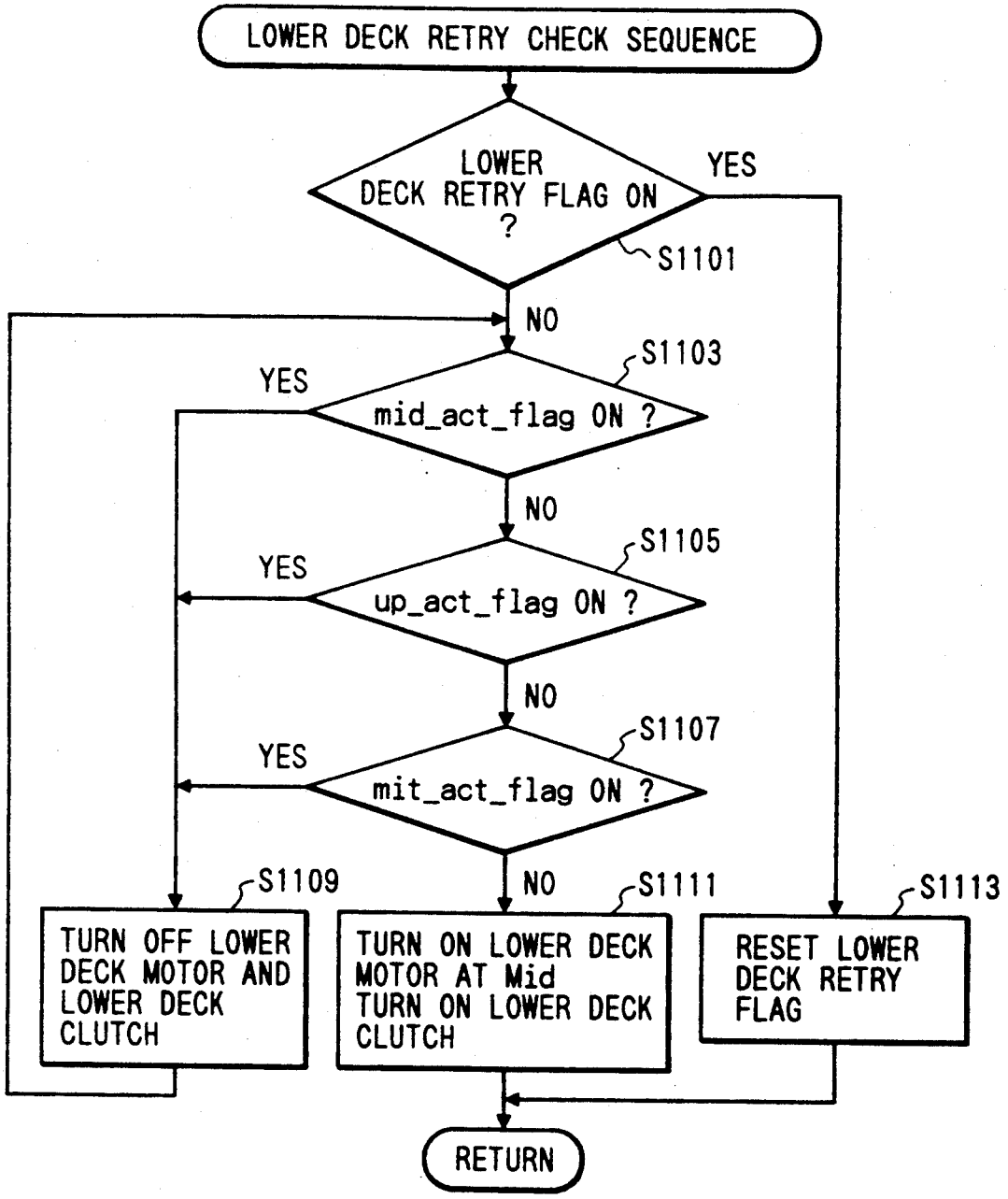
FIG. 56 is a flow chart showing part of a lower deck retry check operation according to the second embodiment.

Next, the lower deck retry check sequence will be described with reference to FIG. 56.

It is first checked whether the lower deck retry flag is on or off. If on, it means that another deck is not feeding a sheet. Therefore, the lower deck retry flag is reset and the operation of the lower deck continues (S1101, S1113).

If off at S1101, it means that any one of the other decks is feeding a sheet. In this case, until all the "act flags" indicating under the sheet feeding operations have been turned off, the lower deck motor 171 and lower deck clutch 152 are maintained turned off (S1103, S1105, S1107, S1100).

When all the other decks have completed sheet feeding, the lower deck motor 171 and lower deck clutch 152 are driven to resume sheet feeding (S1111).

Next, the sheet prefeeding sequence will be described with reference to FIGS. 35 to 37 of the first embodiment.

First, the lower deck pickup solenoid 143 is turned off, and when the pulses corresponding to 90 mm have been counted (S971, S973, S975), the lower deck motor 171 and interface motor 169 are rotated at a middle speed (about 500 mm/sec) and the lower deck clutch 152 and interface clutch 2 (160) are turned on (S977).

When the sheet advances further by 40 mm from when the interface sensor 1 (137) turned on, the lower deck motor 171 and interface motor 169 are braked to stop the sheet (S979, S981, S983, S985). In the above manner, sheet feeding on the transport path has been completed. The "pre ENDflag" on the memory indicating such a condition is set (S987).

After 20 ms, the motor drive is turned off (S989, S991, S993).

Figure 57:
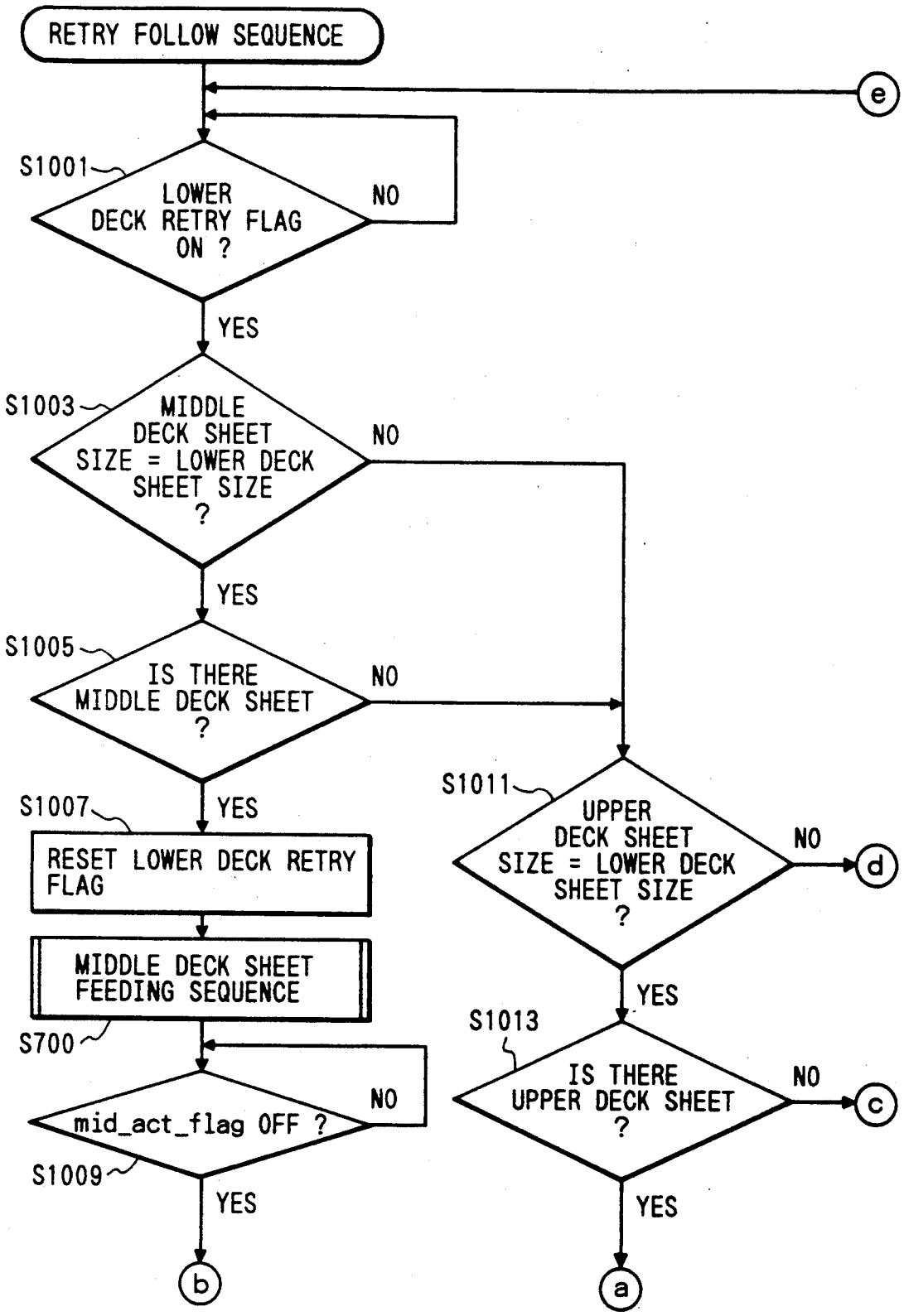
FIG. 57 is a flow chart showing part of a retry follow operation according to the second embodiment.
Figure 58:
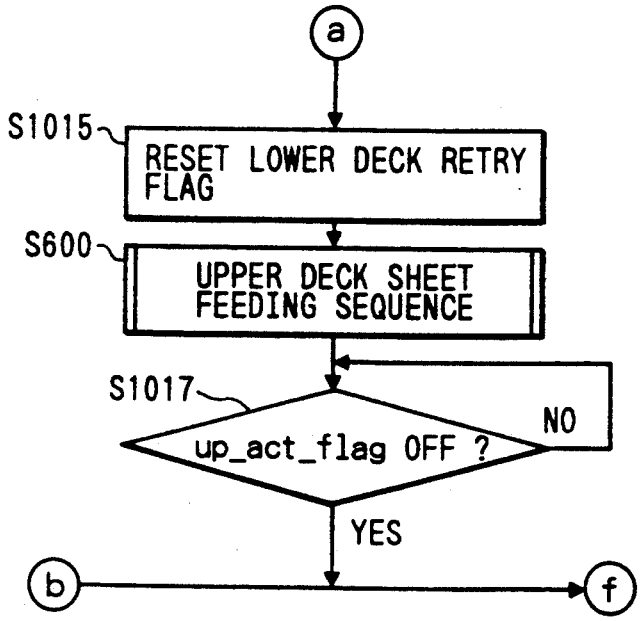
FIG. 58 is a flow chart showing part of the retry follow operation according to the second embodiment.
Figure 59:
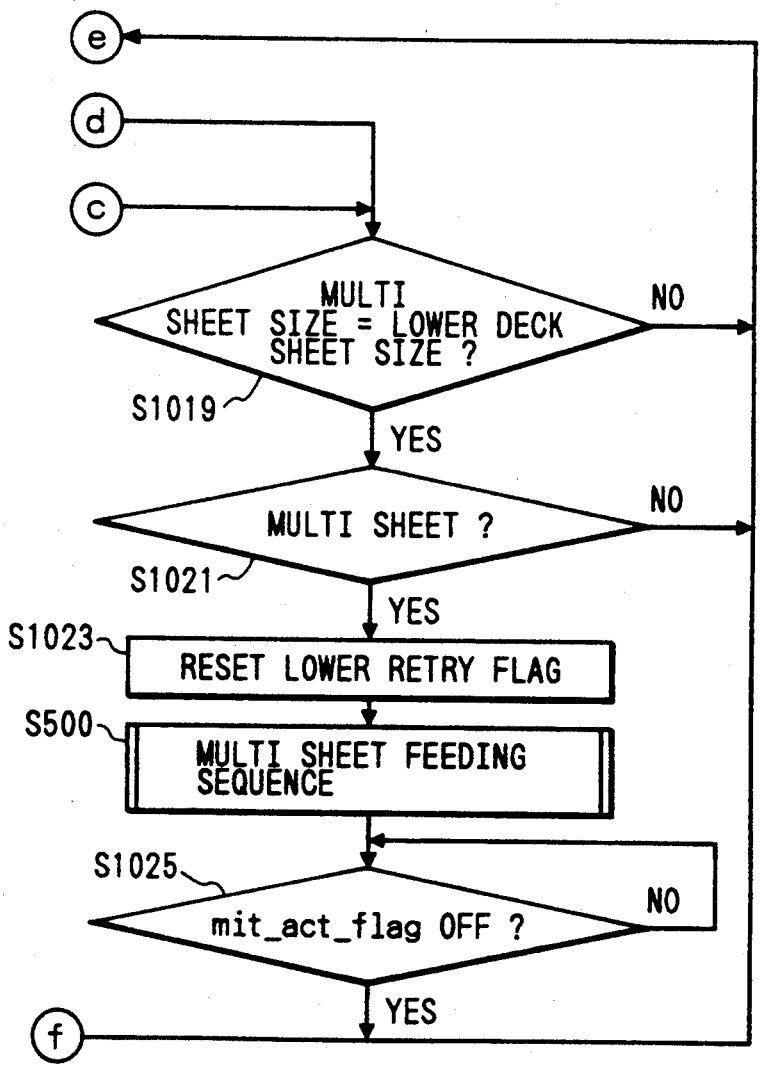
FIG. 59 is a flow chart showing part of the retry follow operation according to the second embodiment.

Next, the retry follow sequence will be described with reference to FIGS. 57 to 59.

No process will be executed unless the lower deck retry flag is on (S1001). If the lower deck retry flag is on, the size of a sheet on the middle deck is compared with that of a sheet on the lower deck. If the sizes are the same, it is checked whether there are sheets on the middle deck (S1003, S1005).

Under the conditions of the same size and presence of sheets, the lower deck retry flag is reset to feed a sheet from the middle deck (S1007, S700), and the control waits until the sheet feeding operation is completed (S1009).

If sheet feeding from the middle deck is impossible, similar judgments and controls are executed for the upper deck and multi sheet feeder (S1011, S1013, S1015, S600, S1017, S1019, S1021, S1023, S500, S1025).

Resetting the lower deck retry flag at S1007, S1015, and S1023 means that, for example in the case of S1007, while the lower deck is under the re-separation operation, the same size sheet is fed from the middle deck. This is also true for the case of the upper deck and multi sheet feeders.

As described above, only when a separation error occurs while a sheet is fed from a sheet stacker at a high speed is, a re-separation operation executed by changing the rotation speed of the separation roller to a stable low speed. After completion of the re-separation operation, the separation speed is again set to a high speed. Therefore, it is possible to improve the overall stabilization of the image forming system, while not lowering the image forming efficiency and reducing the number of jamming interceptions.

Furthermore, when the re-separation operation is performed at a low rotation speed of the separation roller to ensure a stable operation upon occurrence of a separation error of a sheet fed at a high speed, and if there is a sheet on another feeding unit, having the transport path and feeding and driving means, different from the feeding unit at which the separation error occurred, it is possible to feed this sheet during the re-separation operation without lowering the image forming efficiency caused by the lowered separation speed.

3rd Embodiment

An example of applications of the above-described technique to feeding a sheet from the intermediate tray of a copier will be described.

Figure 60:
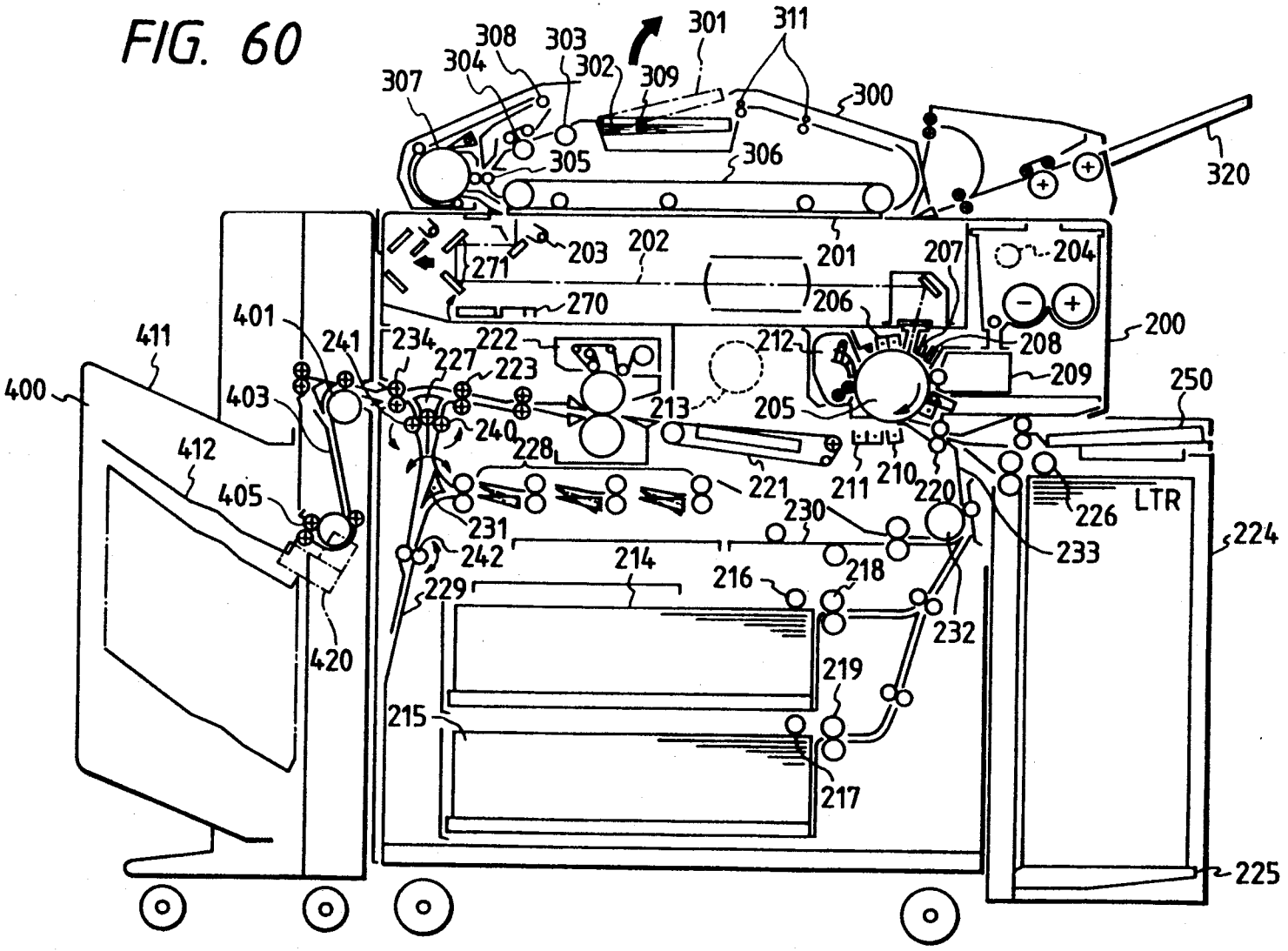
FIG. 60 is a cross sectional view of a copier.

FIG. 60 shows the internal structure of an embodiment of an image forming apparatus to which the present invention is applicable. In FIG. 60, reference numeral 200 represents a copier having an image exposure function and an image recording function. Reference numeral 300 represents a recycle type original feeding apparatus (hereinafter called RDF) for automatically feeding sheets. Reference numeral 310 represents a reserved original feeding apparatus (hereinafter called sub-feeder) for feeding a reserved original while forming an image. Reference numeral 400 represents a sorter with a stapler (hereinafter called a stable sorter). Any one of, or a combination of, these apparatuses 300 to 400 may be used with the copier 200.

A. Copier (200)

In the copier 200, reference numeral 201 represents a platen glass on which an original is placed, reference numeral 202 represents an optical path, reference numeral 203 represents an illumination lamp (exposure lamp) for illuminating an original, reference numeral 204 represents a toner sensor for detecting toner within a hopper, reference numeral 205 represents a photosensitive drum, reference numeral 206 represents a primary charger, reference numeral 207 represents a blank exposure unit, reference numeral 208 represents a potential sensor or detector for measuring a potential on the photosensitive drum, reference numeral 209 represents a developer, reference numeral 210 represents a transfer charger, reference numeral 211 represents a separation charger, reference numeral 212 represents a cleaner, and reference numeral 213 represents a main motor for driving the photosensitive drum and the like.

Reference numeral 214 represents an upper deck, reference numeral 215 represents a lower deck, reference numeral 250 represents a multi sheet manual loading inlet, reference numeral 224 represents a side deck, reference numerals 218 and 219 represent sheet feeding rollers, reference numeral 220 represents resist rollers, reference numeral 221 represents a transport belt for transporting an image recorded sheet to the developer side, and reference numeral 222 represents a fixer for thermally fixing a transported sheet.

A photoconductive member and a seamless photosensitive member made of conductive material are formed on the surface of the photosensitive drum 205. The drum 205 is rotatably supported, and rotated in the direction indicated by an arrow in FIG. 60 by the main motor 213 operating in response to a depression of a copy start key to be described later. Next, after completion of a predetermined rotation control and potential control (pre-process) of the drum 205, the original placed on the platen glass 201 is illuminated by the illumination lamp 203 mounted integrally with a first scan mirror, and the reflected light from the original is focussed on the drum 205 passing through the optical path 202.

The drum 205 is charged by corona discharge of the primary charger 206. Thereafter, an original image illuminated by the illumination lamp 203 is exposed in units of a slit on the drum 205 to form an electrostatic latent image on the drum 205 by means of the well known Carlson process.

Next, the latent image on the photosensitive drum 205 is developed by the developing roller of the developer 209 to visualize it as a toner image. This toner image is transferred on a transfer sheet by the transfer charger 210 as will be described below.

Namely, a transfer sheet set within the upper deck 214, lower deck 215, or side deck 224, or a transfer sheet set at the multi sheet manual feeding inlet 250, is sent to the inside of the copier. The top end of the toner image and the top end of the transfer sheet are aligned by the regist roller 220. Thereafter, the transfer sheet passes between the transfer charger 210 and the drum 205, and moves to the outside of the copier.

After the transfer process, the drum 205 continues to rotate so that the surface thereof is cleaned by the cleaner 212 constructed of a cleaning roller and elastic blade.

Next, the operations of the intermediate tray and reversed sheet discharge will be described. Reference numeral 227 represents a sheet discharge flapper for switching between a path to be used for both-side recording, multiple recording and reversed discharge and a path to be used for normal discharge. Reference numeral 229 represents switchback rollers for reversed discharge. Reference numeral 231 represents a reversed discharge flapper for switching between a path to be used for both-side recording and multiple recording and a path to be used for reversed discharge. This reversed discharge flapper 231 guides a transfer sheet to the switchback roller 229 by pivoting to the right. Reference numeral 228 represents intermediate tray discharge flappers which pivot by an amount corresponding to the length of a sheet. A transfer sheet passed through the discharge flapper 227 is reversed by the switchback rollers 229 and accommodated within the intermediate tray 230. Reference numeral 232 represents a sheet feeding roller for feeding a transfer sheet to the drum 205 side.

In the both-side recording (both-side copying), the discharge flapper 227 is raised and the reversed discharge flapper 231 is pivoted to the right so that a recorded transfer sheet is guided to the switchback rollers 229. After the transfer sheet passes through the reversed flapper 231, the switchback rollers 229 are rotated reversely so that the transfer sheet is guided via the intermediate tray discharge flappers 228 to the intermediate tray 230.

In the multiple recording (multiple copying), the discharge flapper 227 is raised and the reversed discharge flapper 231 is pivoted to the left so that a recorded transfer sheet is guided via the intermediate discharge flappers 228 to the intermediate tray 230. The intermediate tray 230 can accommodate transfer sheets, for example, 50 transfer sheets.

In the back side recording or multiple recording to be next performed, transfer sheets loaded in the intermediate tray 230 are guided one sheet after another to the resist rollers 220. As described previously, after the latent image is transferred, the transfer sheet passes between the transfer charger 210 and the drum 205, and moves to the outside of the copier 200.

In the reversed discharge, the reversed discharge flapper 231 is pivoted to the right so that a transfer sheet is guided to the switchback rollers 229. When the transfer sheet reaches the switchback rollers 229 sufficiently, the switchback rollers are rotated reversely to eject out the transfer sheet by means of discharge rollers 234.

The control operation for the intermediate tray will be later described in detail.

B. RDF (recycle type original feeding apparatus) (300)

In RDF 300, reference numeral 301 represents a tray on which a bundle of originals 302 is placed. For the one-side original, the bottom sheet is separated from the bundle of originals 302 by means of a half moon roller 303 and separation roller 304. The separated original is transported to and stopped at the exposure position of the platen glass 201 by means of feeding rollers 205 and an endless belt 306. Thereafter, the copy operation starts. After the copy operation, the original on the platen glass 201 is sent back to the top of the bundle of originals 302 by means of a large transport roller 307 and a discharge roller 308.

Reference numeral 309 represents a recycle lever for detecting one cycle of an original. This lever 309 is placed on the bundle of originals when an original starts being fed. The lever 309 falls on the tray 301 when the trailing edge of the last original passes through the lever, so that one cycle of originals can be detected.

C. Staple Sorter (Sorter with Stapler) (400)

The staple sorter 400 has a fixed non-sort tray 411 of 20 bins, and sorts sheets.

In the sort mode, copied sheets are sequentially discharged by the discharge rollers 234, and fed to a feeding roller 401 of the sorter 400. Each time a sheet is discharged to each bin of a tray 412 by way of a feeding path 403 and discharge rollers 405, a bin shift motor (not shown) moves each bin up and down to sort the copied sheets. When a staple mode is selected and a staple signal is outputted from the copier 200, a stapler 420 staples the sheets on each bin while moving one bin after another by the bin shift motor.

Figure 61:
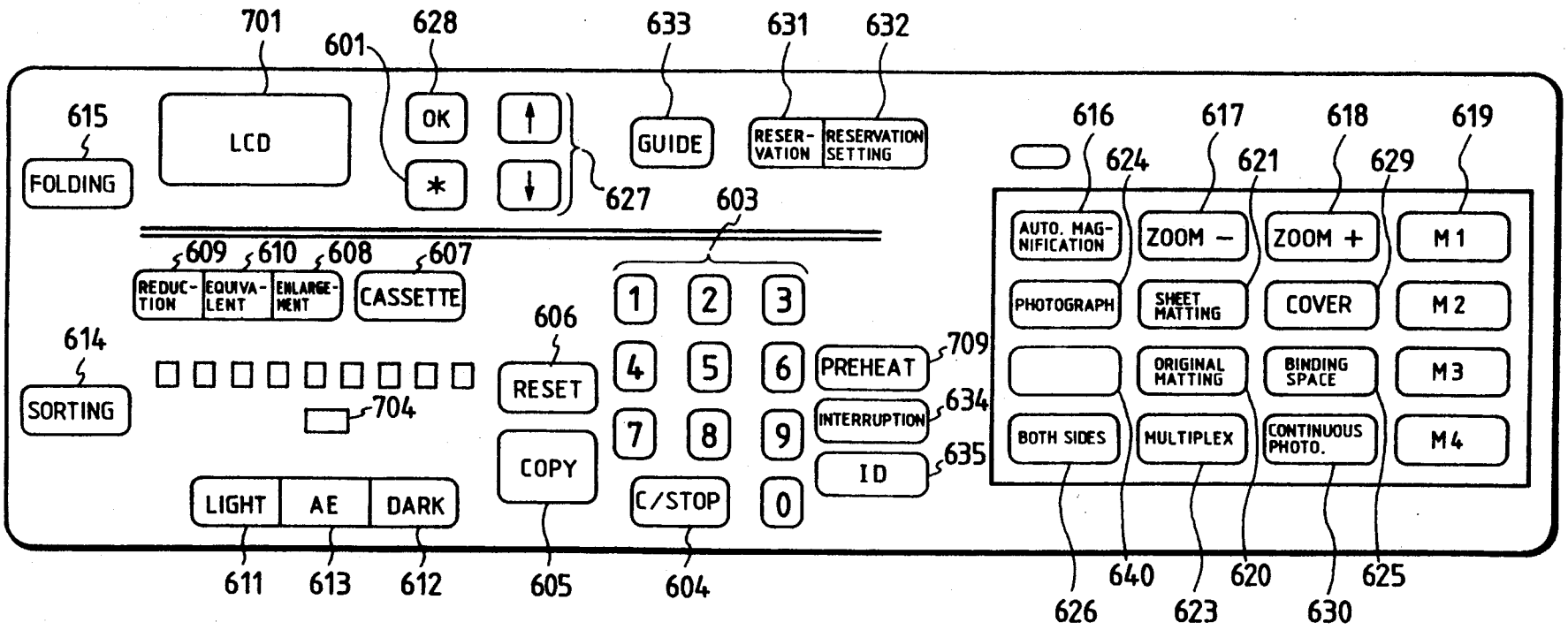
FIG. 61 is a diagram of an operation unit of the copier.

FIG. 61 shows an example of the layout of the operation panel mounted on the copier 200. The operation panel has keys 600 and displays 700 described below.

D. Keys (600)

In FIG. 61, reference numeral 601 represents an asterisk key which is used in an operator setting mode such as setting a binding space and setting a sheet matting size. Reference numeral 606 represents an all-reset key which is depressed when returning to a standard mode.

Reference numeral 605 represents a copy start key which is depressed when starting a copy operation.

Reference numeral 604 represents a clear/stop key which has a function of a clear key during the standby state and a function of a stop key during the copy operation. The clear key is also used when releasing the set number of transfer sheets. The stop key is depressed when intercepting a continuous copy operation. The copy operation stops after the original at the time of depressing the stop key has been copied completely.

Reference numeral 603 represents ten keys which are depressed when setting the number of transfer sheets, and are also used when setting an asterisk mode. Reference numeral 619 represents a memory key by which a frequently used mode can be registered. In this example, four modes M1 to M4 can be registered.

Reference numerals 611 and 612 represent copy density keys which are depressed when manually adjusting a copy density. Reference numeral 613 represents an AE key which is used for automatically adjusting a copy density, or depressed for releasing an automatic density adjustment (AE) and switching to a manual mode. Reference numeral 607 represents a cassette select key which is depressed when selecting one of the following upper deck 114, lower deck 115, side deck 124, and multi sheet manual feeder 150. If an original is placed on RDF 200, an APS (automatic sheet cassette select) mode can be selected by this key 607. When the APS mode is selected, the cassette having sheets whose size is the same as that of an original can be automatically selected.

Reference numeral 610 represents an equivalent magnification key which is depressed when copying at an equivalent magnification. Reference numeral 616 represents an automatic magnification key which is depressed for automatically reducing and magnifying the image of an original so as to match the designated size of a transfer sheet.

Reference numeral 626 represents a both-side key which is depressed when copying a one-side original to a both-side transfer sheet, a both-side original to a both-side transfer sheet, or a both-side original to a one-side transfer sheet. Reference numeral 625 represents a binding space key which is used when providing a binding space of a designated length on the left side of a transfer sheet. Reference numeral 624 represents a photograph key which is depressed when copying an original photograph. Reference numeral 623 represents a multiplex key which is depressed when combining two original images on the same side of a transfer sheet.

Reference number 620 represents an original matting key which is depressed when matting a regular size original. The original size is set by an arrow key 627 and OK key 628. Reference numeral 621 represents a sheet matting key which is depressed when matting an original so as to match the cassette size. Reference numeral 614 represents a sheet discharge method select key for selecting one of a staple mode, a sort mode, and a group mode. With this key, if the stapler for stapling copied sheets is mounted, staple mode or sort mode can be selected or the selected mode can be released; whereas, if the sorter is mounted, the sort mode or group mode can be selected or the selected mode can be released.

Reference numeral 615 represents a sheet folding select key. With this key, a Z-shape folding mode or half folding mode can be selected or the selected mode can be released. In the Z-shape folding mode, a copied sheet of A3 or A4 size is folded in a Z-shape in cross section. In the half folding mode, a copied sheet of A3 or A4 size is folded by halves.

E. Displays (700)

In FIG. 61, reference numeral 701 represents a message display of an LCD (liquid crystal display) type for displaying copy information. For example, one character is formed by 8 * 8 dots, and it is possible to display a sentence of 40 characters or a copy magnification factor set by regular magnification keys 608 and 609, equivalent magnification key 610, or zoom keys 617 and 618. This display 701 is made of a semi-transparent liquid crystal with a back light being illuminated.

Reference numeral 704 represents an AE display which turns on when the AE mode is selected by the AE key 613. Reference numeral 709 represents a preheat display which turns on when copying a both-side original to a both-side transfer sheet or copying a one-side original to a both-side transfer sheet.

In the standard mode using RDF 300, the default settings are one sheet to be copied, the AE density mode, the automatic sheet select, the equivalent magnification, and the mode of copying a one-side original to a one-side transfer sheet. In the standard mode without using RDF 300, the default settings are one sheet to be copied, the manual density mode, the equivalent magnification, and the mode of copying a one-side original to a one-side transfer sheet. Whether RDF 300 is used is determined from whether an original is being set on RDF 300.

G. Controller (800)

Figure 62:
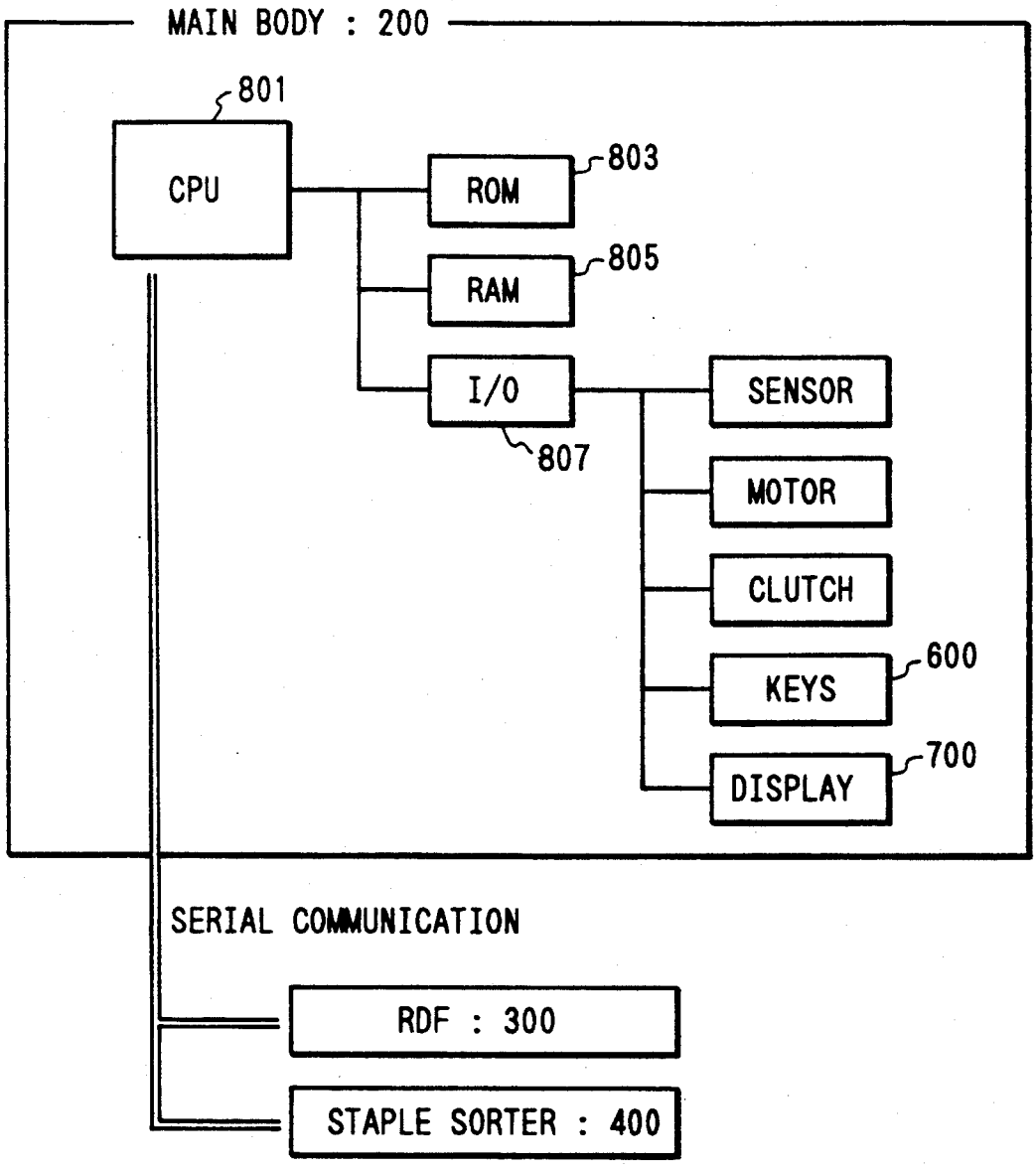
FIG. 62 is an electrical circuit diagram in block form of the copier.

FIG. 62 shows an example of the structure of a controller 800 of the copier. In FIG. 62, reference numeral 801 represents a central processing unit (CPU) for controlling the operation of the copier and for controlling the arithmetic operation, which is a 16 bit microcomputer for example. Reference numeral 803 represents a read-only memory (ROM) for storing control procedures (control programs). CPU 801 controls the constituent elements of the copier in accordance with the control programs stored in ROM 803. Reference numeral 805 represents a random access memory (RAM) as a main storage unit for storing input data and for serving as working areas.

Reference numeral 807 represents an I/O interface for interfacing between input and output control signals supplied to and from CPU 801. The I/O interface is connected to sensors such as the sheet surface sensor 121, and to loads such as the main motor and clutches.

The I/O interface 807 is also connected to the keys 600 and displays 700. CPU 801 can know from a known key matrix method which key has been depressed. These interfaces 807, 809, 811 may use an input/output circuit port 8355 for example.

CPU 801 serially communicates with controllers for peripheral apparatuses such as RDF and staple sorter, and exchanges control data and timing signals necessary for the operation control.

H. Example of Operation

The control operation for the intermediate tray will be described in detail.

Figure 63:
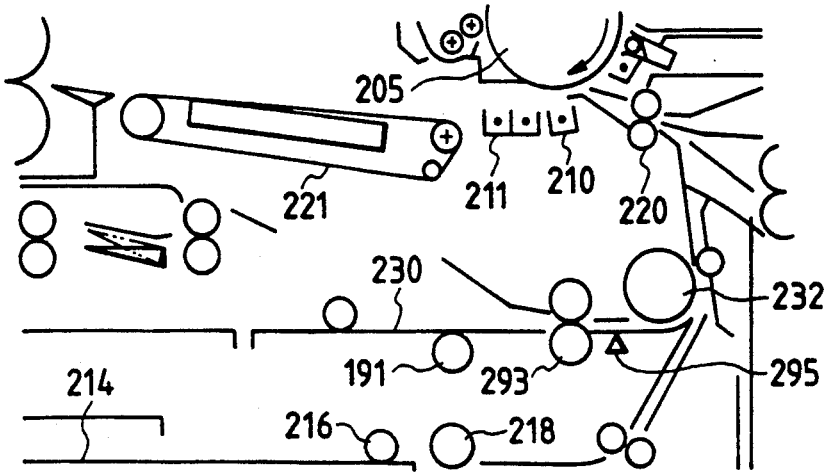
FIG. 63 is an enlarged diagram showing a middle tray of the copier.

FIG. 63 is an enlarged view of the intermediate tray shown in FIG. 60. For the operation of forming an image on one side of a transfer sheet, such as for the both-side image forming mode and the multiple image forming mode, sheets are accommodated within the intermediate tray 230. For the operation of forming an image on the other side of a transfer sheet, a sheet on the intermediate tray is separated by the separation roller 291 and fed to the feeding rollers 293. The sheet is detected by an intermediate tray sheet sensor 295 mounted downstream of the feeding rollers 293, and fed to the resist rollers 220 at the proper timings by means of the feeding rollers 293 and sheet feeding roller 232. Jamming of a sheet can be detected based upon whether the intermediate tray sheet sensor 295 detects the sheet within a predetermined time period after the start of the separation operation by the separation roller 291, or within a predetermined distance determined from a count of encoder clocks. According to the present invention, a delayed detection of a sheet by the intermediate tray sheet sensor 295 is considered a separation error of the separation roller 291. A delayed detection of a sheet by the intermediate tray sheet sensor 295 at the first separation operation is not considered as sheet jamming, but the separation operation is again performed by the separation roller 291. At the second separation operation, in order to reduce a possibility of separation error, the separation roller 291 is rotated slower than the first separation operation, thereby improving the stability of the separation operation. At this time, the rotation speed of the feeding rollers 293 is changed so as to match that of the separation roller 291, and after the recovery operation of the separation error at the intermediate tray, the rotation speeds of the separation roller 291 and feeding rollers 293 are set to the original speeds, thereby preventing the image forming efficiency from being lowered unneccessarily. If a delayed detection of a sheet is found by the intermediate tray sheet sensor 295 at the second separation operation, it may be considered as sheet jamming, or the separation operation may be carried out again at still a lower separation operation speed. In other words, the separation operation may be made desired times unless the motor stops.

The operation of feeding a sheet from the intermediate tray will be further described with reference to the flow charts shown in FIGS. 64 and 65.

Figure 64:
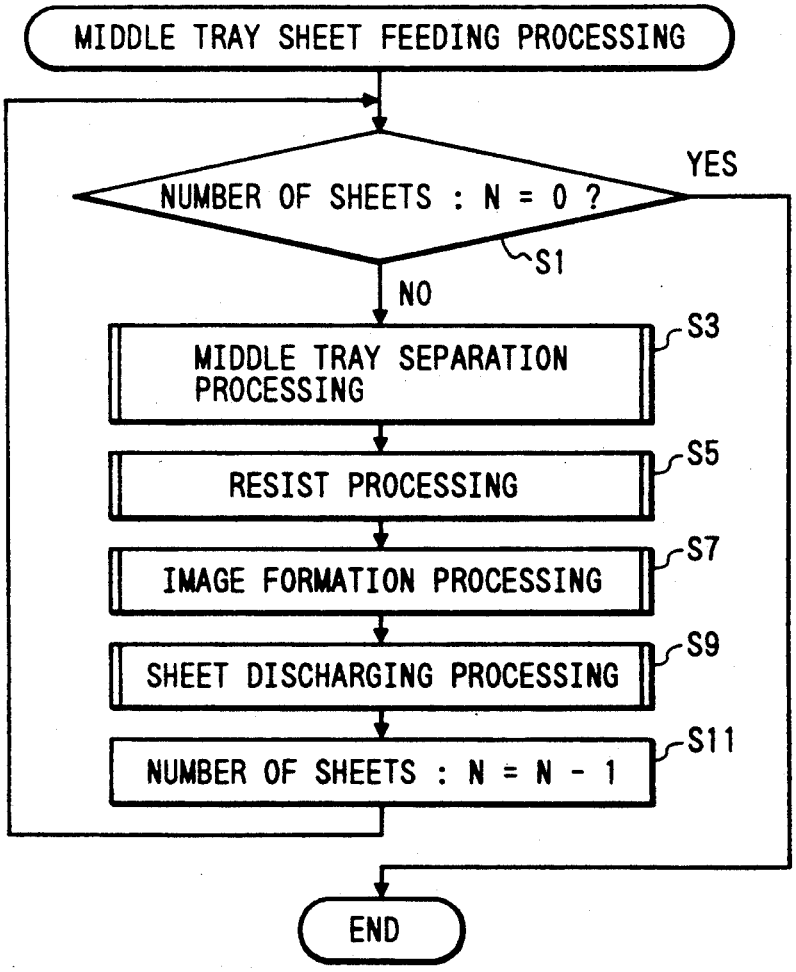
FIG. 64 is a flow chart showing a middle tray sheet feeding process.
Figure 65:
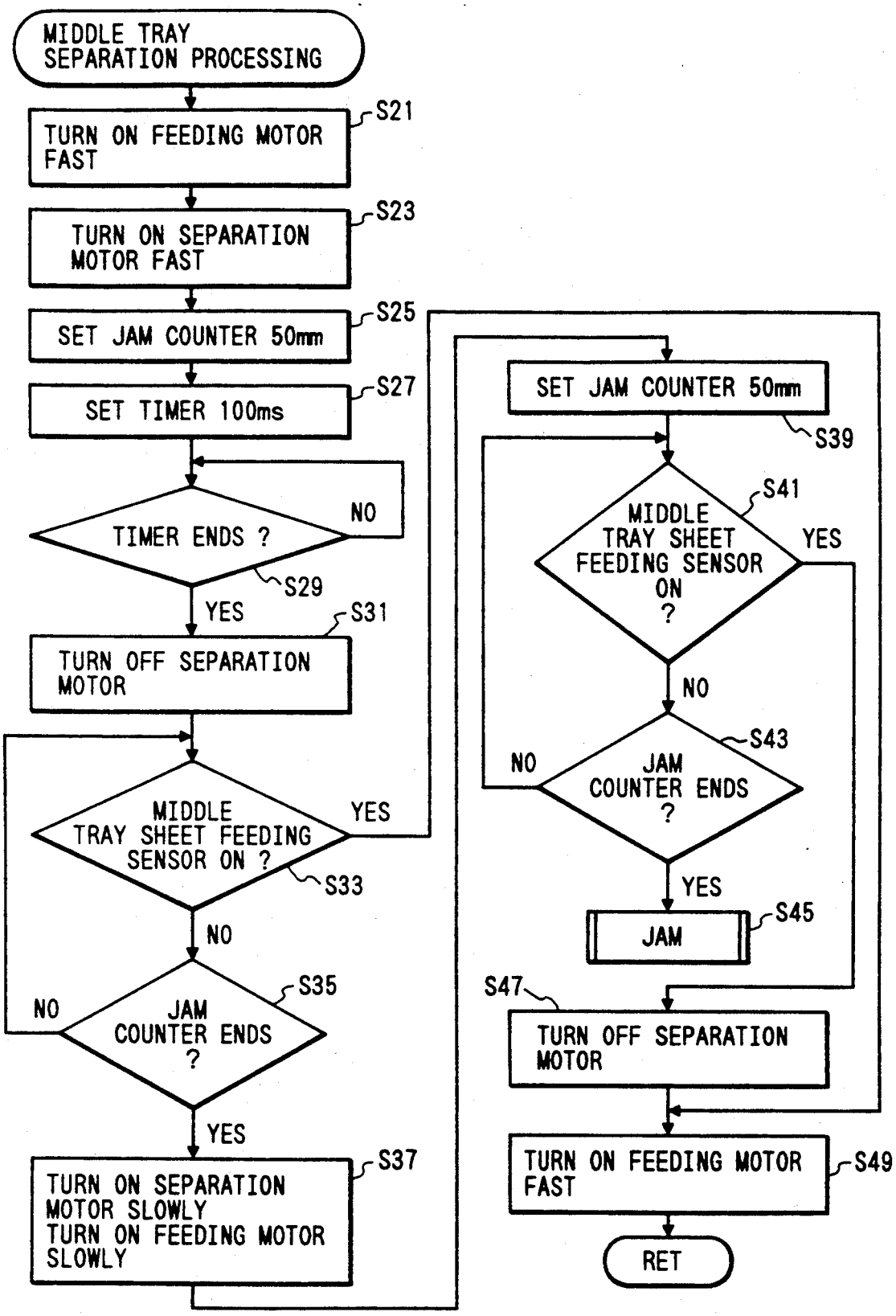
FIG. 65 is a flow chart showing a middle tray sheet separation process.

FIG. 64 is the flow chart showing an intermediate tray sheet feeding procedure including the separation operation at the intermediate tray and the sheet discharge operation.

First, the number N of sheets remaining on the intermediate tray is checked at step S1. Every time one sheet is loaded to the intermediate tray, the number N is incremented by 1, and every time one sheet is fed from the intermediate tray, the number N is decremented by 1. If N = 0, i.e., if no sheet is on the intermediate tray, this procedure is terminated. If it is found at step S1 that there is one or more sheets on the intermediate tray, the separation process at the intermediate tray is executed at step S3. Thereafter, the resist process by the resist rollers 220 is executed at step S5, the image forming process is executed at step S7, and the sheet discharge process is executed at step S9 for discharging the sheet to the outside of the copier. After the number N of sheets remaining on the intermediate tray is decremented by 1, the control returns to step S1. In this manner, the procedure continues until the number of sheets remaining on the intermediate tray becomes 0.

Next, the intermediate sheet separation operation will be described with reference to the flow chart shown in FIG. 65.

The feeding motor for driving various feeding rollers and the separation motor for driving the separation roller 191 are rotated at a fast speed at steps S21 and S23. When the separation motor rotates, the separation roller 191 rotates to start the sheet separation operation. Next, the jam detecting counter is set to a value corresponding to a movement of 50 mm (step S25). A separation operation timer (100 ms) is made to start. After the count-up of the timer, the separation motor is stopped to terminate the sheet separation procedure (step S27, step S29, step S31). This procedure then stands by (step S33) until the sheet is detected by the intermediate sheet sensor 295 before the count operation of the jam counter is completed (step S35). If the sheet is detected, it means a normal separation operation. Therefore, the procedure advances to step S49 whereas the intermediate tray sheet separation operation is terminated while maintaining the feeding motor to rotate at a fast speed. If the sheet is not detected at steps S33 and S35 by the intermediate tray sheet sensor 295 before the count operation of the jam counter is completed, both the separation motor and feeding motor are rotated at a slower speed than the original fast speed (step S37). Namely, the separation roller 291 is rotated at a low speed to perform a stable separation operation. The jam counter is again set (step S39), and the procedure stands by (step S41) until the sheet is detected by the intermediate tray sheet sensor 295 before the count operation of the jam counter is completed (step 43). If the sheet is detected, it means a normal separation operation. Therefore, at step S47 the separation motor is stopped, and the feeding motor is rotated at the original fast speed at step S49, to thereafter terminate the intermediate tray sheet separation operation. If the sheet is not detected at steps S41 and S43 by the intermediate tray sheet sensor 295 before the count operation of the jam counter is completed, it is judged as sheet jamming (step S45).

The separation motor and feeding motor may be a single motor which drives the feeding rollers and separation roller independently by means of clutches.

The resist process, image forming process, and sheet discharge process shown in FIG. 64 are not relevant directly to the present invention, and so the detailed description thereof is omitted.

As described so far, sheets are fed from the intermediate tray at a high speed. Only when a separation error occurs at the intermediate tray, the rotation speed of the separation roller is changed to a more stable low speed and the separation operation is again performed. Accordingly, without considerably lowering the image forming process efficiency, it is possible to reduce the number of separation errors, to avoid image forming operation interception caused by jamming, wasted expendables, and complicated recovery operation, and to realize an improved stability of the image forming system.

What is claimed is:

1. A sheet feeding apparatus comprising:

sheet stacking means for stacking a plurality of sheets and accommodating said sheets;

separation means for separating said sheets stacked on said stacking means one sheet after another;

sheet detecting means mounted at the downstream of said separation means for detecting said sheet separated by said separation means; and control means for activating again, if said sheet detecting means does not detect said sheet after the start of the operation of said separation means, said separation means at a lower operation speed, and if said sheet detecting means detects said sheet thereafter, setting the operation speed of said separation means to an original speed.

2. A sheet feeding apparatus according to claim 1, further comprising sheet feeding means for feeding said sheet separated by said separation means, wherein said control means lowers the feeding speed of said sheet feeding means if said control means lowers the operation speed of said separation means, and sets the feeding speed of said sheet feeding means to an original speed if said control means sets the operation speed of said separation means to an original speed.

3. A sheet feeding apparatus according to claim 1, wherein said control means executes a sheet jamming relieving process if said sheet detecting means does not detects said sheet after said separation means is activated again.

4. A sheet feeding apparatus comprising:

a plurality of sheet feeding means each having separation means for separating sheets one after another;

sheet detecting means mounted at the downstream of said separation means of a first sheet feeding means among said plurality of sheet feeding means, for detecting said sheet separated by said separation means of said first sheet feeding means; and control means for activating again, if said sheet detecting means does not detect said sheet after the start of the operation of said separation means of said first sheet feeding means, said separation means of said first sheet feeding means at a lower operation speed, and if said sheet detecting means of said first sheet feeding means detects said sheet thereafter, setting the operation speed of said separation means of said first sheet feeding means to an original speed wherein in activating again said separation means of said first sheet feeding means, if a second sheet feeding means has a sheet of the same size as that of said sheet to be fed by said first sheet feeding means, said control means activates said second sheet feeding means prior to activating again said separation means of said first sheet feeding means.

5. A sheet feeding apparatus according to claim 4, wherein said control means activates again said separation means of said first sheet feeding means after activation said second sheet feeding means.

6. A sheet feeding apparatus according to claim 5, wherein said control means sets the operation speed of said separation means of said first sheet feeding means to an original speed, if said sheet detecting means detects said sheet after said separation means of said first sheet feeding means is activated again.

7. A sheet feeding apparatus comprising:

image forming means for forming an image on a sheet;

means for temporarily holding said sheet with an image being formed by said image forming means;

separating said sheets held by said holding means one after another;

sheet detecting means mounted at the downstream of said separation means for detecting said sheet separated by said separation means; and control means for activating again, if said sheet detecting means does not detect said sheet after the start of the operation of said separation means, said separation means at a lower operation speed.

8. A sheet feeding apparatus according to claim 7, wherein said control means sets the operation speed of said separation means to an original speed, if said sheet detecting means detects said sheet after said separation means is activated again.

9. A sheet feeding apparatus according to claim 7, further comprising sheet feeding means for feeding said sheet separated by said separation means, wherein said control means lowers the feeding speed of said sheet feeding means if said control means lowers the operation speed of said separation means.

* * * * *

UNITED STATES PATENT AND TRADEMARK OFFICE

CERTIFICATE OF CORRECTION

PATENT NO. : 5,299,795

DATED : April 5, 1994

INVENTOR(S) : NORIFUMI MIYAKE

It is certified that error appears in the above-indentified patent and that said Letters Patent is hereby corrected as shown below:

Column 1,

Line 46, "and Not" should read --Not--.

Column 5,

Line 5, "unit. (2)" should read --unit.--, new paragraph --(2)--;

Line 19, "position" should read --position.--;

Line 23, "position" should read --position.--;

Line 28, "position" should read --position.--; and

Line 38, "decks" should read --decks.--.

Column 7,

Line 37, "signal" should read --signal.--;

Line 42, "signal" should read --signal.--;

Line 46, "signal" should read --signal.--; and

Line 52, "sequence (S200)" should read --sequence (S200).--.

UNITED STATES PATENT AND TRADEMARK OFFICE

CERTIFICATE OF CORRECTION

PATENT NO. : 5,299,795

DATED : April 5, 1994

INVENTOR(S) : NORIFUMI MIYAKE

It is certified that error appears in the above-indentified patent and that said Letters Patent is hereby corrected as shown below:

Column 8,
Line 40, "omitted" should read --omitted.--.

Column 9,
Line 31, "has" should read --have--.

Column 10,
Line 4, "on," should read --on--; and
Line 39, "starts" should read --starts.--.

Column 12,
Line 12, "feeder." should read --feeders.--;
Line 60, "sensor/(137)" should read --sensor 1(137)--.

Column 13,
Line 29, "to" should read --on--.

Column 14,
Line 68, "having" should read --(having--.

Column 15,
Line 1, "mean)" should read --means)--; and
Line 36, "and if" should be deleted.

UNITED STATES PATENT AND TRADEMARK OFFICE

CERTIFICATE OF CORRECTION

PATENT NO. : 5,299,795

DATED : April 5, 1994

INVENTOR(S) : NORIFUMI MIYAKE

It is certified that error appears in the above-indentified patent and that said Letters Patent is hereby corrected as shown below:

Column 18,
Line 65, "sensor 130" should read --sensor 130 is--.

Column 21,
Line 20, "sensor 1(137)" should read --sensor 1(137) is--; and
Line 53, "is," should read --, is--.

Column 26,
Line 9, "whether" should read --whether the--.

Column 28,
Line 66, "detects" should read --detect--.

Column 29,
Line 28, "tion" should read --tion of--.

Column 30,
Line 10, "separating" should read --separation means for separating--.

Signed and Sealed this

Twentieth Day of September, 1994

Bruce Lehman

*Attest:*

BRUCE LEHMAN

*Attesting Officer*

*Commissioner of Patents and Trademarks*